US006589701B2

(12) United States Patent
Yamazaki et al.

(10) Patent No.: US 6,589,701 B2
(45) Date of Patent: Jul. 8, 2003

(54) DRY TONER, IMAGE FORMING METHOD AND PROCESS CARTRIDGE

(75) Inventors: Katsuhisa Yamazaki, Numazu (JP); Tsutomu Onuma, Yokohama (JP); Nobuyuki Okubo, Yokohama (JP); Tsuneo Nakanishi, Abiko (JP); Kaori Hiratsuka, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/911,723

(22) Filed: Jul. 25, 2001

(65) Prior Publication Data

US 2002/0051922 A1 May 2, 2002

(30) Foreign Application Priority Data

Jul. 28, 2000 (JP) ..... 2000-228078

(51) Int. Cl.[7] ..... G03G 9/083

(52) U.S. Cl. ..... 430/106.2; 430/111.4; 430/122; 399/262

(58) Field of Search ..... 430/110.3, 110.4, 430/106.2, 111.4, 122; 399/262

(56) References Cited

U.S. PATENT DOCUMENTS

| | | | | |
|---|---|---|---|---|
| 2,297,691 A | | 10/1942 | Carlson | |
| 3,666,363 A | | 5/1972 | Tanaka et al. | 355/17 |
| 4,071,361 A | | 1/1978 | Marushima | 96/1.4 |
| 4,132,634 A | | 1/1979 | Rumpf et al. | 209/136 |
| 4,153,541 A | | 5/1979 | Rumpf et al. | 209/143 |
| 4,206,064 A | | 6/1980 | Kiuchi et al. | 430/106 |
| 4,404,271 A | | 9/1983 | Kawagishi et al. | 430/110 |
| 4,844,349 A | | 7/1989 | Kanda et al. | 241/19 |
| 5,194,359 A | | 3/1993 | Kanbe et al. | 430/120 |
| 5,240,803 A | | 8/1993 | Ota | 430/106 |
| 5,641,601 A | | 6/1997 | Mitani et al. | 430/106.6 |
| 5,712,069 A | * | 1/1998 | Baba et al. | 430/111.31 |
| 5,721,433 A | | 2/1998 | Kosaka | 250/573 |
| 5,800,959 A | | 9/1998 | Ikami | 430/126 |
| 5,858,593 A | | 1/1999 | Tamura et al. | 430/106.6 |
| 6,007,957 A | | 12/1999 | Kobori et al. | 430/106.6 |
| 6,171,743 B1 | * | 1/2001 | Nakamura | 430/110.4 |
| 6,203,957 B1 | * | 3/2001 | Nomura et al. | 430/110.4 |

FOREIGN PATENT DOCUMENTS

| | | |
|---|---|---|
| JP | 41-20153 | 11/1966 |
| JP | 42-27596 | 12/1967 |
| JP | 44-6397 | 3/1969 |
| JP | 45-26478 | 9/1970 |
| JP | 50-133838 | 10/1975 |
| JP | 51-56057 | 5/1976 |
| JP | 52-41959 | 3/1977 |
| JP | 55-18656 | 2/1980 |
| JP | 55-42752 | 11/1980 |
| JP | 58-41508 | 9/1983 |
| JP | 59-7384 | 1/1984 |
| JP | 59-7385 | 2/1984 |
| JP | 63-101858 | 5/1988 |
| JP | 2-87157 | 3/1990 |
| JP | 3-84558 | 4/1991 |
| JP | 3-229268 | 10/1991 |
| JP | 4-1766 | 1/1992 |
| JP | 4-102862 | 4/1992 |
| JP | 8-136439 | 5/1996 |
| JP | 8-286421 | 11/1996 |
| JP | 9-26672 | 1/1997 |

OTHER PUBLICATIONS

Suzuki et al., "A New Approach . . . System", Japan Hard Copy '97 Paper Collection, pp. 65–68.

Carr, "Evaluating Flow Properties of Solids", Chem. Eng. pp. 163–168, Jan. 1965.

* cited by examiner

*Primary Examiner*—John Goodrow

(74) *Attorney, Agent, or Firm*—Fitzpatrick, Cella, Harper & Scinto

(57) ABSTRACT

A dry magnetic toner is formed of magnetic toner particles comprising a binder resin and magnetic iron oxide particles. The magnetic toner is provided with excellent developing performances and transferability by controlling the presence of isolated iron-containing particles and containing a high percentage of spherical particles, the amount of which is controlled relative to the weight-average particle size of the magnetic toner and a content of particles of 3 $\mu$m or below in the magnetic toner.

52 Claims, 25 Drawing Sheets

YO-VANE

ZO-VANE

SO-VANE

AO-VANE

DRY TONER, IMAGE FORMING METHOD AND PROCESS CARTRIDGE

FIELD OF THE INVENTION AND RELATED ART

The present invention relates to a toner for use in electrophotography, an image forming method for visualizing an electrostatic image and toner jetting; an image forming method using the toner, and a process cartridge including the toner.

Hitherto, various electrophotographic processes have been disclosed in U.S. Pat. Nos. 2,297,691; 3,666,363: 4,071,361; etc. In these processes, an electrostatic latent image is formed on a photoconductive layer by irradiating a light image corresponding to an original, and a toner is attached onto the latent image to develop the electrostatic image. Subsequently, the resultant toner image is transferred onto a transfer(-receiving) material such as paper, via or without via an intermediate transfer member, and then fixed, e.g., by heating, pressing, or heating and pressing, to obtain a copy or a print. The toner remaining on the photosensitive member is cleaned by various methods, and the above steps are repeated for a subsequent image forming cycle.

Japanese Laid-Open Patent Application (JP-A) 55-18656 has proposed a jumping developing method wherein a magnetic toner is applied in a very small thickness onto a sleeve, triboelectrically charged and brought to a proximity to an electrostatic image to effect the development. This method is advantageous in that a sufficient triboelectrification becomes possible by application of the magnetic toner in a very small thickness layer on the sleeve to increase the opportunity of contact between the sleeve and the toner.

However, the developing method using an insulating magnetic toner involves an unstable factor associated with the use of such an insulating magnetic toner. More specifically, insulating magnetic toner particles contain a substantial amount of fine powdery magnetic material, and a portion of the magnetic material is isolated from or exposed to the surfaces of the toner particles, thus affecting the flowability and triboelectric chargeability of the magnetic toner to consequently change or deteriorate the various performances, inclusive of developing performance and continuous image forming performances. These difficulties are presumably caused by the presence at the magnetic toner particle surfaces of fine particles of magnetic material having a lower resistivity than the resin constituting the toner. The toner chargeability also greatly affects the developing performance and transferability, thus also deeply affecting the resultant image quality. For this reason, a magnetic toner capable of stably attaining a high charge is seriously demanded.

Further, in recent years, apparatus utilizing electrophotography have been used not only as copying machines for reproducing originals but also for printers for computers and facsimile apparatus. Accordingly, electrophotographic apparatus are required to be smaller in size and weight and to exhibit higher speed and reliability, so that they are required to be composed of simpler components. Consequently, a toner is required to exhibit higher performances, failure of which makes impossible the realization of an excellent image forming apparatus.

JP-A 7-230182 and JP-A 8-286421 have proposed external addition of magnetic material powder for stabilizing the chargeability. This allows the provision of a toner showing a stable chargeability and high cleanability, but the toner is liable to be attached to a contact charging member which is frequently included in a high-speed printer of a simple structure.

Further, after a transfer step of transferring a toner image from a photosensitive member to a transfer(-receiving) material, a portion of toner (residual toner) remains on the photosensitive member without being transferred. The residual toner has to be cleaned from the photosensitive member in order to continuously obtain good toner images in a continuous copying or printing. The recovered residual toner is stored in a vessel in the image forming machine or a recovery box and then discharged as a waste toner or recycled.

In order to obviate the occurrence of waste toner, the image forming apparatus has to be equipped with a recycle mechanism. Such a recycle system to be placed in the apparatus has to be a large-scale one for complying with multiplicity of function, high-speed and high image quality required of copying machines, printers and facsimile apparatus demanded on the market, thus resulting in a larger apparatus which is against the demand for a smaller apparatus in the market. This problem is also encountered also in the case of storing the waste toner in a vessel or a recovery box disposed in the apparatus or in a system including a waste toner recovery unit integral with the photosensitive member.

In order to alleviate the problem, the rate or efficiency of transfer at the time of transferring a toner image from a photosensitive member to a transfer material has to be increased.

JP-A 9-26672 has proposed a toner containing a transfer efficiency-improving agent having an average particle size of 0.1–3 $\mu$m and hydrophobic silica fine powder having a BET specific surface area of 50–300 $m^2/g$, so that the toner is provided with a reduced volume resistivity and a thin layer of the transfer efficiency-improving agent is formed on the photosensitive member, to increases the transfer efficiency. However, a toner produced through the pulverization process is caused to have a generally broad particle size distribution, so that it is difficult to uniformly increase the transfer efficiency of all the toner particles, thus leaving a room for further improvement.

For improving the transfer efficiency, there has been known a method of forming a toner, of which the shape is made closer to a sphere. Examples thereof may include production methods by spraying toner particle formation, dissolution with a solution and polymerization as disclosed in JP-A 3-84558, JP-A 3-229268, JP-A 4-1766 and JP-A 4-102862. However, these toner production methods require a large production apparatus, and the resultant sphere-like toner particles are liable to cause a problem of cleaning failure because of their spherical shape.

In a conventional toner production process including a pulverization step, toner ingredients including a binder resin for ensuring toner fixation onto a transfer material, a colorant or magnetic material for providing a toner and a charge control agent for imparting a chargeability to toner particles are dry-blended and melt-kneaded by a kneading apparatus, such as a roll mill or an extruder, and, after being cooled and solidified, the kneaded product is pulverized by a pulverizing apparatus, such as a jet stream-type pulverizer or a mechanical impingement-type pulverizer, followed by classification by means of a pneumatic classifier, to obtain toner particles, which are optionally further blended with a flowability improver and a lubricant externally added thereto. In order to provide a two-component developer, the toner may be blended with a magnetic carrier.

An example of such a process for producing toner particles is illustrated by a flow chart shown in FIG. 7.

A coarsely pulverized material is continuously or successively fed to a first classification means, from which a coarse powder fraction principally comprising particles beyond a prescribed particle size range is sent to a pulverization means for pulverization and then recycled to the first classification means.

The other fine powder fraction principal comprising particles within the prescribed particle size range and particles below the prescribed particle size range is supplied to a second classification means and separated thereby into medium powder principally comprising particles within the prescribed particle size range, fine powder principally comprising particles below the prescribed particle size range and coarse powder principally comprising particles above the prescribed particle size range.

As the pulverization means, various pulverizers are used, and for pulverization of a coarsely pulverized toner product principally comprising a binder resin, an impingement-type pneumatic pulverizer using a jet gas stream as shown in FIG. 9 is generally used.

In such an impingement-type pneumatic pulverizer using a high pressure gas for a jet gas stream, a powdery material is conveyed with a jet air stream and ejected from an outlet of an acceleration pipe to be impinged onto an impingement surface of an impingement member disposed opposite to the outlet opening of the acceleration pipe, whereby the powdery material is pulverized by an impact force caused by the impingement.

For example, in the impingement-type pneumatic pulverizer shown in FIG. 9, an impingement member 164 is disposed opposite to an outlet port 163 of an acceleration pipe 162 connected to a high-pressure gas feed nozzle 161, a powdery material is sucked through a powder material feed port 165 formed intermediate the acceleration tube 162 into the acceleration tube 162 under the action of a high-pressure gas supplied to the acceleration pipe, and the powder material is ejected from the outlet port 163 together with the high-pressure gas to impinge onto the impinging surface 166 of the impingement member 164 to be pulverized under the impact. The pulverized product is discharged out of a discharge port 167.

However, as the powdery material is pulverized by the impacting force caused by the impingement of the powder ejected together with a high-pressure gas onto the impingement member, the resultant toner particles are made indefinitely shaped and angular, and the release agent and magnetic material powder are liable to be isolated from the toner particles.

JP-A 2-87157 discloses a method wherein toner particles produced through the pulverization process are subjected to a mechanical impact (by means of a hybridizer) to modify the shape and surface state of the particles to improve the transfer efficiency. According to this method, however, as a treatment step is added after the pulverization process, the productivity of toner particles is lowered and toner particle surface is made less uneven to require some improvement in developing performance.

Further, in order to produce a small particle size toner by using the above-mentioned impingement-type pneumatic pulverizer, a large amount of air is required, thus increasing the electric power consumption which results in an increase in production energy cost. In recent years, economization of toner production energy is also required from an ecological viewpoint.

As for the classification means, various pneumatic classifiers and classifying methods have been proposed, including classifiers using rotating vanes and classifiers having no moving units. The latter includes a fixed wall-type centrifugal classifier, and a classifier utilizing an inertia. The use of the latter inertia-type classifiers has been proposed in Japanese Patent Publication (JP-B) 54-24745, JP-B 55-6433 and JP-A 63-101858.

According to such a pneumatic classifier, as illustrated in FIG. 10, a powdery material is ejected together with a high-speed gas stream through a supply nozzle opening into a classification zone of a classification chamber, and under the action of a centrifugal force caused by a curved gas stream flowing along a Coanda block 145, the powdery material is classified into coarse powder, medium powder and fine powder which are separated by narrow-tipped edges 146 and 147.

More specifically, in a classification apparatus 127, a pulverized powder material is introduced through a supply nozzle including tapered tubular pipe suctions 148 and 149, where a powdery material tends to flow straightly and parallel to the tube walls. However, in the supply nozzle, the powder supply stream is liable to be separated into an upper stream rich in light fine powder and a lower stream rich in heavier coarse powder. The respective powder streams are liable to flow separately and be ejected in different courses depending on positions of introduction into the classifying chamber, and further the coarse powder stream is liable to disturb the course of flying of fine powder, thus posing a limit of improved classification accuracy.

Moreover, a large number of different properties are required of a toner, and many of them are determined not only by the starting materials but also by the production processes. The toner classification step is required to provide classified particles having a sharp particle size distribution at a low cost and in a stable manner.

Further, in recent years, toner particles are gradually becoming smaller in size in order to improve the image quality in copying machines and printers in recent years. Generally, a particulate substance is governed by a larger inter-particle force as the particle size becomes smaller. This is also true with toner particles principally comprising a resin, and the agglomeratability thereof becomes larger as the size thereof is smaller.

As a result, in the case of obtaining a toner having a weight-average particle size of at most 10 $\mu$m and a sharp particle size distribution, the classification efficiency is significantly lowered by using conventional apparatus and methods. Particularly in the case of obtaining a toner having a weight-average particle size of at most 10 $\mu$m and a sharp particle size distribution, not only the classification efficiency is significantly lowered, but also the classified toner particles are liable to have a large amount of an ultra-fine powder fraction, by using conventional apparatus and methods.

Further, according to the conventional system, even if a toner product having an accurate particle size distribution can be attained, the steps therein are liable to be complicated to result in a lower classification efficiency, a lower production yield and a higher production cost. This tendency becomes more noticeable if the prescribed size becomes smaller.

Further, in the case of a magnetic toner having a smaller particle size than usual, the amount of magnetic material contained in toner particles is increased in order to suppress the fog, and the amount of magnetic material isolated from the toner particle is increased correspondingly. As a result, in order to comply with a higher process speed, the lowering in low-temperature fixability and restriction on developing performance of a magnetic toner become severer than ever.

SUMMARY OF THE INVENTION

A generic object of the present invention is to provide a dry magnetic toner having solved the above-mentioned problems.

A more specific object of the present invention is to provide a dry magnetic toner capable of retaining a good developing performance even at a smaller particle size.

Another object of the present invention is to provide a dry magnetic toner causing less waste toner to exhibit a higher transfer rate.

A further object of the present invention is to provide a process cartridge and an image forming method using such a magnetic toner.

According to the present invention, there is provided a dry magnetic toner, comprising: magnetic toner particles each comprising at least a binder resin and magnetic iron oxide particles; wherein 100–350 iron-containing isolated particles are present per 10,000 toner particles;

the toner has a weight-average particle size X in a range of 5–12 μm; and contain at least 90% by number of particles satisfying a circularity Ci according to formula (1) below of 0.900 with respect to particles of 3 μm or larger therein, $$Ci=L_0/L \quad (1),$$

wherein L denotes a peripheral length of a projection image of an individual particle, and $L_0$ denotes a peripheral length of a circle giving an identical area as the projection image; and the toner satisfies either (a) (i) a cut percentage Z determined by formula (3) shown below satisfies formula (2) below with respect to the weight-average particle size X:

$$Z \leqq 5.3 \times X \quad (2),$$

$$Z=(1-B/A)\times 100 \quad (3),$$

wherein A denotes the number of total particles and B denotes the number of particles of 3 μm or larger, and (ii) the toner contains a number-basis percentage Y (%) of particles having Ci≧0.950 within particles of 3 μm or larger satisfying:

$$Y \geqq X^{-0.645} \times \exp 5.51 \quad (4), \text{ or}$$

(b) (iii) a cut percentage Z determined by the formula (3) above satisfies formula (5) below with respect to the weight-average particle size X:

$$Z > 5.3 \times X \quad (5), \text{ and}$$

percentage Y (%) of particles having Ci≧0.950 within particles of 3 μm or larger satisfying:

$$Y \geqq X^{-0.545} \times \exp 5.37 \quad (6).$$

According to another aspect of the present invention, there is provided an image forming method, comprising the steps of:

developing an electrostatic image formed on an image-bearing member with the above-mentioned dry magnetic toner to form a toner image thereon, transferring the toner image onto a transfer material via or without via an intermediate transfer member, and fixing the toner image onto the transfer material under application of heat and pressure.

According to a further aspect of the present invention, there is provided a process-cartridge comprising: an image-bearing member, and a developing means containing the above-mentioned dry magnetic toner for developing an electrostatic image formed on the image-bearing member; the image-bearing member and the developing means being integrally supported to form a cartridge which is detachably mountable to a main assembly of image forming apparatus.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
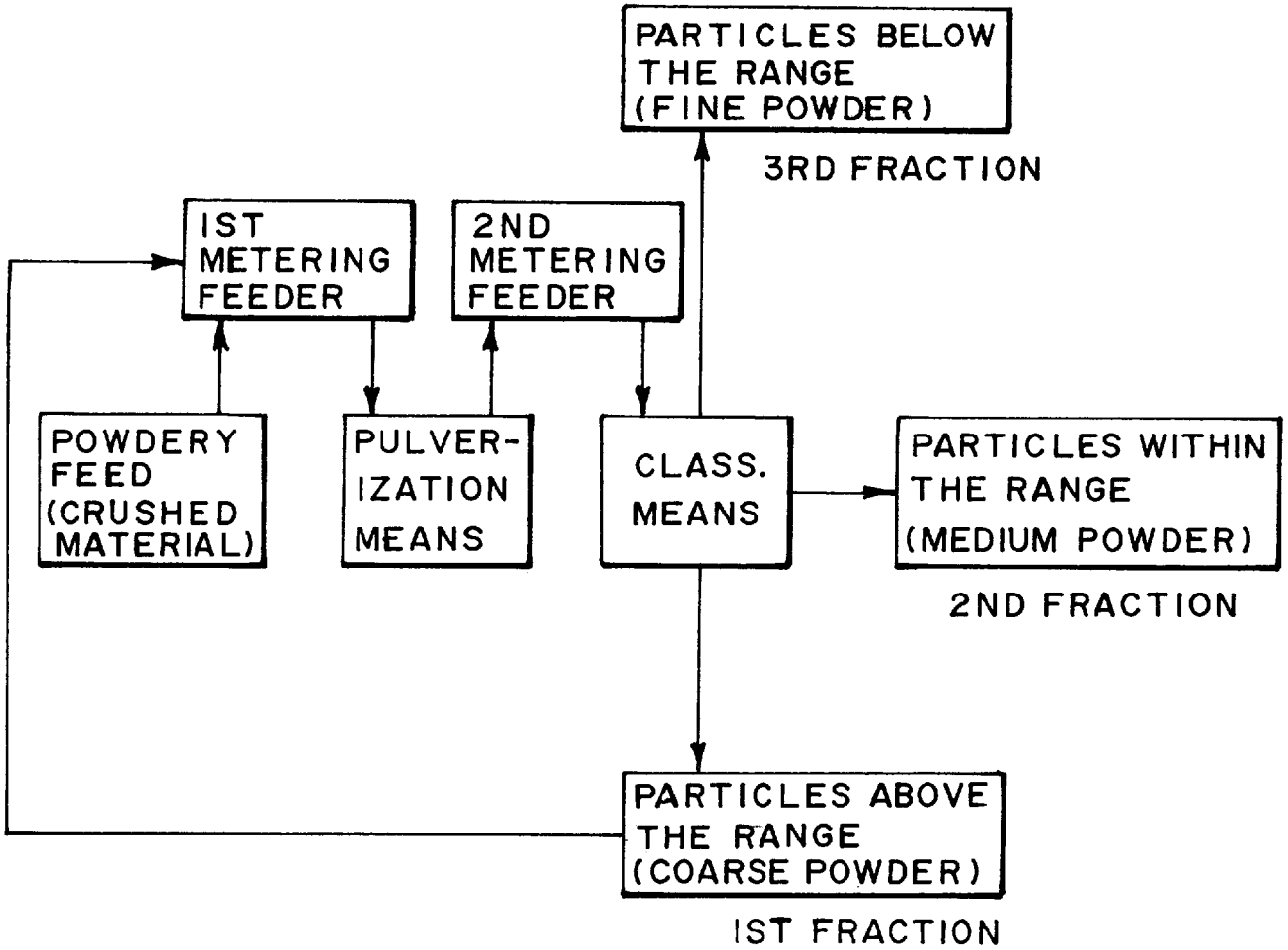
FIG. 1 is a flow chart for illustrating an example of toner production process.

As a result of our study on amounts and shape of isolated magnetic material and toner ingredients in a toner, it has been found that there is a close relationship between the amount (and further shape) of isolated magnetic material in a toner, and the transferability and developing performance of the toner.

The toner according to the present invention obtained through the control of the amount of the isolated magnetic material exhibits an increased transfer efficiency without impairing the fixability, provides high-quality images stably in both high-humidity and low-humidity environments, and is little liable to cause image defects with time.

The dry toner according to the present invention comprises at least a binder resin and a magnetic iron oxide, and contains isolated iron-containing particles in a proportion of 100–350 particles, preferably 100–300 particles, more preferably 120–250 particles, further preferably 120–200 particles, per 10,000 toner particles.

If the number of the isolated iron-containing particles exceeds 350 particles, the toner charge is liable to leak via the particles, thus lowering the toner charge. The toner with a thus-lowered charge causes increased fog, a lower transfer efficiency and charging failure adversely affecting the developing performance. Further, the toner attachment onto the toner-carrying member is increased to obstruct the triboelectric charging performance, leading to charging failure and inferior developing performance. On the other hand, the number of the isolated iron-containing particles being less than 100 particles, means that the toner is substantially free from isolated magnetic iron oxide particles. Such a toner containing substantially no isolated magnetic iron oxide particles exhibits a high chargeability but is liable to be excessively charged in continuous image formation on a large number of sheets in a high-speed apparatus, particularly in a low temperature/low humidity environment, thus being liable to result in a lower image density. By controlling the number of iron-containing particles in the range of 100–350 particles, it has become possible to provide a toner which allows an easy charge control and can be uniformly and stably charged.

The number of isolated iron-containing particles described herein is based on values measured according to the following method.

Measurement is performed by using a particle analyzer ("PT1000", made by Yokogawa Denki K.K.) according to a principle described in Japan Hardcopy '97 Paper Collection, pp. 65–68. More specifically, in the apparatus, fine particles like toner particles are introduced into plasma, particle by particle, to determine an element and a particle size of a luminescent particle from its luminescence spectrum. For example, in the case where a magnetic toner particle is introduced into plasma, each toner particle causes one luminescence of carbon (constituting the binder resin) and one luminescence of iron (constituting the magnetic iron oxide) which can be respectively observed. As one toner particle causes one luminescence, the number of toner particles can be determined based on the number of observed luminescences. In this instance, the luminescence of iron atom within 2.6 msec from the luminescence of carbon atom is regarded as simultaneous luminescence as that of carbon atoms.

In the case of a magnetic toner particle containing magnetic iron oxide particles, the simultaneous luminescences of carbon atom and iron atom means a luminescence from a toner particle containing magnetic iron oxide dispersed therein, and the luminescence of only iron atom means a luminescence from an isolated iron-containing particle.

More specifically, for the measurement, a sample toner left standing overnight in an environment of 23° C. and 60%RH is subjected to measurement together with 0.1% $O_2$-containing helium gas in the above environment. For spectrum separation, Channel 1 detector is used for carbon atom (at wavelength of 247.86 nm, with a recommended value of K factor) and Channel 2 detector is used for iron atom (at wavelength of 239.56 nm, with K factor of 3.3764). Sampling is performed at a rate of one scan for covering 1000–1400 times of luminescence of carbon atom, and the sampling is repeated until the luminescences of carbon atom reaches at least 10,000 times. By integrating the luminescences, a particle size distribution curve is drawn with the number of luminescences taken on the ordinate and with the cube root of voltage representing a particle size on the abscissa. In order to ensure the accuracy of measurement, it is important that the particle size distribution curve exhibits a single peak and no valley. The number of luminescences of only iron atom is regarded as the number of isolated iron containing particles (which may be regarded as substantially equal to the number of isolated magnetic iron-oxide particles in the present invention). The noise cut level during the measurement is taken at 1.50 volts.

Incidentally, an azo-iron compound as a charge control agent may be contained in a toner in some cases, but the azo iron compound is an organometallic compound, so that it cannot result in a luminescence of only iron atom. Further, it is possible that such a charge control agent is isolated from toner particles, but the content of a charge control agent is as small as 1–3% of the binder resin and the magnetic iron oxide in toner particles, so that its contribution is negligible. Accordingly, the luminescences of carbon atom and iron atom according to the above method can be regarded as caused by only the binder resin and the magnetic iron oxide particles.

Further, the toner of the present invention is allowed to contain at least 90% by number of toner particles having a circularity (Ci) of at least 0.900 as measured with respect to toner particles of at least 3 $\mu$m in addition to the above-mentioned number of isolated iron-containing particles in a range of 100–350 particles per 10,000 toner particles, by adopting a production process as described hereinafter for producing toner particles.

In the present invention, an average circularity (Cav) is used as a convenient parameter for quantitatively indicating a particle shape based on values measured by using a flow-type particle image analyzer ("FPIA-1000", available from Toa Iyou Denshi K.K.). For each measured particle, a circularity Ci is calculated according to equation (1) below, and an average circularity Cav. is calculated by dividing the total of circularities (Ci) of all the measured particles with the number of particles as shown in equation (7) below.

$$\text{Circularity } Ci = L_0/L \quad (1)$$

wherein L represents a peripheral length of a projection image (two-dimensional image) of an individual particle, and $L_0$ represents a peripheral length of a circle giving an identical area as the projection image.

$$\text{Average circularity } Cav = \sum_{i=1}^{m} Ci/m \tag{7}$$

wherein m represents a number of measured particles.

A circularity standard deviation SDc may be determined according to equation (8) below:

$$SDc = \left(\sum_{i=1}^{m} (Cav - Ci)^2/m\right)^{1/2}. \tag{8}$$

As is understood from the above equation (1), a circularity Ci is an index showing a degree of unevenness of a particle, and a perfectly spherical particle gives a value of 1.00, and a particle having a more complicated shape gives a smaller value. Further, a circularity standard deviation SDc is an index of fluctuation of circularity, and a smaller value represents a smaller fluctuation.

In the flow-type particle image analyzer ("FPIA-1000") used herein, for convenience of calculation, an actual calculation is automatically performed according to the following scheme: that is, circularities (Ci) of individual particles are classified into 61 divisions by an increment of 0.010 within a circularity range of 0.400–1.000, i.e., 0.400—below 0.410, 0.410—below 0.420, . . . 0.990—below 1.000, and 1.000. Then, an average circularity Cav is determined based on central values and frequencies of the respective divisions. However, an error introduced by the convenient calculation is very small and substantially negligible from the value obtained by strictly applying above-mentioned equations.

Hitherto, it has been known that a toner shape affects various toner performances. As a result of our study, it has been found that the shape of toner particles of 3 μm or larger and the amount of isolated magnetic iron oxide particles greatly affect the transferability and developing performance of a magnetic toner. We have also found that if the amount of particles below 3 μm in terms of circle-equivalent diameter (C.E.D.=$L_0/\pi$ with reference to the above equation (1)) exceeds a certain level, the transferability and developing performance of the toner are liable to be lowered. Further to say, it has been found that if the amount of the particles of smaller than 3 μm (inclusive of toner particles of below 3 μm in particle size and external additive particles of below 3 μm in particle size) exceeds a certain level, it is difficult to attain desired performances unless the circularity of toner particles of 3 μm or larger is increased.

Accordingly, for achieving the object of the present invention, it is important for the particles of 3 μm or larger in circle-equivalent diameter (C.E.D.) to exhibit a high circularity, but in order to attain more effects from the particles of 3 μm or larger greatly affecting the transferability and developing performance, it becomes necessary to control the circularity of the toner particles of 3 μm or larger depending on the amount of fine powder of below 3 μm.

Thus, it is possible to obtain a toner exhibiting excellent transferability and developing performance by controlling the circularity of toner particles of 3 μm or larger depending on the amount of the fine powder smaller than 3 μm.

In the circularity measurement by using "FPIA-1000" (hereinafter sometimes referred to as a "FPIA-measurement"), there is a tendency that a smaller particle exhibits a higher circularity because the particle image becomes closer to a point. Accordingly, if a toner contains a larger amount of small particles, the toner tends to show a higher circularity. On the other hand, in case where such small particles are present only in a small amount, the circularity of the toner is lowered. Accordingly, based on a cut percentage Z determined by subtracting the proportion of particles of 3 μm or larger in the total particles from 100% as shown in equation (3) below, two cases of formulae (2) and (5) are taken, and the relationship between a circularity level required for achieving desired performances and a weight-average particle size X is optimized as shown in formulae (4) and (6) for the cases of formulae (2) and (5) respectively.

$$\text{Cut percentage } Z=(1-B/A)\times 100 \tag{3}$$

wherein A denotes the number of total particles, and B denotes the number of particles of 3 μm or larger. (For the purpose of the present invention, the ratio B/A may be represented by a ratio of concentration (particles/μl) of the relevant particles in a sample liquid for the FPIA-measurement.)

Thus, in the case of a toner containing only a small amount of particles below 3 μm represented by $$Z \leqq 5.3\times X \tag{2}$$

the number-basis percentage Y of particles having Ci≧0.950 within particles of 3 μm or larger should satisfy:

$$Y \geqq \exp 5.51\times X^{-0.645} \tag{4}$$

where exp5.51 means $e^{5.51}$=247.15. On the other and, in the case of a toner containing a larger mount of particles below 3 μm represented by $$Z > 5.3\times X \tag{5}$$

the number-basis percentage Y of particles of 3 μm or larger having Ci≧0.950 should be larger so as to satisfy:

$$Y \geqq \exp 5.37\times X^{-0.545} \tag{6}$$

Consequently, the toner should contain at least 90% by number of particles having Ci≧0.900 within particles of 3 μm or larger, and the toner should also satisfy either (a) (i) a cut percentage Z determined by formula (3) shown below satisfies formula (2) below with respect to the weight-average particle size X:

$$Z \leqq 5.3\times X \tag{2}$$

(preferably $0<Z\leqq 5.3\times X$)

$$Z=(1-B/A)\times 100 \tag{3}$$

wherein A denotes the number of total particles and B denotes the number of particles of 3 μm or larger, and (ii) the toner contains a number-basis percentage Y (%) of particles having Ci≧0.950 within particles of 3 μm or larger satisfying:

$$Y \geqq X^{-0.645}\times \exp 5.51 \tag{4}$$ , preferably $$X^{-0.187}\times \exp 4.85 \geqq Y \leqq X^{-0.645}\times \exp 5.51$$

(b) (iii) a cut percentage Z determined by the formula (3) above satisfies formula (5) below with respect to the weight-average particle size X:

$$Z>5.3\times X \quad (5), \text{ and}$$

(preferably $95\geqq Z>5.3\times X$)

percentage Y (%) of particles having $Ci\geqq 0.950$ within particles of 3 μm or larger satisfying:

$$Y\geqq X^{-0.545}\times \exp 5.37 \quad (6), \text{ preferably}$$

$$X^{-0.187}\times \exp 4.85\geqq Y\geqq X^{-0.545}\times \exp 5.37.$$

If the toner satisfies the above-mentioned circularity requirement, the toner allows easy charge control and can realize uniform and stable chargeability in a continuous image formation. It is also possible to realize a higher transfer efficiency. This is presumably because in such a toner satisfying the above-mentioned requirement, the toner particles are caused to have a smaller contact area with the photosensitive member, thus resulting in ai smaller force of attachment attributable to van der Waals force onto the photosensitive member. Further, as the toner particles have a smaller surface area compared with conventional toner particles obtained through pulverization using an impingement-type pneumatic pulverizer, the toner particles can be packed in a higher bulk density due to a reduced contact area between the toner particles, thus showing a better heat-conduction at the time of fixation to result in an improved fixing performance.

If the number-basis percentage of particles having $Ci\geqq 0.900$ is below 90% within the particles of 3 μm or larger, the toner charge is liable to leak via the isolated magnetic iron oxide particles, result in a consequent reduction in toner charge, even if the amount of the isolated magnetic iron oxide particles is controlled. Further, the toner particles are caused to have an increased contact area with the photosensitive member, so that the attachment force of the toner particles onto the photosensitive member is increased to result in a difficulty in obtaining a sufficient transfer efficiency.

Further, in a case where the cut percentage Z satisfies $Z\leqq 5.3\times X$, preferably $0<Z\leqq 5.3\times X$, but the number-basis percentage Y (%) of particles having $Ci\geqq 0.950$ within particles of 3 μm or larger fails to satisfy:

$$Y\geqq \exp 5.51\times X^{-0.645},$$

i.e., Y satisfies $Y<\exp 5.51\times X^{-0.645}$, or in a case where the cut percentage Z satisfies $Z>5.3\times X$, preferably $95\geqq Z>5.3\times X$, but the number-basis percentage Y (%) of particles having $Ci\geqq 0.950$ within the particles of 3 μm or larger fails to satisfy:

$$Y\geqq \exp 5.37\times X^{-0.545}),$$

i.e., Y satisfies $Y<\exp 5.37\times X^{-0.545}$, it becomes difficult to realize a sufficient transfer efficiency, and the toner is liable to show a lower flowability and a lower fixing performance.

The toner having the above-mentioned circularity requirement should also satisfy a weight-average particle size (D4=X) of 5–12 μm. It is further preferred that the toner shows D4=5–10 μm, and contains at most 40% by number of particles of at least 4.0 μm in particle size and at most 25% by volume of particles of at least 10.1 μm in particle size.

A toner having D4>12 μm may be obtained by reducing the energy input to the pulverizer to the minimum or increasing the feed rate, but the resultant toner particles are liable to be angular,so that it becomes difficult to attain desired circularity level and circularity distribution.

A toner having D4<5 μm may be obtained by increasing the energy input to the pulverizer or reducing the feed rate to the minimum, the resultant toner particles are caused to have a particle shape approximate to a sphere, and it becomes difficult to attain desired circularity level and circularity distribution.

A toner containing more than 40% by number of particles having a particle size of at most 4.0 μm may be obtained by increasing the energy input to the pulverizer or reducing the feed rate to the minimum, the resultant toner particles are caused to have a particle shape approximate to a sphere, and it becomes difficult to attain desired circularity level and circularity distribution.

A toner having containing more than 25% by number of particles having a particle size of at least 10.1 μm may be obtained by reducing the energy input to the pulverizer to the minimum or increasing the feed rate, but the resultant toner particles are liable to be angular,so that it becomes difficult to attain desired circularity level and circularity distribution.

As a parameter for evaluating a fluctuation in circularity of particles, a circularity standard deviation SDc calculated according the formula (8) shown before may be relied on. In the present invention, a toner satisfying SDc in a range of 0.030–0.045 may be used without any problem.

For an actual measurement of circularity by using the FPIA-measurement, 0.1–0.5 ml of a surfactant (preferably an alkylbenzenesulfonic acid salt) as a dispersion aid is added to 100 to 150 ml of water from which impurities have been removed, and ca. 0.1–0.5 g of sample particles are added thereto. The resultant mixture is subjected to dispersion with ultrasonic waves (50 kHz, 120 W) for 1–3 min. to obtain a dispersion liquid containing 12,000–20,000 particles/μl (i.e., a sufficiently high particle concentration for ensuring a measurement accuracy even at a high cut percentage), and the dispersion liquid is subjected to measurement of a circularity distribution with respect to particles having a circle-equivalent diameter (C.E.D.) in the range of 0.60 μm to below 159.21 μm by means of the above-mentioned flow-type particle image analyzer.

The details of the measurement is described in a technical brochure and an attached operation manual on "FPIA-1000" published from Toa Iyou Denshi K.K. (Jun. 25, 1995) and JP-A 8-136439 (U.S. Pat. No. 5,721,433). The outline of the measurement is as follows.

A sample dispersion liquid is caused to flow through a flat thin transparent flow cell (thickness=ca. 200 μm) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two-dimensional image having a certain area parallel to the flow cell. From the two-dimensional image area of each particle, a diameter of a circle having an identical area (an equivalent circle) is determined as a circle-equivalent diameter (CED= $L_0/\pi$. Further, for each particle, a peripheral length ($L_0$) of the equivalent circle is determined and divided by a peripheral length (L) measured on the two-dimensional image of the particle to determine a circularity Ci of the particle according to the above-mentioned formula (1).

Next, some description will be made regarding the composition of the toner according to the present invention.

The binder resin constituting the toner may preferably have an acid value of 1–100 mgKOH/g, more preferably 1–50 mgKOH/g, further preferably 2–40 mgKOH/g.

If the binder resin does not have an acid value in the above-described range, the dispersion of toner ingredients, particularly magnetic iron oxide particles, within the binder resin in the step of melt-kneading is liable to be inferior, so that the amount of the isolated magnetic iron oxide particles is liable to be increased in the pulverization step.

Further, if the acid value of the binder resin is below 1 mgKOH/g, the resultant toner particles are liable to have a lower chargeability, thus providing a toner with lower developing performance and stability in continuous image formation. On the other hand, above 100 mgKOH/g, the binder is liable to be excessively moisture-absorptive, to provide a toner resulting in a lower image density and increased fog.

The acid values of the binder resin described herein are based on values measured according to the following method.

<Acid Value Measurement>

The basic operation is according to JIS K-0070.

1) A binder resin is pulverized, and 0.5–2.0 g of the pulverized sample is accurately weighed to provide a sample containing W (g) of binder.

2) The sample is placed in a 300-ml beaker, and 150 ml of a toluene/ethanol (4/1) mixture liquid is added thereto to dissolve the sample.

3) The sample solution is (automatically) titrated with a 0.1 mol/liter-KOH solution in ethanol by means of a potentiometric titration apparatus (e.g., "AT-400 (win workstation)" with an "ABP-410" electromotive buret, available from Kyoto Denshi K.K.).

4) The amount of the KOH solution used for the titration is recorded at S (ml), and the amount of the KOH solution used for a blank titration is measured and recorded at B (ml).

5) The acid value is calculated according to the following equation:

$$\text{Acid value (mgKOH/g)}=\{(S-B)\times f\times 5.61\}/W,$$

wherein f denotes a factor of the 0.1 mol/liter-KOH solution.

The binder resin may for example comprise a vinyl polymer having a carboxyl group or an acid anhydride group, or a polyester resin.

Examples of monomers for providing a vinyl polymer for constituting the binder resin may include the following:

Unsaturated dibasic acids, such as maleic acid, citraconic acid, dimethylmaleic acid, itaconic acid, alkenylsuccinic acid, fumaric acid, mesaconic acid and dimethylfumaric acid, and anhydrides and monoesters of these unsaturated dibasic acids; α,β-unsaturated acids, such as acrylic acid, methacrylic acid, crotonic acid and cinnamic acid, and anhydrides of these; anhydrides between the above-mentioned unsaturated dibasic acids and α,β-unsaturated acids; anhydrides between the above-mentioned unsaturated acids and lower fatty acids; alkenylmalonic acid, alkenylglutaric acid, alkenyladipic acid, and hydrides and monoesters of these. Among these, maleic acid, maleic acid half esters and maleic anhydride may be used as particularly preferred monomers for providing the binder resin having an acid value used in the present invention.

Examples of a comonomer to be used for providing the vinyl polymer may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, m-nitrostyrene, o-nitrostyrene, and p-nitrostyrene; ethylenically unsaturated monoolefins, such as ethylene, propylene, butylene, and isobutylene; unsaturated polylenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the above-mentioned α,β-unsaturated acids and diesters of the above-mentioned dibasic acids. These vinyl monomers may be used singly or in two or more species.

Among the above, a combination of monomers providing a styrene copolymer or a styrene-acrylate copolymer, is preferred.

The binder resin used in the present invention can include a crosslinking structure obtained by using a crosslinking monomer having two or more vinyl groups, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, compounds obtained by substituting methacrylate groups for the acrylate groups in the above compounds, and polyester-type diacrylates (e.g., one available under the trade name of "MANDA" from Nippon Kayaku K.K.).

Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking monomers may preferably be used in ca. 0.01–5 wt. parts, more preferably ca 0.03–3 wt. parts, per 100 wt. parts of the other monomer components.

Examples of polymerization initiator for polymerizing the vinyl monomers may include: organic peroxides, such as benzoyl peroxide, 1,1-di(t-butylperoxy)-3,3,5-trimethylcyclohexane, n-butyl-4,4-di(t-butylperoxy) valerate, dicumyl peroxide, α,α'-bis(t-butylperoxydiisopropyl)benzene, t-butylperoxycumene and di-t-butyl peroxide; and azo and diazo compounds, such as azobisisobutyronitrile, and diazoamino azobenzene.

The binder resin may produced, e.g., by bulk polymerization, solution polymerization, suspension polymerization emulsion polymerization.

The toner of the present invention may preferably contain a THF (tetrahydrofuran)-soluble component providing a molecular weight distribution according to GPC showing a main peak in a molecular weight region of 2,000–25,000, more preferably 5,000–20,000, and including 50–90% of components having molecular weights in the range of $10^5$ or smaller. If the main peak molecular weight (Mp) is below 2,000, it is difficult for the toner to have an appropriate level of elasticity modulus, so that the toner is liable to have inferior continuous image forming performance while the fixability is increased. More specifically, on continuation of image formation, the magnetic iron oxide particles are liable to drop off from the toner particles, thus resulting in a lower developing performance. If Mp is below 2000, the storage stability of the toner is also lowered. If Mp exceeds 25,000, the toner is liable to show a lower fixing performance.

The toner satisfying the above-mentioned molecular weight distribution, the toner exhibits a good balance of fixability, anti-offset property and storage stability.

In order to provide a toner having such a desired molecular weight distribution, the binder resin may preferably have a main-peak molecular weight (Mp) in a range of 2,000–25,000.

A resin not having such Mp fails to exhibit an appropriate level of elasticity modulus, thus failing to cause an appropriate level of shearing force at the time of melt-kneading for toner production, so that the dispersibility of the toner ingredients is lowered and the magnetic iron oxide particles are liable to be isolated from the toner particles. Further, as the dispersion of the toner ingredients is lowered, the resultant toner is liable to have lower fixability and stability in continuous image formation.

GPC molecular weight distribution data of a THF-soluble component in a toner or a binder resin described herein are based on GPC measurement.

In the GPC apparatus, a column is stabilized in a heat chamber at 40° C., tetrahydrofuran (THF) solvent is caused to flow through the column at that temperature at a rate of 1 ml/min., and ca. 100 μl of a sample solution in THF is injected. The identification of sample molecular weight and its distribution is performed based on a calibration curve obtained by using several monodisperse polystyrene samples and having a logarithmic scale of molecular weight versus count number. The standard polystyrene samples maybe available from, e.g., Toso K.K. or Showa Denko. It is appropriate to use at least 10 standard polystyrene samples having molecular weights ranging from a. $10^2$ to ca. $10^7$. The detector may be an RI (refractive index) detector. It is appropriate to constitute the column as a combination of several commercially available polystyrene gel columns. For example, it is possible to use a combination of Shodex GPC KF-801, 802, 803, 804, 805, 806, 807 and 808P available from Showa Denko K.K.; or a combination of TSKgel G1000H ($H_{XL}$), G2000H ($H_{XL}$), G3000H ($H_{XL}$), G4000H ($H_{XL}$), G5000H ($H_{XL}$), G7000H ($H_{XL}$) and TSK-guard column available from Toso K.K.

A GPC sample solution is prepared in the following manner.

A sample is added to THF and left standing for several hours. Then, the mixture is well shaked until the sample mass disappears and further left to stand still for at least 24 hours. Then, the mixture is caused to pass through a sample treatment filter having a pore size of 0.2–0.5 μm (e.g., "Maishori Disk H-25-2", available from Toso K.K.) to obtain a GPC sample having a resin concentration of 0.5–5 mg/ml.

In view of the storage stability, the toner may preferably have a glass transition temperature (Tg) of 45–75° C., more preferably 50–70° C. If Tg of the toner is below 45° C., the toner is liable to be deteriorated in a high temperature environment and liable to cause offset at the time of fixation. On the other hand, if Tg of the toner exceeds 75° C., the toner is liable to exhibit a lower fixability.

Next, magnetic iron oxide particles constituting the toner of the present invention will be described.

The magnetic iron oxide particles used in the present invention may for example comprise particles of magnetic iron oxide such as magnetite, maghemite, ferrite or a mixture of these containing an oxide or hydroxide of iron or different element at the surface thereof. By containing an oxide or hydroxide of preferably non-iron element at the surface of the magnetic iron oxide particles, the magnetic iron oxide particles are caused to have a good affinity with and a good dispersibility within the binder resin, so that the magnetic iron oxide particles are less liable to be isolated from the toner particles in the pulverization step for toner production, and consequently the resultant toner is provided with an improved transfer efficiency and performances for stably providing high-quality images in various environments of high humidity and low humidity and for providing defect-free images in continuous image formation. The surface modification also contributes to the chargeability control by the magnetic iron oxide particles. More specifically, it is preferred to use magnetic iron oxide particles containing an oxide or a hydroxide of at least one element selected from lithium, beryllium, boron, magnesium, aluminum, silicon, phosphorus, sulfur, germanium, titanium, zirconium, tin, lead, zinc, calcium, barium, scandium, vanadium, chromium, manganese, cobalt, copper, nickel, gallium, indium, silver, palladium, gold, platinum, tungsten, molybdenum, niobium, osmium, strontium, yttrium, technetium, luthenium, rhodium, and bismuth.

The amount of such an oxide or hydroxide of iron or non-iron element present at the magnetic iron oxide particle surfaces may be represented by a hydrophobicity of the magnetic iron oxide particles. More specifically, a methanol hydrophobicity of at most 20% as measured by the following method may be retarded as representing the presence of surface oxide or hydroxide of iron or non-iron element.

0.1 g of sample magnetic iron oxide particles are added to 50 ml of distilled water in a 250 ml-beaker. Then, methanol is added at a rate of 1.3 ml/min. to the mixture under gentle stirring from the bottom of the beaker. A point of time when the magnetic iron oxide particles are recognized to disappear from the surface of the liquid is judged as the completion of sedimentation of the magnetic iron oxide particles, and a hydrophobicity is determined in terms of a volume percentage of methanol in the methanol-water mixture at that point.

If the magnetic iron oxide particles have a uniform particle size distribution, the dispersibility thereof in the binder resin is increased to stabilize the toner chargeability. This is effective in a smaller-size toner having a weight-average particle size (D4) of 10 μm or smaller desired in recent years to promote the charging uniformity, alleviate the toner agglomeratability, increase the image density, remove the fog and improve the developing performance.

This effect is particularly noticeable in the case of a toner of D4≦6.0 for providing a high definition. However, D4 of 5 μm or larger is preferred for the purpose of providing a sufficient image density.

The non-iron element may preferably be contained in a proportion of 0.05–10 wt. %, more preferably 0.1–7 wt. %, further preferably 0.2–5 wt. %, more preferably 0.3–4 wt. %, based on the iron content in the magnetic iron oxide. If the content is below the above-mentioned range, the addition effect thereof is scarce, thus failing to provide better dispersibility and charging uniformity. In excess of the above range, the resultant magnetic iron oxide particles are liable to cause excessive charge liberation to result in an insufficient chargeability, thus causing a lower image density and increased fog.

It is preferred that such a non-iron modifier element is predominarily present in proximity to the surface of the magnetic particles. For example, when magnetic iron oxide particles are dissolved to a dissolution percentage of 20% of the ion content, it is preferred that at least 40% of the total non-iron element is dissolved, more preferably 40–80%, further preferably 60–80%. The predominant presence at the surface of the non-iron element promotes the dispersibility and electric diffusibility enhancing effects thereof onto the magnetic particles.

The magnetic iron oxide particles may preferably be contained in toner particles in a proportion of 20–200 wt. parts, more preferably 40–150 wt. parts, per 100 wt. parts of the binder resin.

In a preferred embodiment, the magnetic iron oxide particles may preferably contain silicon (Si) in a proportion of 0.4–2.0 wt. %, more preferably 0.5–0.9 wt. %, based on iron (Fe), as a whole, and contain Si in a proportion providing an Fe/Si atomic ratio of 1.2–7.0, more preferably 1.2–4.0, at the surfacemost portion.

The Fe/Si atomic ratio at the surfacemost portion of the magnetic iron oxide particles may be determined by X-ray photoelectron spectroscopy (XPS).

If Si content is below 0.4 wt. % (as a whole) or Fe/Si atomic ratio exceeds 7.0 (at the surface), the Si addition effect, particularly the effect of improving the magnetic toner flowability, is scarce. On the other hand, if Si content exceeds 20 wt. % or Fe/Si atomic ratio is below 1.2, the chargeability of the toner is lowered depending on an environment, particularly after standing for a long period in a high-humidity environment. Further, the durability of the magnetic toner and the dispersibility of magnetic iron oxide particles in the binder resin are lowered, so that the magnetic iron oxide particles are liable to be isolated from the toner particles at the time of pulverization.

The Si content at the surface of the magnetic iron oxide particles affects the flowability and moisture-absorptivity of the magnetic iron oxide particles, thus affecting the properties of the magnetic toner containing the magnetic iron oxide particles.

It is further preferred that the magnetic iron oxide particles exhibit a smoothness (Dsm) of 0.3–0.8, more preferably 0.45–0.7, further preferably. The smoothness (Dsm) is related with the amount of pores at the surface of magnetic iron oxide particles, and Dsm below 0.3 means the presence of many surface pores promoting moisture adsorption. The presence of many adsorption sites not allowing easy liberation of adsorbed water results in a magnetic toner (containing the magnetic iron oxide particles) which exhibits a lower chargeability and takes much time in recovery of chargeability, particularly after long-term standing in a high-humidity environment.

It is further preferred that the magnetic iron oxide particles have a bulk density (Db) of at least 0.8 g/cm$^3$, more preferably at least 1.0 g/cm$^3$.

If the magnetic iron oxide particles have a bulk density (Db) of below 0.8 g/cm$^3$, the physical mixability thereof with other toner ingredients at the time of toner production is lowered, thus being liable to result in isolation of the magnetic iron oxide particles from the toner particles during the toner production.

The magnetic iron oxide particles may preferably have a BET specific surface area ($S_{BET}$) of at most 15.0 m$^2$/g, more preferably at most 12.0 m$^2$/g. If $S_{BET}$ exceeds 15.0 m$^2$/g, the magnetic iron oxide particles are liable to have an increased moisture-absorptivity, thus resulting in a magnetic toner showing also a high moisture-absorptivity and a lower chargeability.

In another preferred embodiment, the magnetic iron oxide particles may preferably contain 0.01–2.0 wt. %, more preferably 0.05–1.0 wt. %, of aluminum (Al), presumably in the form of an aluminum compound such as aluminum hydroxide, predominantly present at the surface of magnetic iron oxide particles. It has been confirmed that the presence of Al at the surface is effective for stabilizing the chargeability of the resultant magnetic toner.

It is further preferred that the magnetic iron oxide particles contain Al preferentially at the surface so as to provide an Fe/Al atomic ratio at the surfacemost portion of 0.3–10.0, more preferably 0.3–5.0, further preferably 0.3–2.0, for stabilizing the toner chargeability even in a high-humidity environment.

The magnetic iron oxide particles used in the present invention may preferably have a number-average particle size (D1) of 0.1–0.4 μm, more preferably 0.1–0.3 μm.

Various properties characterizing the present invention described herein are based on values measured according to the methods.

(1) Particle Size Distribution (a) The particle size distribution of a magnetic toner may be measured according to the Coulter counter method, e.g., by using "Coulter Multisizer IIE" (=trade name, available from Coulter Electronics Inc.).

Figure 23:
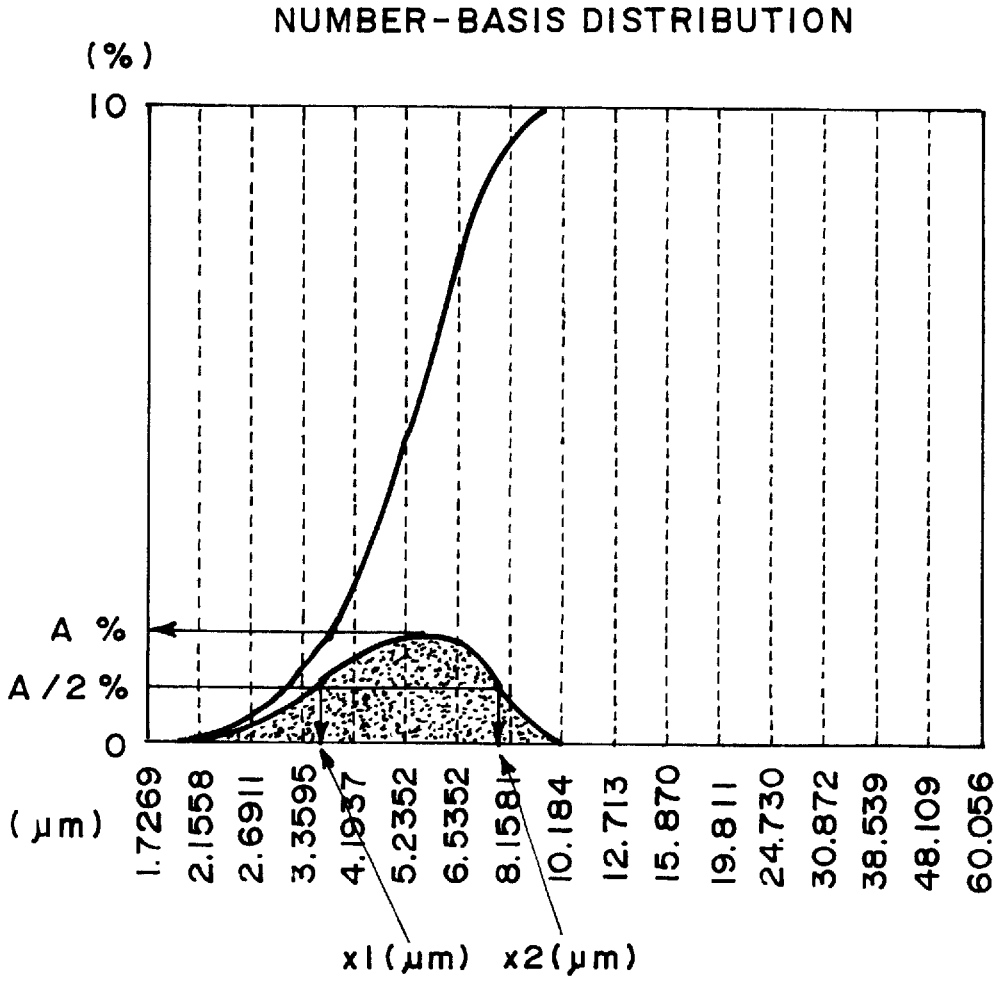

In the measurement, a 1%-NaCl aqueous solution may be prepared by using a reagent-grade sodium chloride as an electrolytic solution. It is also possible to use ISOTON R-II (available from Coulter Scientific Japan K.K.). Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of at least 2 μm by using the above-mentioned apparatus with a 100 μm-aperture to obtain a volume-basis distribution and a number-basis distribution. The distribution data are obtained for 256 channels divided in a particle size range of 1.59–64.0 μm. An example of number-basis distribution is shown in FIG. 23, in which 256 channel data are illustrated in 16 particle size sections with scales ranging from 1.7269 μm to 60.056 μm on the abscissa. The weight-average particle size ($D_4$) may be obtained from the volume-basis distribution by using a central value as a representative value for each channel. From the number-basis distribution, the content of particles having particle sizes of at most 4.00 μm (%N (≦4.00 μm)) is determined, and from the volume-basis distribution, the amount of particle sizes of at least 10.1 μm (%V (≧10.1 μm)) is also determined.

(b) Half value width (Dwy2=y) with respect to a peak particle size (=x) on a number-basis particle size distribution.

From a number-basis particle size measured for 256 channels according to a Coulter counter as shown in FIG. 23, a frequency A (%) at a peak particle size x is determined, and two points giving a frequency A/2 (%) are determined on the distribution curve at particle sizes x1 and x2, from which a half-value width y is calculated as y=x2−x1.

(c) A preferred half-value width (y).

In a preferred embodiment of the present invention, the magnetic toner of the present invention is set to have a particle size distribution so as to have a half-value width y ($\mu$m) of with respect to a peak particle size x ($\mu$m), as measured by the Coulter counter 256 channel-measurement as mentioned above, satisfying a relationship of:

$$2.06x-9.113 \leqq y 2.06x-7.341.$$

Figure 22:
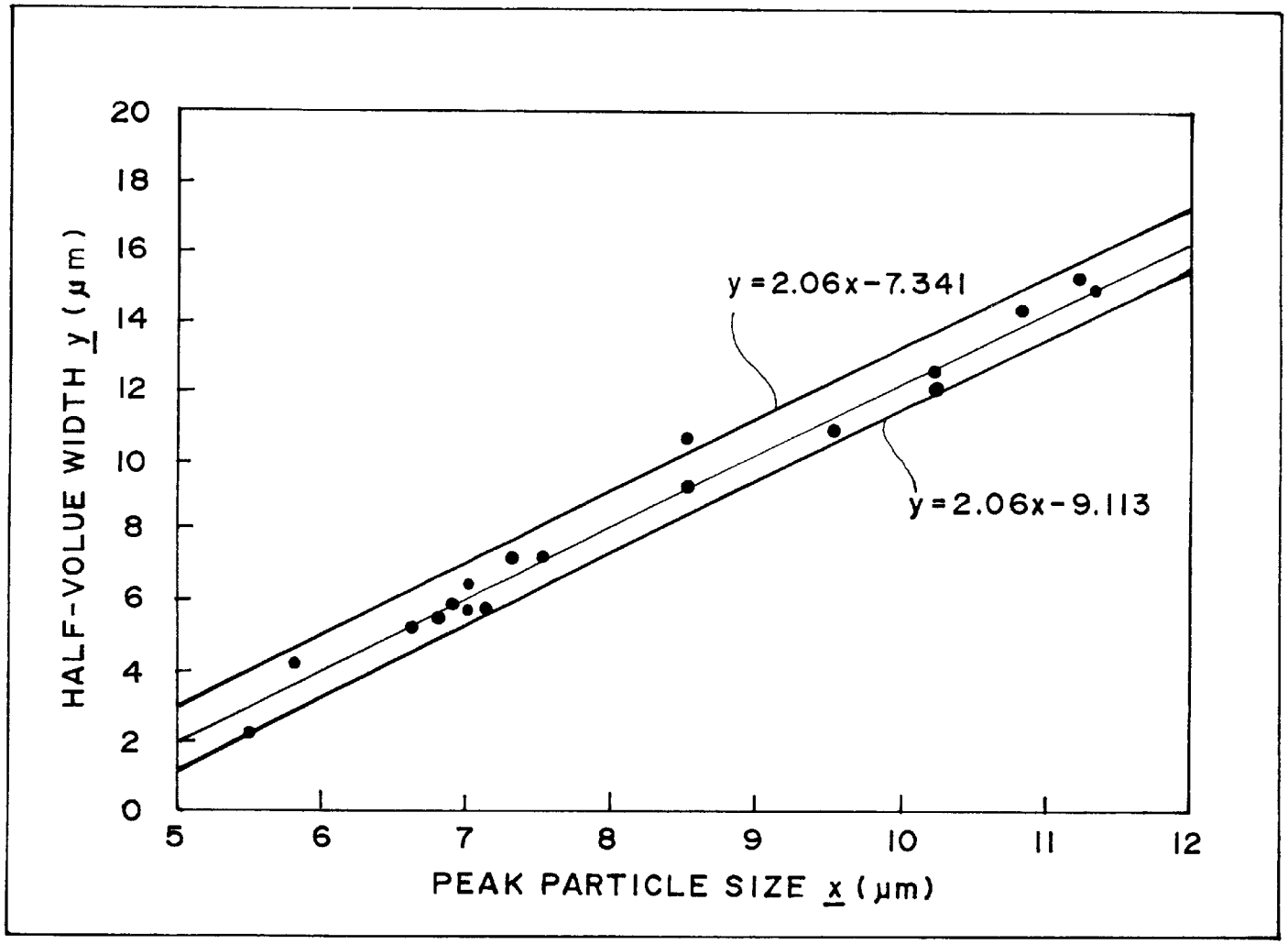
FIGS. 22 and 23 are respectively a graph showing a relationship between a relationship between a weight-average particle size X and a particle size distribution peak half-value width y.

FIG. 22 is a graph representing the above relationship together with spots indicating experimental data given by Examples described hereinafter.

More specifically, in a case of y>2.06x−7.341 showing a broad particle size distribution, the toner particles are liable to have a fluctuation in charge distribution, leading to an inferior performance in continuous image formation. On the other hand, a case of y<2.06x−9.113 represents a very narrow particle size distribution, and in such a case, the toner is provided with a very uniform charge and shows an improved developing performance, but the toner amount effectively used for development is liable to be increased thus resulting in rather undesirable image qualities, such as a broader line width and a lower dot reproducibility. Moreover, a toner having such a very narrow particle size distribution requires a severe classification step control, resulting in larger amounts of fine powder fraction and coarse powder fraction leading to a lower yield of the toner product.

(2) Fe/Si Atomic Ratio, Fe/Al Atomic Ratio

Fe/Si atomic ratio and Fe/Al atomic ratio at the surface-most portion of magnetic iron oxide particles are measured according to XPS (X-ray photoelectron spectroscopy), by using the following apparatus.

XPS apparatus: "ESCALAB 200-X" (made by VG Co.)

X-ray source: MgK$\alpha$ (300 W)

Analyzing region: 2×3 mm (3) Bulk Density ($d_B$)

Bulk density of ($d_B$) of magnetic iron oxide particles is measured according to JIS-K5101 (pigment test).

(4) BET Specific Surface Area ($S_{BET}$)

BET specific surface area ($S_{BET}$) of, e.g., magnetic iron oxide particles, is measured by an automatic gas adsorption apparatus ("Autosorb 1", made by Yuasa Ionics K.K.) according to the BET multi-point method by using nitrogen as the adsorbate gas for a sample pretreated for de-gasification at 50° C. for 10 hours.

(5) Average Particle Size (D1) and Spherical Specific Surface Area (Ssphere)

Magnetic iron oxide particles are photographed through a transmission electron miroscope to obtain pictures at a magnification of $4\times10^4$. On the pictures, 250 particles are selected at random and each particle projection image is subjected to measure a Martin diameter (a length of a chord dividing the projection image into two halves of identical area among chords taken in a constant direction). A number-average of the thus-measured 250 Martin diameters is taken as a number-average particle size (D1) of the magnetic iron oxide particles.

From the number-average particle size (D1 (m)) of the magnetic iron oxide particles, a spherical specific surface area (Ssphere) based on an assumption that each particle has a spherical shape, is calculated by using a true density ($d_t$ (g/m$^3$)) magnetic iron oxide particles separately measured, according to the following formula:

$$\text{Ssphere } (m^2/g)=6/(d_t \times D1).$$

(6) Smoothness (Dsm)

A smoothness (Dsm) of magnetic iron oxide particles is calculated from the BET specific surface area ($S_{BET}$) and the spherical specific surface area (Ssphere) measured in (4) and (5) above according to the following formula:

$$Dsm(-)=\text{Ssphere } (m^2/g)/S_{BET}(m^2/g)$$

(7) Elementary Content

The contents of various elements (including iron and non-iron element) may be measured by fluorescent X-ray analysis according to JIS K0119 (fluorescent X-ray analysis: general rules) by using fluorescent X-ray analyzer (e.g., "SYSTEM 3080", made by Rigaku Denki Kogyo K.K.).

Magnetic iron oxide particles containing a non-iron element, e.g., silicon (Si), may be prepared in the following manner.

Into a ferrous salt solution, an aqueous alkali hydroxide solution containing 0.90–0.99 equivalent of an alkali hydroxide is added for reaction to obtain an aqueous liquid containing ferrous hydroxide colloid, followed by introduction of oxygen-containing gas into the liquid to produce magnetite particles. Prior to or during the above process, a water-soluble silicate salt containing 50–99% of total silicon (Si) to be added (0.4–2.0 wt. % based on Fe) is added to either one of the above-mentioned alkali hydroxide aqueous solution and the aqueous liquid containing ferrous hydroxide colloid, and then the oxygen-containing gas is introduced to cause the oxidation while the system is heated in the range of 85–100° C., whereby magnetic iron oxide particles containing Si are produced from the ferrous hydroxide colloid. To the suspension liquid after the oxidation, an aqueous solution of alkali hydroxide in an amount of at least 1.00 equivalent with respect to $Fe^{2+}$ in the suspension liquid and the remaining amount of the water-soluble salt (containing 1–50% of Si among the total of 0.4–2.0 wt. % with respect to Fe) are added, followed further by heating at 85–100° C. for oxidation to obtain Si-containing magnetic iron oxide particles. Non-iron elements other than Si may be introduced by using a water-soluble salt of another corresponding element.

Further, for the treatment with aluminum oxide, into the alkaline suspension liquid wherein magnetic iron oxide particles have been produced, a water-soluble aluminum salt containing aluminum (Al) in a proportion of 0.01–2.0 wt. % of produced magnetic iron oxide particles is added, and the pH is adjusted to 6–8 to precipitate aluminum hydroxide on the magnetic iron oxide particles. Then, the particles are filtered out, washed with water, dried and disintegrated to obtain the product magnetic iron oxide particles. Then, the magnetic iron oxide particles are preferably subjected to application of compression force, shearing force and rubbing force by means of Mix-Muller (available from Shinto Kogyo K.K.), etc., for adjustment to desired smoothness and specific surface area.

The silicate compound to be added to the magnetic iron oxide particles may for example be silicates, such as commercially available sodium silitate, or silicate sol formed by hydrolysis.

The water-soluble aluminum salt may for example be aluminum sulfate.

The ferrous salt may for example be iron sulfate by-produced in the sulfuric acid process for titanium production and iron sulfate by-produced in surface washing of steel sheets. It is also possible to use iron chloride.

Arbitrary pigments or dyes may be added as another colorant to the magnetic toner of the present invention.

Examples of the pigment may include: carbon black, aniline black, acetylene black, Naphthol Yellow, Hansa Yellow, Rohdamine Lake, Alizarin Lake, red iron oxide, Phthalocyanine Blue and Indanthrene Blue. The pigment may be used in an amount for providing a sufficient optical density, e.g., 0.1–20 wt. parts, preferably 1–10 wt. parts, per 100 wt. parts of the binder resin. For a similar purpose, a dye can be used. Examples thereof may include: azo dyes, anthraquinone dyes, xanthene dyes and methine dyes. The dye may be used in 0.1–20 wt. parts, preferably 0.3–10 wt. parts, per 100 wt. parts of the binder resin.

Examples of the waxes usable in the present invention may include: aliphatic hydrocarbon waxes, such as low-molecular weight polyethylene, low-molecular weight polypropylene, polyolefin copolymers, polyolefin wax, microcrystalline wax, paraffin wax, and Fischer-Tropsche wax oxides of aliphatic hydrocarbon waxes, such as oxidized polyethylene wax, and block copolymers of these; waxes principally comprising aliphatic acid esters, such as montaic acid ester wax and castor wax; vegetable waxes, such as candelilla wax, carnauba wax and wood wax; animal waxes, such as bees wax, lanolin and whale wax; mineral waxes, such as ozocerite, ceresine, and petroractum; partially or wholly de-acidified aliphatic acid esters, such as deacidified carnauba wax. Further examples may include: saturated linear aliphatic acids, such as palmitic acid, stearic acid and montaic acid and long-chain alkylcarboxylic acids. having longer chain alkyl groups; unsaturated aliphatic acids, such as brassidic acid, eleostearic acid and valinaric acid; saturated alcohols, such as stearyl alcohol, eicosy alcohol, behenyl alcohol, carnaubyl alcohol, ceryl alcohol and melissyl alcohol and long-chain alkyl alcohols having longer chain alkyl groups; polybasic alcohols, such as sorbitol, aliphatic acid amides, such as linoleic acid amide, oleic acid amide, and lauric acid amide; saturated aliphatic acid bisamides, such as methylene-bisstearic acid amide, ethylene-biscopric acid amide, ethylene-bislauric acid amide, and hexamethylene-bisstearic acid amide; unsaturated aliphatic acid amides, such as ethylene-bisoleic acid amide, hexamethylene-bisoleic acid amide, N,N'-dioleyladipic acid amide, and N,N-dioleylsebacic acid amide; aromatic bisamides, such as m-xylene-bisstearic acid amide, and N,N'-distearylisophthalic acid amide; aliphatic acid metal soaps (generally called metallic soaps), such as calcium stearate, calcium stearate, zinc stearate and magnesium stearate; waxes obtained by grafting vinyl monomers such as styrene and acrylic acid onto aliphatic hydrocarbon waxes; partially esterified products between aliphatic acid and polyhydric alcohols, such as behenic acid monoglyceride; and methyl ester compounds having hydroxyl groups obtained by hydrogenating vegetable oil and fat.

Examples of preferably usable waxes may include: polyolefins obtained by radical polymerization of olefins under high pressure; polyolefins obtained by purification of low-molecular weight by-products obtained in polymerization for high-molecular weight polyolefins; polyolefins polymerized under low pressure by using catalysts such as a Ziegler catalyst or a metallocene catalyst; polyolefins polymerized under irradiation with radiation, electromagnetic wave or light; low-molecular weight polyolefin by thermal decomposition of high-molecular weight polyolefin; paraffin wax, microcrystalline wax, Fischer-Tropsche wax; synthetic hydrocarbon waxes, such as those synthesized through the Synthol process, the Hydrocol process and the Arge process; synthetic wax obtained from mono-carbon compound; hydrocarbon waxes having a functional group, such as a hydroxyl group or carboxyl group; mixtures of hydrocarbon waxes and functional group-containing waxes; and waxes obtained by grafting onto these waxes with vinyl monomers, such as styrene, maleic acid esters, acrylates, methacrylates and maleic anhydride.

It is also preferred to use a wax having a narrower molecular weight distribution or a reduced amount of impurities, such as low-molecular weight solid aliphatic acid, low-molecular weight solid alcohol, or low-molecular weight solid compound, by the press sweating method, the solvent method, recrystallization, vacuum distillation, supercritical gas extraction or fractionating crystallization.

In order to provide the toner with a good balance of fixability and anti-offset property, it is preferred to use a wax having a melting point of 65–160° C., more preferably 65–130° C., further preferably 70–120° C. Below 65° C., the anti-blocking property of the toner is lowered, and above 160° C., it is difficult to attain the anti-offset effect.

In the toner of the present invention, the wax may be used in an amount of 0.2–20 wt. parts, more preferably 0.5–10 wt. parts, per 100 wt. parts of the binder resin. It is possible to use such waxes singly or in combination of two or more species in a total amount within the above range.

The wax melting point is determined in terms of a peak-top temperature of a largest peak on a heat-absorption curve of a wax according to DSC (differential scanning calorimetry).

For a DSC measurement of a wax or a toner, it is possible to use, e.g., "DSC-7" (available from Perkin-Elmer Corp.) according to ASTM D3418-82. It is appropriate to once heat a sample for removing a thermal hystory and then heat the sample at rate of 10° C./min in a temperature range of 0–200° C. to take a DSC heat-absorption curve.

The toner of the present invention may preferably contain a charge control agent.

Examples of negative charge control agents may include: monoazo dye metal complexes as disclosed in JP-B 41-20153, JP-B 42-27596, JP-B 44-6397 and JP-B 45-26478; nitrohumic acid, its salt and dye or pigment, such as C.I. 14645 disclosed in JP-A 50-133838, complexes of salicylic acid, naphthoic acid and dicarboxylic acids with metals, such as Zn, Al, Co, Cr, Fe and Zr disclosed in JP-B 55-42752, JP-B 58-41508, JP-B 58-7384, and JP-B 59-7385; sulfonated copper phthalocyanine pigments; styrene oligomers having introduced nitro or halogen group; and chlorinated paraffins. Because of excellent dispersibility, stable image density and effect of fog reduction, it is preferred to use an azo metal complex of formula (I) below or a basic organic acid metal complex of formula (II) below:

(I)

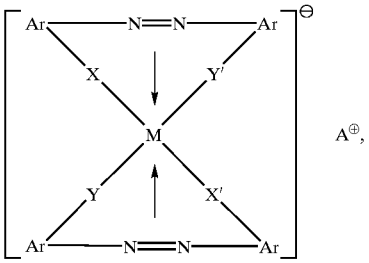

wherein M denotes a coordination center metal selected from the group consisting of Cr, Co, Ni, Mn, Fe, Ti and Al; Ar denotes an aryl group capable of having a substituent, selected from include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^{\oplus}$ denotes a hydrogen, sodium, potassium, ammonium or aliphatic ammonium ion or a mixture of such ions.

(II)

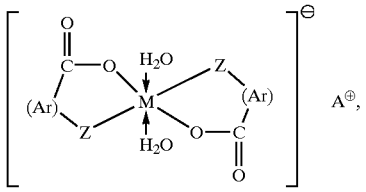

wherein M denotes a coordination center metal selected from the group consisting of Cr, Co, Ni, Mn, Fe, Ti, Zr, Zn, Si, B and Al; Ar denotes an aryl group capable of having a substituted selected from nitro, halogen, carboxyl, anilide and alkyls and alkoxyles having 1–18 carbon atoms; Z denotes —O— or —CO—O—; and $A^{\oplus}$ denotes a hydrogen, sodium potassium, ammonium or aliphatic ammonium ion, or a mixture of such ions.

Among the above, it is particularly preferred to use an azo metal iron complex of the above formula (I), and particularly an azo iron complex of formula (III) or (IV) shown below.

Formula (III):

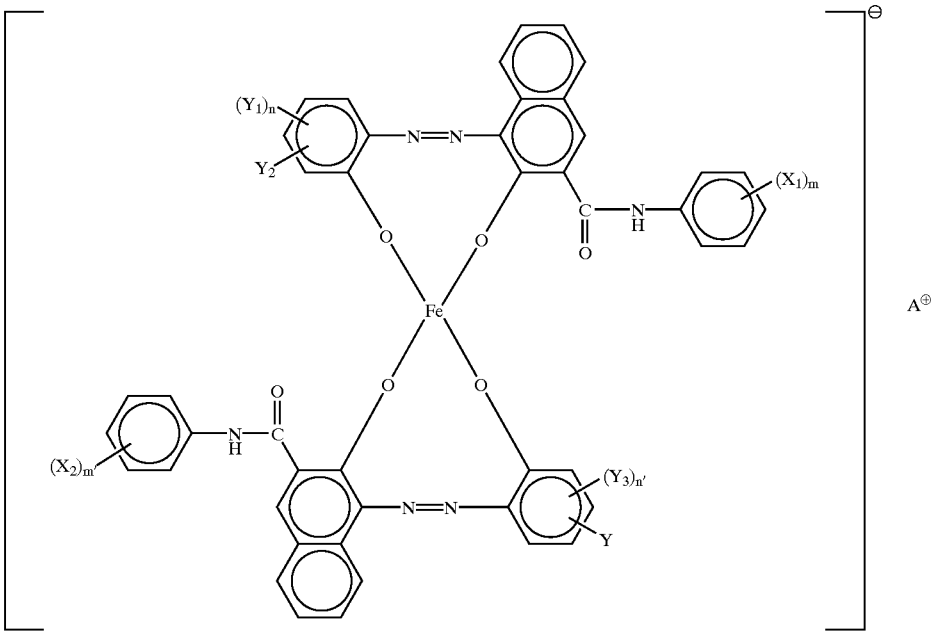

wherein $X_1$ and $X_2$ independently denote hydrogen, alkyl having 1–18 carbon atoms, alkoxy having 1–18 carbon atoms, nitro or halogen; m and m' denote an integer of 1–3; $Y_1$ and $Y_3$ independently denote hydrogen, alkyl having 1–18 carbon atoms, alkenyl having 2–18 carbon atoms, sulfonamide, mesyl, sulfonic acid, carboxy ester, hydroxy, alkoxy having 1–18 carbon atoms, acetylamino, benzoylamino or halogen; n and n' denote an integer of 1–3; $Y_2$ and $Y_4$ independently denote hydrogen or nitro; and $A^{\oplus}$ denotes an ammonium, hydrogen, sodium or potassium ion, or a mixture such ions, preferably containing 75–98 mol % of ammonium ion.

Formula (IV):
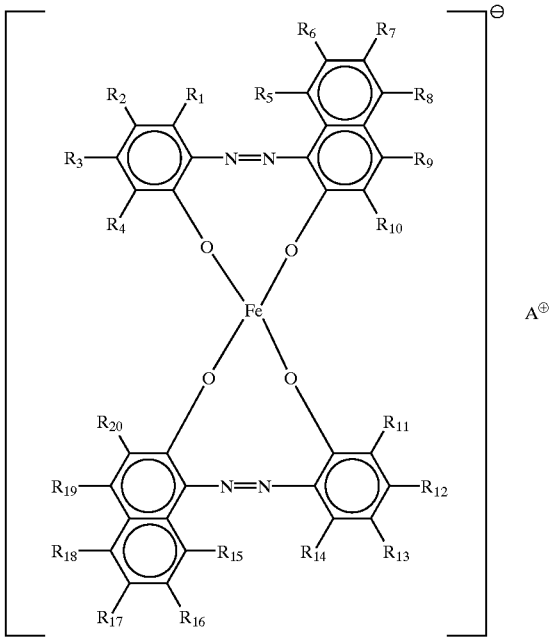
wherein $R_1$–$R_{20}$ independently denote hydrogen, halogen or alkyl; and $A^{\oplus}$ denotes an ammonium, hydrogen, sodium, or potassium ion, or a mixture of such ions.
Specific examples of the azo iron compounds represented by the above formula (III) are enumerated below where $A^{\oplus}$ has the same meaning as defined in the formula (III).
Azo ion complex (1)
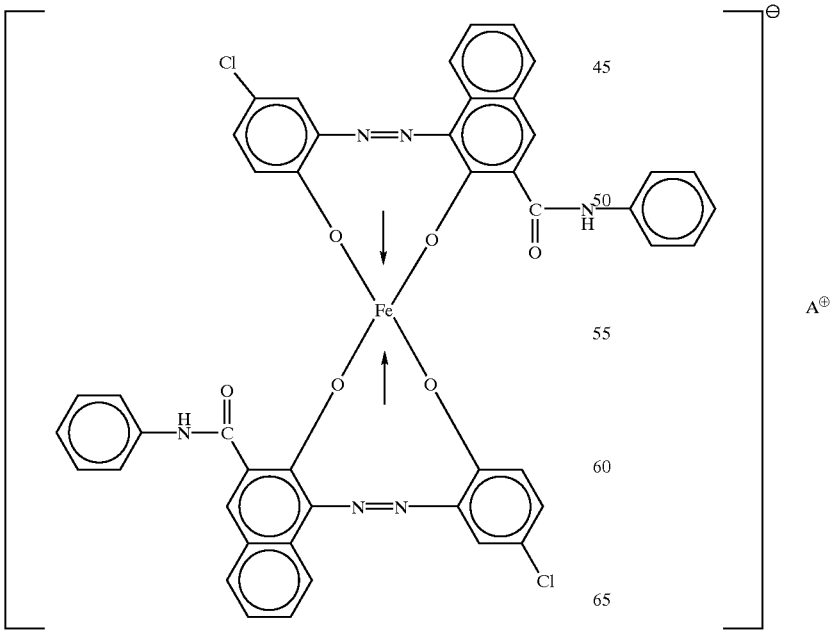

-continued
Azo ion complex (2)
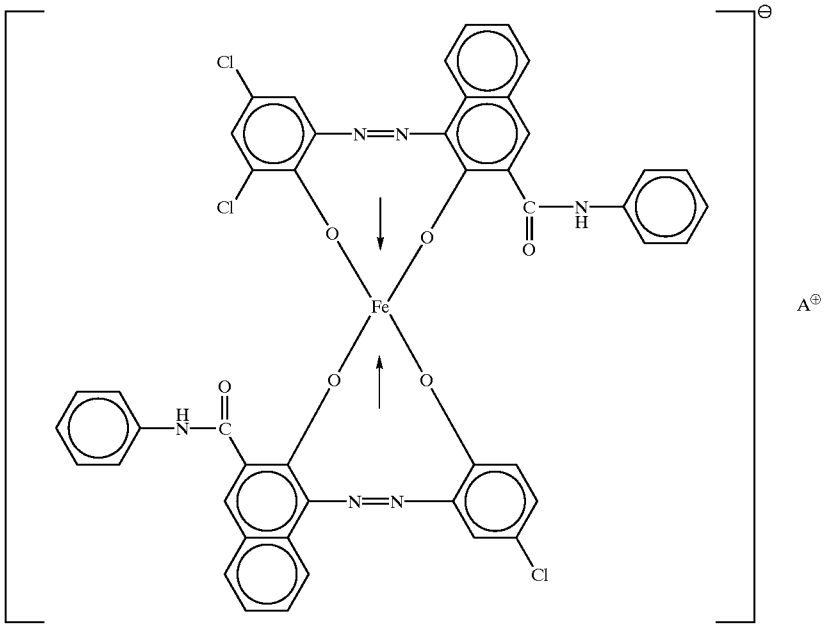
Azo ion complex (3)
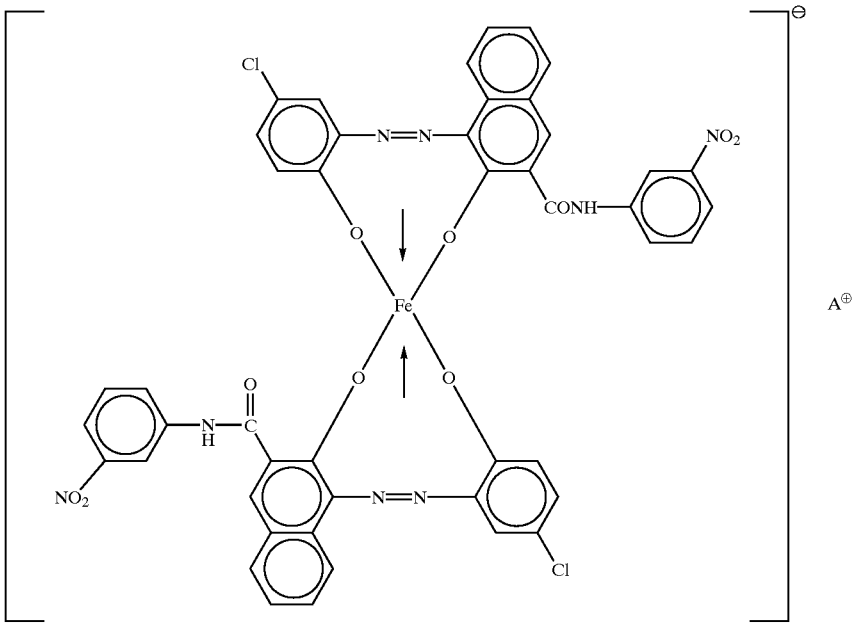

-continued
Azo ion complex (4)
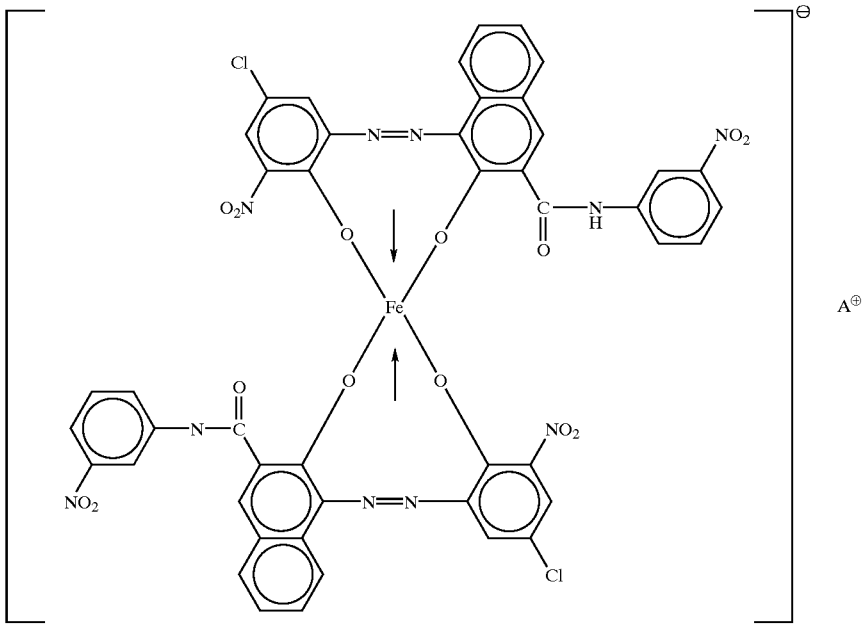
Azo ion complex (5)
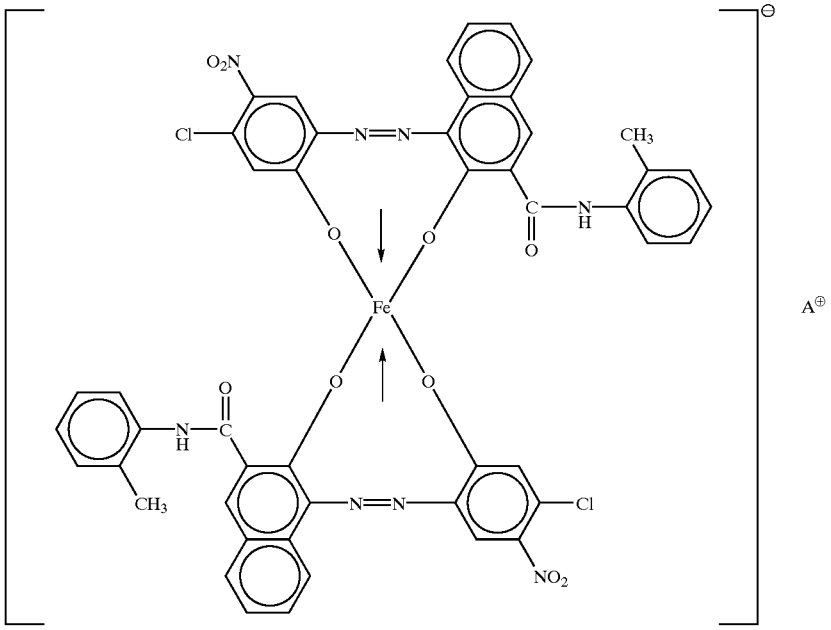

-continued
Azo ion complex (6)
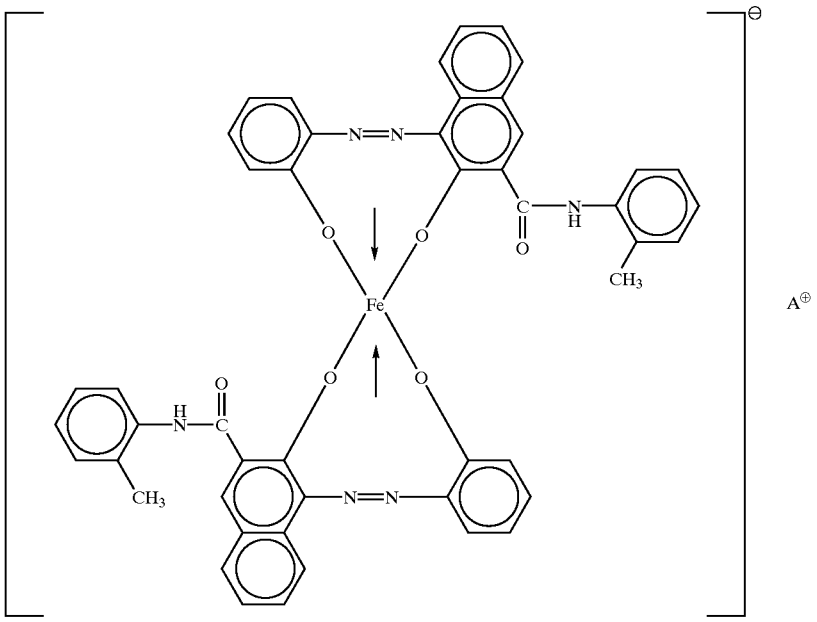
Further, some specific examples of charge control agents represented by the above-mentioned formulae (I), (II) and (IV) are enumerated below where $A^{\oplus}$ has the same meaning as defined in the formula (IV):
Azo chromium complex (7):
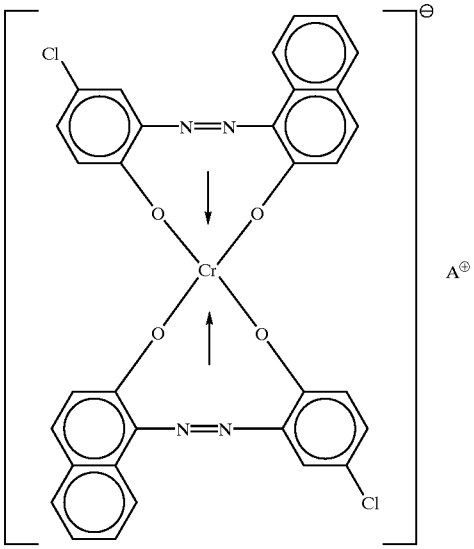

-continued
Azo chromium complex (8):
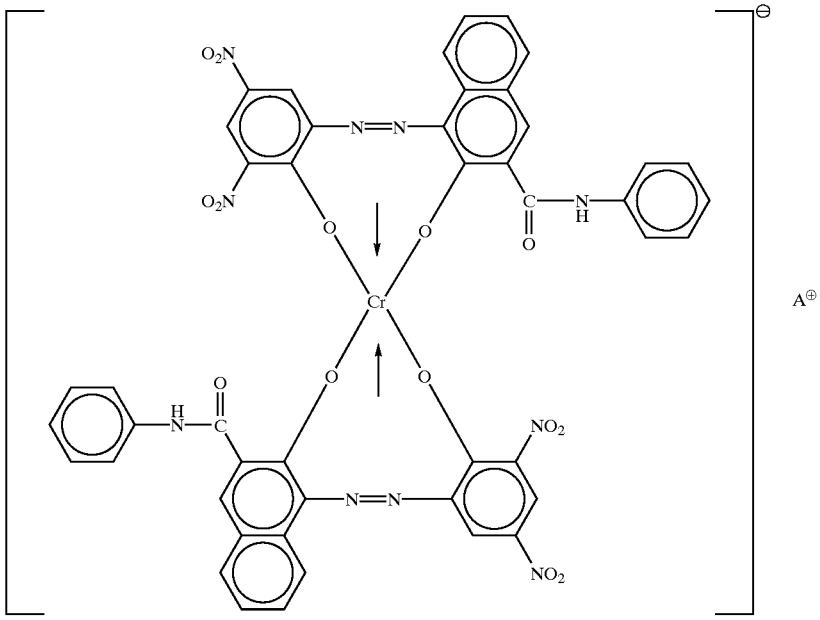
Aluminum complex (9):
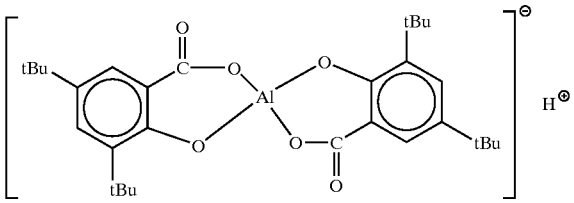
Zinc complex (10):
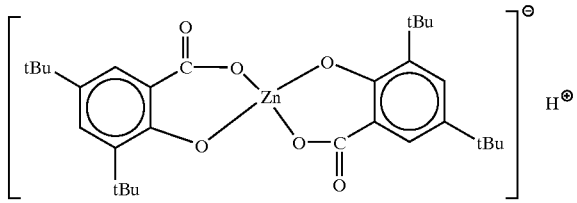
Chromium complex (11):
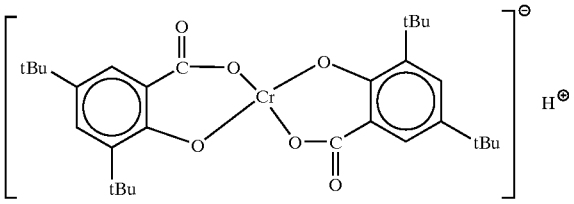
Zirconium complex (12):
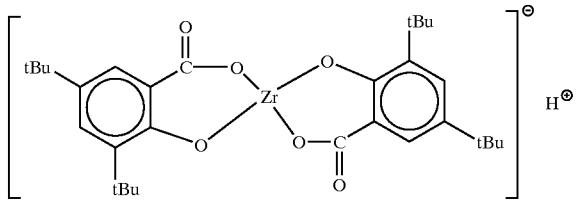

-continued

Azo iron complex (13):

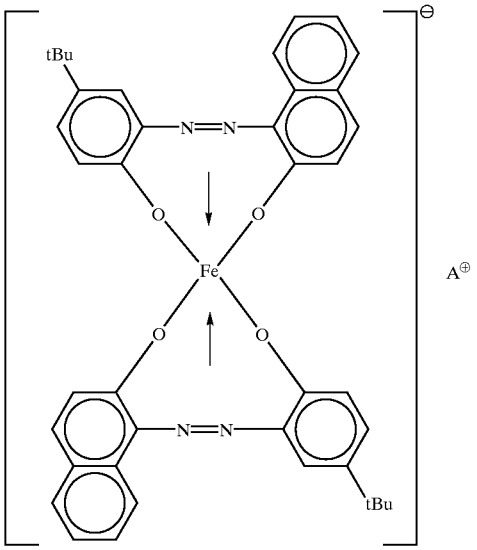

The above-mentioned metal complex compounds may be used singly or in combination of two or more species.

The charge control agent may preferably be used in a proportion of 0.1–5.0 wt. parts per 100 wt. parts of the binder resin.

On the other hand, examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologues inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species.

The toner may preferably contain inorganic fine powder or hydrophobic inorganic fine powder externally added to and blended with toner particles. For example, it is preferred to contain silica fine powder.

As the silica fine powder, it is possible to use both the dry-process silica (or fumed silica) formed by vapor phase oxidation of a silicon halide and the wet-process silica formed from water glass. It is however preferred to use the dry-process silica in view of less superficial or internal silanol groups and less production residue.

It is preferred that the silica fine powder has been hydrophobized. The hydrophobization may be effected by surface treatment of silica fine powder with an organic silicon compound reactive with or physically adsorbed by the silica fine powder. In a preferred embodiment, dry-process silica fine powder formed by vapor-phase oxidation of a silicon halide may be surface-treated with a silane coupling agent, followed by or simultaneously with treatment with an organic silicon compound, such as silicone oil.

Example of such a silane coupling agent may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

Silicone oil preferably used as an organic silicon compound may have a viscosity at 25° C. of $3\times10^{-5}$–$1\times10^{-3}$ $m^2/s$. Particularly preferred examples thereof may include: dimethylsilicone oil, methylphenylsilicone oil, α-methylstyrene-modified silicone oil, chlorophenylsilicone oil, and fluorine-containing silicone oil.

Treatment with such a silicone oil may be performed by, e.g., direct blending with silicone oil of silica fine powder already treated with a silane coupling agent in a blender, such as a Henschel mixer; spraying silicone oil onto base silica fine powder; or blending of silica fine powder with silicone oil dissolved or dispersed in an appropriate solvent, followed by removal of the solvent.

The toner of the present invention may contain an external additive, as desired, other than the silica fine powder. Examples thereof may include: a chargeability-enhancing agent, an electro-conductivity-imparting agent, a flowability-improving agent, an anti-caking agent, a release agent for hot roller fixation, and resinous fine particles or inorganic fine particles functioning as a lubricant or abrasive agent.

For example, it is sometimes effective to add a lubricant, such as particles of polytetrafluoroethylene, zinc stearate or polyvinylidene fluoride, preferably polyvinylidene fluoride; an abrasive, such as particles of cerium oxide, silicon carbide or strontium titanate, preferably strontium titanate; a flowability improving agent, such as particles of titanium oxide or aluminum oxide, preferably hydrophobized; an anti-caking agent in electro-conductivity-imparting agent, such as carbon black zinc oxide for tin oxide; and a small amount of white or black fine particles having an opposite polarity of triboelectric chargeability compared with toner particles.

The inorganic fine powder or hydrophobic fine powder may preferably be added in 0.1–5 wt. parts, preferably 0.1–3 wt. parts to 100 wt. parts of the toner.

The magnetic toner according to the present invention may preferably exhibit a Carr's floodability index larger than 80 and more preferably also a Carr's flowability index larger than 60.

Carr's flowability index and floodability index described herein are based on values measured in the following manner.

By using a powder tester ("P-100", available from Hosokawa Micron K.K.), respective parameters of an angle of repose, an angle of difference, a compressibility,-a cohesion, an angle of spatula and a dispersibility, are measured, and the respective measured parameters are substituted into Carr's tables for determination of flowability and floodability indices (Chemical Engineering, Jan. 18, 1965, pp. 163–168) to obtain corresponding point scores (max=25) for the respective parameters. By summing up the point scores for specified parameters, a flowability index and a floodability index are calculated. The respective parameters are measured in the following manner.

(1) Angle of Repose

A toner sample in an amount of 150 g is dropped through a mesh having an opening of 150 μm into a circular table of 8 cm in diameter to form a heap of the toner. The dropping of the sample is performed so as to cause an overflow of the sample beyond the edge of the table. Then, the angle between the slope of the sample heap and the horizontal table surface is measured by illumination with a laser beam as an angle of repose.

(2) Compressibility

A loose packing bulk density (loose apparent specific gravity) A and a tapping bulk density (packed apparent specific gravity) B are measured in manners described below to determining a compressibility according to the following formula:

$$\text{Compressibility } (\%)=100\times(P-A)/P.$$

(Loose Apparent Specific Gravity)

Into a 100 cc-cup of 5 cm in diameter and 5.2 cm in height, 150 g of a sample toner is gently placed to form an overflow, and the overflow of the sample is leveled off to measure a weight of the sample in the cup, from which a loose apparent specific gravity A is calculated.

(Packed Apparent Specific Gravity)

The 100 cc-cup used for the above loose apparent specific gravity measurement is equipped with an accessory cap. After placing a plenty of toner sample in the cup, the capped cup is tapped 180 times. Then the cap is removed, and an excess heap of the sample is leveled off to measured a weight of the packed sample, from which a packed apparent specific gravity B is calculated.

The thus-measured two apparent specific gravity values A and B are substituted in the above equation to calculate a compressibility.

(3) Angle of Spatula

A spatula measuring 3 cm×8 cm is placed in so as to reach a bottom of a vat measuring 10 cm×15 cm. A sample toner is placed on the spatula to form a heap thereon. Then, only the vat is gently set down to measure a side inclinating angle of the toner heap remaining on the spatula as a spatula angle by laser illumination. Then, one shock is applied from a shocker attached to the spatula, and then a spatula angle is measured again.

An average of two measured angles before and after the shock application is taken as a spatula angle.

(4) Cohesion

On a vibration table, sieves having openings of 75 μm, 150 μm and 250 μm are placed and set in this order to form a nest of sieves Then, 5 g of a sample toner is placed on the uppermost sieve (250 μm) and the nest of sieves are vibrated at an amplitude of 1 mm for 20 sec. After the termination of the vibration, the amounts of the samples remaining on the respective sieves are measured and multiplied by respective factors as follows:

$$((\text{sample weight on the upper sieve})/5)\times100=a$$

$$((\text{sample weight on the middle sieve})/5)\times100\times0.6=b$$

$$((\text{sample weight on the lower sieve})/5)\times100\times0.2=c$$

Then, a cohesion is calculated as assume of these values, i.e.:

$$\text{Cohesion } =a+b+c$$

As mentioned above, the above-measured parameters (1)–(4) are respectively substituted into a Carr's table (Chemical Engineering, Jan. 18, 1965) for determining a flowability index to obtain corresponding point scores (up to 25 for each item), and the sum of them (point scores for parameters (1)–(4)) provides a Carr's flowability index.

(5) Angle of Fall

For the circular table placed on a wet and carrying the heap of toner sample after the angle of repose measurement (1), three times of shock are applied by a shocker, and an angle of the sample heap remaining on the table relative to the table surface is measured as an angle of fall by laser illumination.

(6) Angle of Difference

An angle of difference is given as a difference between the angle of repose (1) and the angle of fall (5).

(7) Dispersibility 10 g of a sample toner is dropped in a mass from a height of ca. 60 cm onto a 10 cm-dia. watch glass, and the weight W (g) of the toner remaining on the watch glass is measured to calculate a dispersibility according to the following equation:

$$\text{Dispersibility } (\%)=(10-W)\times10.$$

The above-measured parameters (5)–(7) and the above-obtained flowability index are substituted into a Carr's table (also Chemical Engineering, Jan. 16, 1965) to obtain corresponding point scores (max=25) for the respective parameters. By summing up the point sores for the respective parameters, a Carr's floodability index is determined.

As a result of the above determination, it has been found that a magnetic toner showing a Carr's floodability index larger than 80, preferably 81–89 and more preferably also a Carr's flowability index larger than 60, further preferably 61–79, shows a high flowability under stirring by a stirring member even when packed in a higher degree of packing in a process cartridge, so that the magnetic toner can be conveyed at a constant speed from the toner storage in the cartridge to the developing sleeve, thus exhibiting a stable developing performance even when incorporated in a high-speed printer and packed in a large-volume cartridge. The magnetic toner of the present invention may be provided with proper levels of floodability index and flowability index by controlling the particle size and shape of magnetic toner particles and the amount and state of attachment of external additives. More specifically, by controlling the number of isolated iron-containing particles at 100–350 particles per 10,000 toner particles, it becomes possible to suppress the lowering of flowability due to agglomeration of isolated magnetic iron oxide particles, and the above-mentioned floodability and flowability indices can be accomplished by controlling the stirring state at the time of external additive blending by changing the stirring blade shape and stirring mode, and the processed amount in the mixer, if the magnetic toner has a floodability index of 80 or below, the toner may show a high flowability but if the toner plugging is once caused, the flowability is not recovered readily. As a result, the uniform conveyance of the magnetic toner to the developing sleeve becomes difficult, and the magnetic toner ununiformly covering the developing sleeve is liable to be ununiformly charged to result in image irregularity.

Further, if the magnetic toner shows a floodability index of 80 or below and a flowability index of 60 or below, the magnetic toner particles are liable to agglomerate with each other and cause melt-sticking of the magnetic toner at the sliding parts in the cartridge.

Further, the magnetic toner of the present invention may preferably exhibit an absolute value of triboelectric chargeability |Qd| satisfying:

$$70 \geqq |Qd| \geqq 20\ \mu C/g.$$

As the triboelectric chargeability is largely affected by the surface shape of magnetic toner particles and the state of exposure of magnetic iron oxide particles at the toner particle surfaces, in order to obtain a desired level of triboelectric chargeability, it is important to control the proportion of isolated iron-containing particles from the toner particles, appropriately selecting the species and amount of the external additive and control the stirring state in the external additive mixing apparatus by changing the blade shape, the processed amount in the mixer and the stirring mode.

The values of triboelectric chargeability Qd described herein are based on values measured according to the following method.

In an environment of 23° C. and 60% RH, 1.0 g of a sample magnetic toner is placed in a 50 to 100 ml-polyethylene bottle together with 9.0 g of an iron powder carrier having a particle size distribution including 50–70 wt. % of particles in a particle size range of 106–150 μm, and 20–50 wt. % of particles in a particle size range of 75–106 μm (e.g., "IDSP138", made by Dowa Teppun K.K.). Then, the bottle containing the mixture is shaken 50 times by hands.

Figure 19:
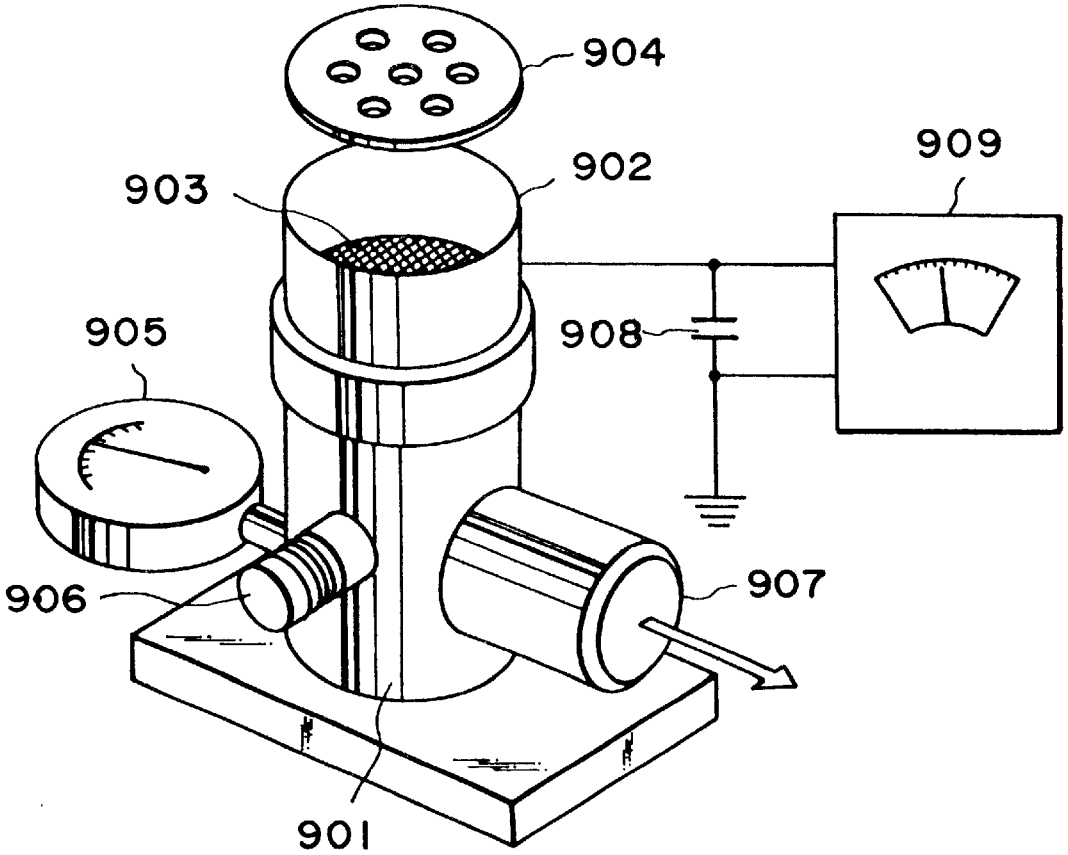
FIG. 19 illustrates a device for measuring toner chargeability.

The mixture is subjected to measurement in a measurement apparatus as illustrated in FIG. 19. More specifically, 1.0–1.2 g of the mixture is placed in a metal measurement vessel 902 bottomed with a 500-mesh screen 903 and then covered with a metal lid 904. The weight of the entire measurement vessel 902 at this time is weighed at $W_1$ (g). Then, an aspirator 901 (composed of an insulating material at least with respect to a portion contacting the measurement vessel 902) is operated to suck the toner through a suction port 907 while adjusting a gas flow control valve 906 to provide a pressure of 2 kPa at a vacuum gauge 905. Under this state, the toner is sufficiently removed by sucking for 1 min.

The potential reading on a potentiometer 909 at this time is denoted by V (volts) while the capacitance of a capacitor 908 is denoted by C (mF), and the weight of the entire measurement vessel is weighed at $W_2$ (g). Then, the triboelectric charge Qd (mC/kg) of the sample toner is calculated by the following equation:

$$Qd\ (\text{mC/kg}) = C \times V/(W_1 - W_2).$$

If the magnetic toner has an absolute value of triboelectric chargeability |Qd| with respect to iron powder carrier exceeding 70 μc/g, the magnetic toner is liable to cause a lowering in developing performance due to excessive charge particularly in a low humidity environment. On the other hand, if |Qd|<20 μC/g, because of a lower chargeability, the magnetic toner on the developing sleeve is liable to fail in acquiring an appropriate level of electrostatic agglomeration force and an appropriate level of magnetic constraint force, thus failing to achieve a faithful transfer onto an electrostatic latent image and thus showing a lower developing performance.

The magnetic toner of the present invention may preferably show a maximum heat-absorption peak temperature (Tabs.max) in a range of 60–120° C. on a heat-absorption curve according to DSC (differential scanning calorimetry). If Tabs.max is below 60° C., the toner is liable to exhibit lower anti-offset property and anti-blocking property. If Tabs.max exceeds 120° C., the fixability is lowered.

It is further preferred that the toner of the present invention shows a second or sub-heat absorption peak temperature (Tabs.2nd) in a range of 60–160° C., which differs by at least 20° C. from Tabs.max, so as to realize an effective function separation of fixability and releasability. If the absorption peak temperature difference (|Tabs.max-Tabs.2nd|) is below 20° C., it becomes difficult to realize the functional separation. More specifically, if such heat-absorption peaks are present, the plasticizing effect and the releasability effect are appropriately adjusted to provide a good balance among fixability, anti-offset property and anti-blocking property. The specified circularity of the magnetic toner of the present invention allows more effective exhibition of the plasticizing effect and the release effect over a wide temperature range.

Now, a preferred embodiment of process for producing the toner of the present invention will be described. FIG. 1 is a flow chart for illustrating an outline of such an production process embodiment. As shown in the flow chart, the toner of the present invention may preferably be produced through a process which does not include a classification step before the pulverization but includes a single path of pulverization step and classification step.

For the toner production, specified toner ingredients are used and subjected to production steps of which conditions are variously selected, to provide toner particles having a specified number of isolated iron-containing particles and a specified circularity. Generally, toner ingredients including at least a binder resin, magnetic iron oxide particles and a wax are melt-kneaded, and the melt-kneaded product after being cooled is pulverized to provide a coarsely pulverized material as a powdery feed. A prescribed amount of the pulverized material is introduced into a mechanical pulverizer including at least a rotor comprising a rotating member affixed to a central rotation shaft, and a stator housing the rotor with a prescribed spacing from the rotor surface, so that an annular space given by the spacing is made airtight, and the rotor is rotated at a high speed to finely pulverize the coarsely pulverized material. Then, the fine pulverizate is introduced to a classification step to obtain toner particles comprising a mass of particles having preferred particle sizes. In the classification step, it is preferred to use a multi-division pneumatic classifier including at least three zones for recovery of fine powder, medium powder and coarse powder. For example, in the case of using a three-division pneumatic classifier, the feed powder is classified into three types of fine powder, medium powder and coarse powder. In the classification step using such a classified, medium powder is recovered while removing the coarse powder comprising particles having sizes larger than the prescribed range and the fine powder comprising particles having sizes smaller than the prescribed range, and the medium powder is recovered as toner particles which may be used as they are as a toner product or blended with an external additive, such as hydrophobic colloidal silica to provide a toner.

The fine powder removed in the classification step and comprising particles having particle size below the prescribed range are generally recycled for re-utilization to the melt-kneading step for providing a coarsely pulverized melt-kneaded product comprising toner ingredients, or discarded.

Figure 2:
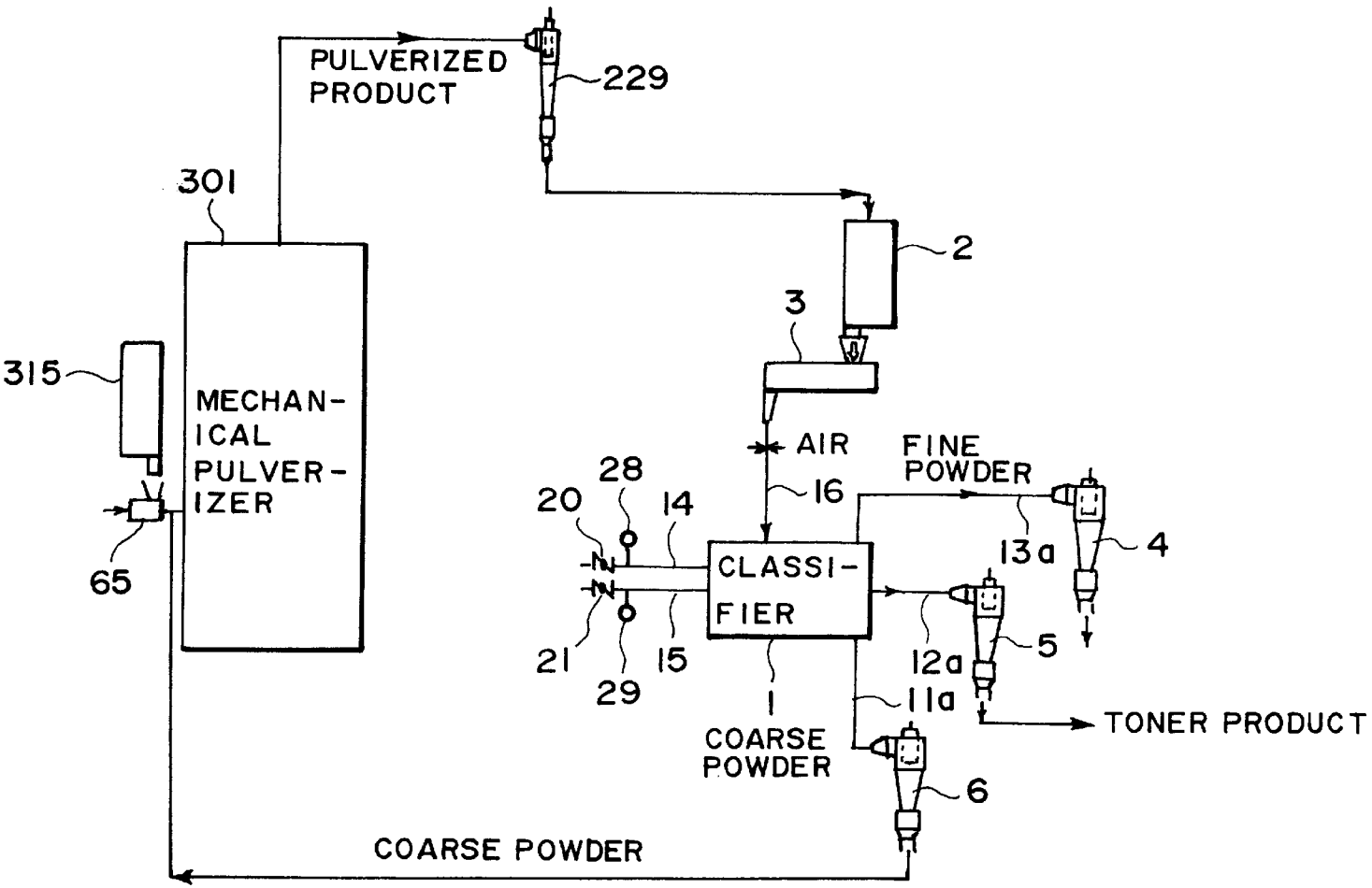
FIG. 2 illustrates an example of the apparatus system for practicing a toner production process.

FIG. 2 illustrates an embodiment of such a toner production apparatus system. In the apparatus system, a powdery feed comprising at least a binder resin, magnetic iron oxide and a wax is supplied. For example, a binder resin, magnetic iron oxide and a wax are melt-kneaded, cooled and pulverized to form such a powdery feed.

Referring to FIG. 2, the powdery feed is introduced at a prescribed rate to a mechanical pulverizer 301 as pulverization means via a first metering feeder 315. The introduced powdery feed is instantaneously pulverized by the mechanical pulverizer 301, introduced via a collecting cyclone 329 to a second metering feeder 2 and then supplied to a multi-division pneumatic classifier 1 via a vibration feeder 3 and a feed supply nozzle 16.

In the apparatus system, the feed rate to the multi-division pneumatic classifier, via the second metering feeder 2, may preferably be set to 0.7–1.7 times, more preferably 0.7–1.5 times, further preferably 1.0–1.2 times, the feed rate to the mechanical pulverizer 301 from the first metering feeder, in view of the toner productivity and production efficiency.

Figure 6:
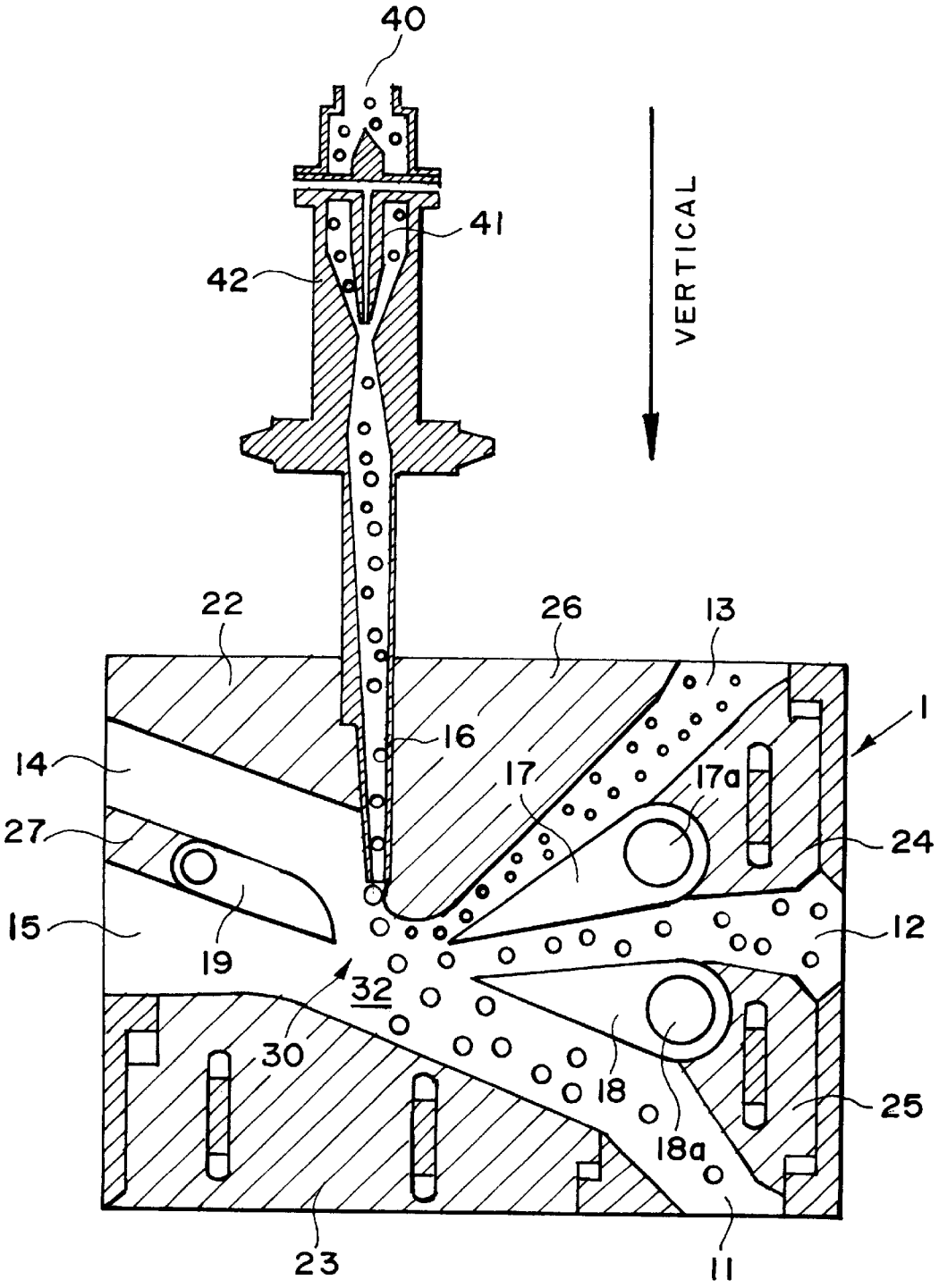
FIG. 6 is a schematic sectional view of a multi-division pneumatic classifier used in a toner classification-step.

A pneumatic classifier is generally incorporated in an apparatus system while being connected with other apparatus through communication means, such as pipes. FIG. 2 illustrates a preferred embodiment of such an apparatus system. The apparatus system shown in FIG. 2 includes the multi-division classifier 1 (the details of which are illustrated in FIG. 6), the metering feeder 2, the vibration feeder 3, and collecting cyclones 4, 5 and 6, connected by communication means.

In the apparatus system, the pulverized feed is supplied to the metering feeder 2 and then introduced into the three-division classifier 1 via the vibration feeder 3 and the feed supply nozzle 16 at a flow speed of 10–350 m/sec. The three-division classifier 1 includes a classifying chamber ordinarily measuring 10–50 cm×10–50 cm×3–50 cm, so that the pulverized feed can be classified into three types of particles in a moment of 0.1–0.01 sec or shorter. By the classifier 1, the pulverized feed is classified into coarse particles, medium particles and fine particles. Thereafter, the coarse particles are sent out of an exhaust pipe 1*a* to a collecting cyclone 6 and then recycled to the mechanical pulverizer 301. The medium particles are sent through an exhaust pipe 12*a* and discharge out of the system to be recovered by a collecting cyclone 5 as a toner product. The fine particles are discharged out of the system via an exhaust pipe 13*a* and are discharged but of the system to be collected by a collecting cyclone 4. The collected fine particles are supplied to a melt-kneading step for providing a powdery feed comprising toner ingredients for re-utilization, or are discarded. The collecting cyclones 4, 5 and 6 can also function as a suction vacuum generation means for introducing by sucking the pulverized feed to the classifier chamber via the feed supply nozzle. The coarse particles classified out of the classifier 1 may preferably be re-introduced to the first metering feeder 315 to be mixed with a fresh powdery feed and re-pulverized in the mechanical pulverizer.

The rate of re-introduction of the coarse particles to the mechanical pulverizer 301 from the pneumatic classifier 1 may preferably be set to 0–10.0 wt. %, more preferably 0–5.0 wt. %, of the pulverized feed supplied from the second metering feeder 2 in view of the toner productivity. If the rate of re-introduction exceeds 10.0 wt. %, the powdery dust concentration in the mechanical pulverizer 301 is raised to increase the load on the pulverizer 30, and the toner productivity can be lowered due to difficulties, such as over-pulverization heat causing toner surface deterioration, isolation of the magnetic iron oxide particles from the toner particles and melt-sticking onto the apparatus wall.

The powdery feed to the apparatus system may preferably have a particle size distribution such that a least 95 wt. % is 18 mesh-pass and at least 90 wt. % is 100 mesh-on (according to ASTME-11-61).

In order to produce a toner having a weight-average particle size (D4) of at most 10 $\mu$m, preferably at most 8 $\mu$m, and a narrow particle size distribution, the pulverized product out of the mechanical pulverizer may preferably satisfy a particle size distribution including a weight-average particle size of 5–10 $\mu$m, at most 70% by number, more preferably at most 65% by number of particles of at most 4.0 $\mu$m, and at most 25% by volume, more preferably at most 20% by volume, of particles of at least 10.1 $\mu$m. Further, the medium particles classified out of the classifier 1 may preferably satisfy a particle size distribution including a weight-average particle size of 5–10 $\mu$m, at most 40% by number, more preferably at most 35% by number of particles of at most 4.0 $\mu$m, and at most 25% by volume, more preferably at most 20% by volume, of particles of at least 10.1 $\mu$m.

Figure 7:
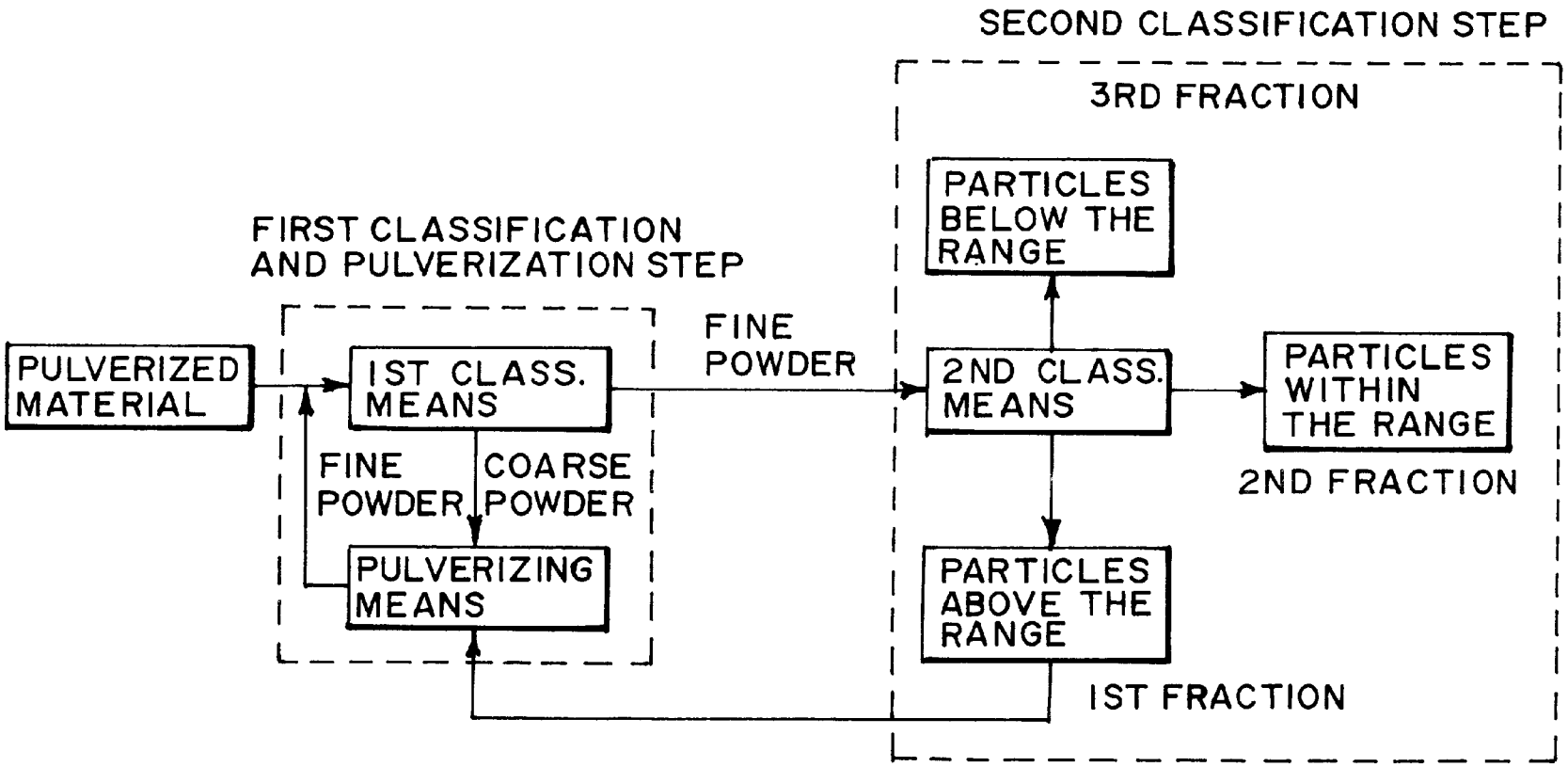
FIG. 7 is a flow chart for illustrating a conventional toner production process.

The apparatus system shown in FIG. 1 does not include a first classification step, as contained in the conventional system shown in FIG. 7, prior to the pulverization step, and includes a single pass of pulverization step and classification step.

The mechanical pulverizer 301 suitably incorporated in the apparatus system of FIG. 2 may be provide by a commercially available pulverizer, such as "KTM" (available from Kawasaki Jukogyo K.K.) or "TURBOMILL" (available from Turbo Kogyo K.K.), as it is, or after appropriate re-modeling.

Figure 3:
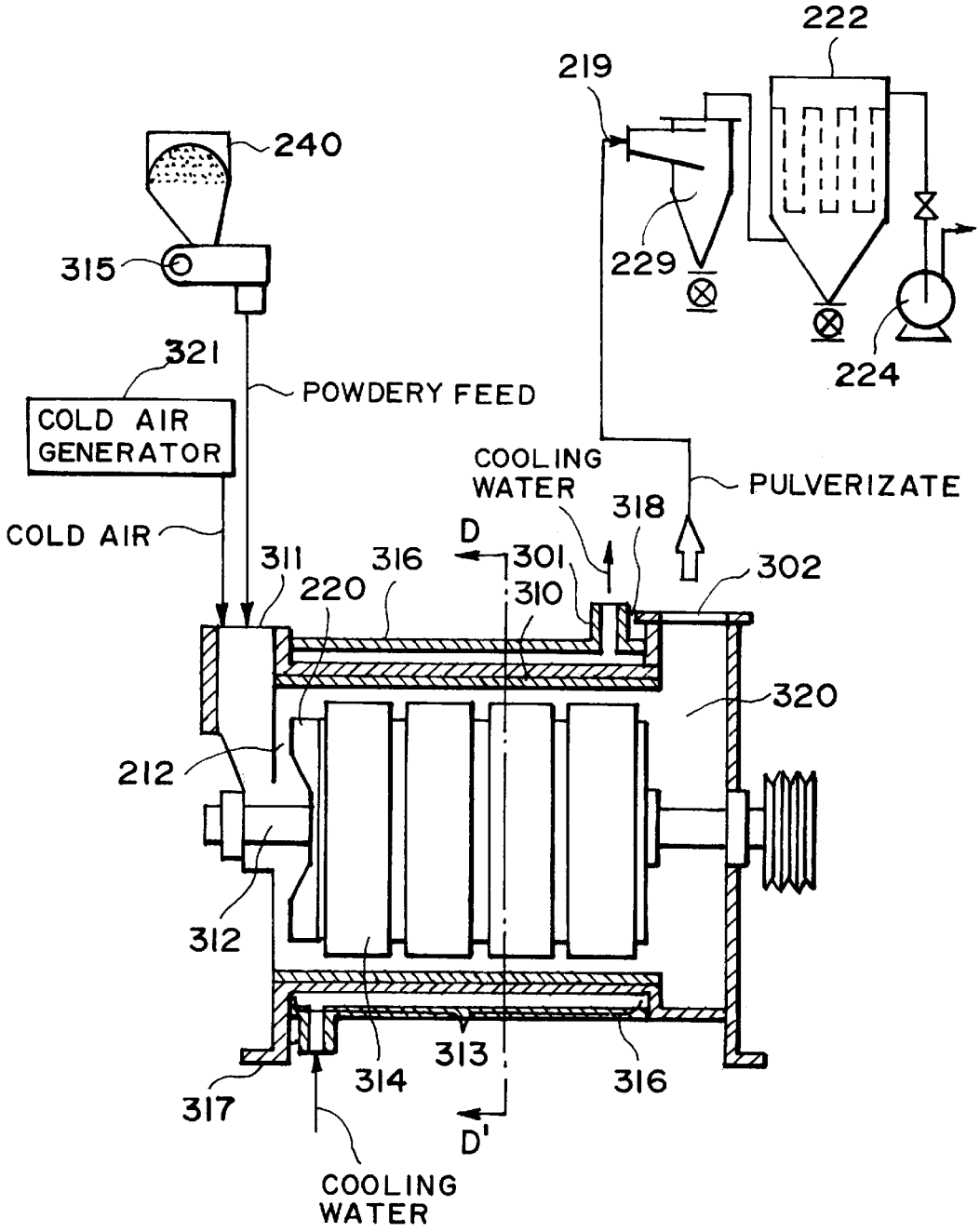
FIG. 3 is a schematic sectional view of a mechanical pulverizer used in a toner pulverization step.
Figure 4:
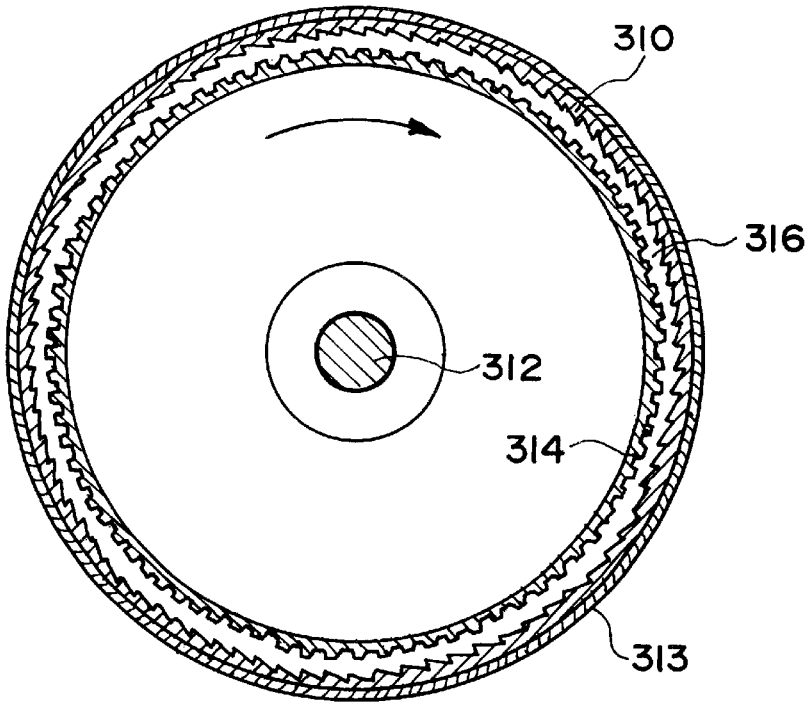
FIG. 4 is a schematic sectional view of a D–D' section in FIG. 3.
Figure 5:
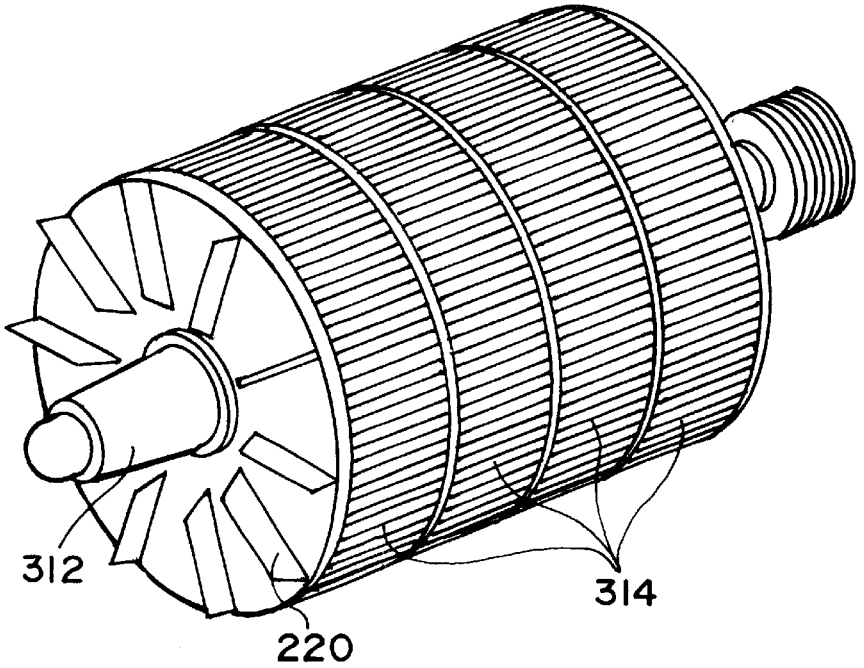
FIG. 5 is a perspective view of a rotor contained in the pulverizer of FIG. 3.

It is particularly preferred to adopt a process using a mechanical pulverizer as illustrated in FIGS. 3–5, and using specific toner ingredients, as a process capable of producing a toner including controlled shape of toner particles and controlled number of isolated iron-containing particles. This is also preferred so as to allow easy pulverization of the powdery feed and realize effective toner production.

Figure 9:
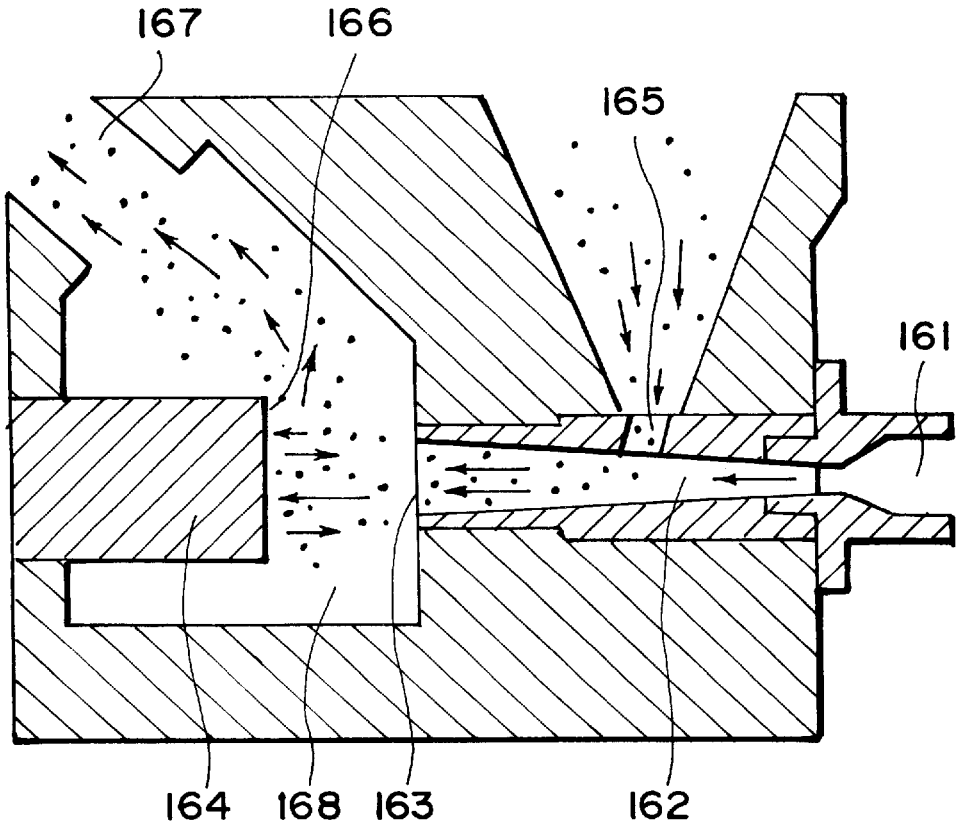
FIG. 9 is a schematic sectional view of a conventional impingement-type pneumatic pulverizer.
Figure 10:
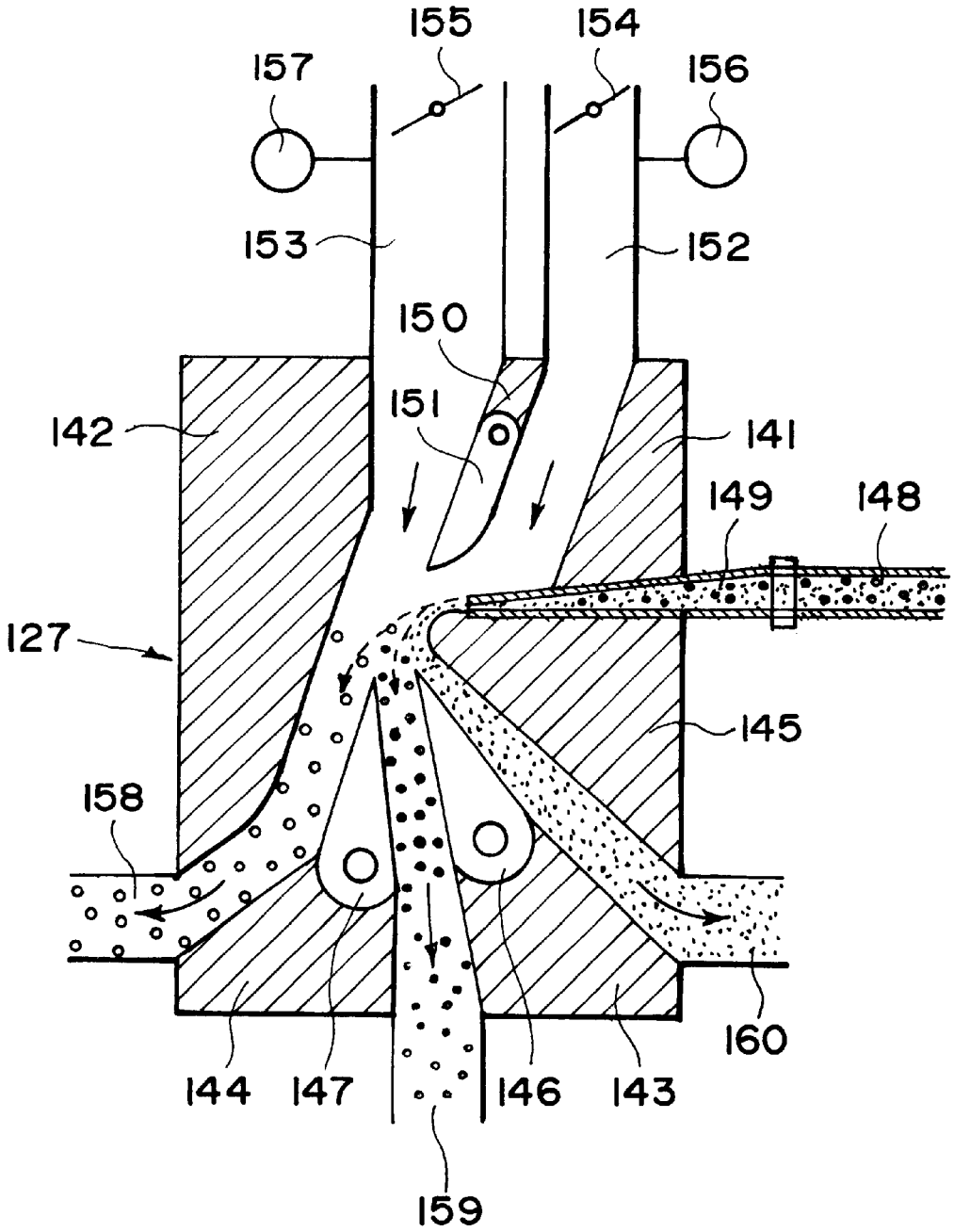
FIG. 10 is a schematic sectional view of a multi-division pneumatic classifier conventionally used as a second classification means.

In contrast thereto, according to a conventional impingement-type pneumatic pulverizer (as described with reference to FIG. 9) wherein toner particles are caused to impinge onto an impingement surface of an impingement member to pulverize the toner particles under the action of the impact force at the time of the impingement, magnetic iron oxide particles are liable to be isolated at the time of the impingement. Further, the resultant toner particles are made indefinitely and angularly shaped, so that the magnetic iron oxide particles are liable to fall off the toner particles. Such toner particles produced through the impingement-type pneumatic pulverizer ca be subjected to modification of particle shape and surface property for reducing the liberatability of magnetic iron oxide particles from the toner particles by application of mechanical impact (as by using a hybridizer), but the difficulties arising from the magnetic iron oxide particles liberated from the toner particles at the time of the impingement cannot be recovered thereby, so that the control of the toner shape and the number of isolated magnetic iron oxide particles is more difficult compared with the toner production process using a mechanical pulverizer.

Now, the organization of a mechanical pulverizer will be described with reference to FIGS. 3–5. FIG. 3 schematically illustrates a sectional view of a mechanical pulverizer; FIG. 4 is a schematic sectional view of a D—D section in FIG. 3, and FIG. 5 is a perspective view of a rotor 314 in FIG. 3. As shown in FIG. 3, the pulverizer includes a casing 313; a jacket 316; a distributor 220; a rotor 314 comprising a rotating member affixed to a control rotation shaft 312 and disposed within the casing 313, the rotor 314 being provided with a large number of surface grooves (as shown in FIG. 5) and designed to rotate at a high speed; a stator 310 disposed with prescribed spacing from the circumference of the rotor 314 so as to surround the rotor 314 and provided with a large number of surface grooves; a feed port 311 for introducing the powdery feed; and a discharge port 302 for discharging the pulverized material.

In operation, a powdery feed is introduced at a prescribed rate from the feed port 311 into a processing chamber, where the powdery feed is pulverized in a moment under the action of an impact caused between the rotor 314 rotating at a high speed and the stator 310, respectively provided with a large number of surface grooves, a large number of ultra-high speed eddy flow occurring thereafter and a high-frequency pressure vibration caused thereby. The pulverized product is discharged out of the discharge port 302. Air conveying the powdery feed flows through the processing chamber, the discharge port 302, a pipe 219, a collecting cyclone 209, a bag filter 222 and a suction blower 224 to be discharged out of the system.

The conveying air is cold air generated by a cold air generation means 312 and introduced together with the powdery feed, and the pulverizer main body is covered with a jacket 316 for flowing cooling water (preferably, non-freezing liquid comprising ethylene glycol, etc.), so as to maintain the temperature within the processing chamber at 0° C. or below, more preferably −5 to −15° C., further preferably −7 to −12° C., in view of the toner productivity. This is effective for suppressing the surface deterioration of toner particles due to pulverization heat, particularly the liberation of magnetic iron oxide particles present at the toner particle surfaces and melt-sticking of toner particles onto the apparatus wall, thereby allowing effective pulverization of the powdery feed. The operation at a processing chamber temperature below −15° C. requires the use of flon (having a better stability at lower temperatures but regarded as less advisable from global viewpoint) instead of flon substitute as a refringerant for the cold air generation means.

The cooling water is introduced into the jacket 316 via a supply port 317 and discharged out of a discharge port 318.

In the pulverization operation, it is preferred to set the temperature T1 in a whirlpool chamber 212 (inlet temperature) and the temperature T2 in a rear chamber (outlet temperature) so as to provide a temperature difference ΔT=T2−T1) of 30–80° C., more preferably 35–75° C., further preferably 37–72° C., thereby suppressing the surface deterioration of toner particle surfaces, particularly isolation of the magnetic iron oxide particles from the toner particle surfaces, and effectively pulverizing the powdery feed. A temperature difference ΔT of below 30° C. suggests a possibility of short pass of the powdery feed without effective pulverization thereof, thus being undesirable in view of the toner performances. On the other hand, ΔT>80° C. suggests a possibility of the overpulverization, resulting in the liberation of magnetic iron oxide particles from and surface deterioration due to heat of the toner particles and melt-sticking of toner particles onto the apparatus wall and thus adversely affecting the toner productivity.

It is preferred that the inlet temperature (T1) in the mechanical pulverizer is set to at most 0° C. and a value which is lower than the glass transition temperature (Tg) of the binder resin by 60–75° C. As a result, it is possible to suppress the surface deterioration of toner particles due to heat, particularly the liberation of magnetic iron oxide particles at the toner particle surfaces, and allow effective pulverization of the powdery feed. Further, the outlet temperature (T2) may preferably be set to a value which is lower by 5–30° C., more preferably 10–20° C., than Tg. As a result, it becomes possible to suppress the surface deterioration of toner particles due to heat, particularly the liberation of magnetic iron oxide particles at the toner particle surfaces, and allow effective pulverization of the powdery feed.

The rotor 314 may preferably be rotated so as to provide a circumferential speed of 80–180 m/s, more preferably 90–170 m/s, further preferably 100–160 m/s. As a result, it becomes possible to suppress insufficient pulverization or overpulverization, suppress the isolation of magnetic iron oxide particles due to the overpulverization and allow effective pulverization of the powdery feed. A circumferential speed below 80 m/s of the rotor 314 is liable to cause a short pass without pulverization of the feed, thus resulting in inferior toner performances. A circumferential speed exceeding 180 m/s of the rotor invites an overload of the apparatus and is liable to cause overpulverization resulting in the isolation of magnetic iron oxide particles. Further, the overpulverization is also liable to result in surface deterioration of toner particles due to heat, particularly the liberation of magnetic iron oxide particles at the toner particle surfaces, and also melt-sticking of the toner particles onto the apparatus wall, thus adversely affecting the toner productivity.

Further, the rotor 314 and the stator 310 may preferably be disposed to provide a minimum gap therebetween of 0.5–10.0 mm, more preferably 1.0–5.0 mm, further preferably 1.0–3.0 mm. As a result, it becomes possible to suppress insufficient pulverization or overpulverization and the liberation of magnetic iron oxide particles due to the overpulverization, and allow effective pulverization of the powdery feed. A gap exceeding 10.0 mm between the rotor 314 and the stator 310 is liable to cause a short pass without pulverization of the powdery feed, thus adversely affecting the toner performance. A gap smaller than 0.5 mm invites an overload of the apparatus and is liable to cause overpulverization resulting in the isolation of magnetic iron oxide particles. Further, the overpulverization is also liable to result in surface deterioration of toner particles due to heat, particularly the liberation of magnetic iron oxide particles at the toner particle surfaces, and also melt-sticking of the toner particles onto the apparatus wall, thus adversely affecting the toner productivity.

Further, by appropriately controlling the surface roughness of the pulverization surfaces (i.e., mutually opposing outer and inner surfaces) of the rotor 314 and the stator 310, it becomes possible to control the occurrence of isolated magnetic iron oxide particles and provide magnetic toner particles showing good developing performance, transferability and chargeability. More specifically, the surface roughnesses of the pulverization surfaces of the rotor 314 and the stator 310 may preferably be set to provide a central line-average roughness Ra of at most 10.0 μm, more preferably 2.0–10.0, a maximum roughness Ry of at most 60.0 μm, more preferably 25.0–60.0 μm, and a ten point-arrange roughness Rz of at most 40.0 μm, more preferably 20.0 μm. If Ra>10.0 μm, Ry>60.0 μm or Rz>40.0 μm, overpulverization is liable to occur at the time of pulverization, and the overpulverization is liable to result in surface deterioration of toner particles due to heat, particularly the isolation of magnetic iron oxide particles at the toner particle surfaces, and also melt-sticking of toner particles onto the apparatus wall, thus adversely affecting the toner productivity.

The above-mentioned parameters regarding the surface roughness are based on values measured by using a laser focus displacement meter ("LT-8100", available from K.K. Keyence) and a surface shape measurement software ("Tres-Vallet Lite", available from Mitani Shoji K.K.). Several times of measurement are made by selecting measurement points at random to obtain average values. For the measurement, a basis length is set to 8 mm, a cut-off value is set to 0.8 mm, and a movement speed is set to 90 μm/sec.

The significance of the above-mentioned surface roughness parameters is supplemented hereinbelow. A central line roughness Ra is determined based on a roughness curve on which a basis length L (=8 mm) is sampled along a central line, and for the sampled length, a roughness curve is represented by Z=f(x) while taking an X-axis along the central line and a Z-axis on a vertical roughness to determine Ra according to the following formula:

$$Ra=(1/L)\cdot\int|f(x)|dx.$$

Further, the maximum roughness Ry is determined as a difference in height between the highest peak and the lowest valley taken along the basis length. Further, the ten point-average roughness Rz is determined as a sum of an absolute value of an average height of first to fifth height peaks and an absolute value of an average depth of first to fifth deepest valleys, respectively taken in the basis length portion.

The rotor and/or the stator may be surface-roughened according to known methods. The roughened surfaces may preferably be subjected to an anti-wearing treatment, which is preferably nitriding.

The nitriding is a surface-hardening treatment for improving the anti-wear resistance and anti-fatigue resistance of the treated material and may be effected to cause nitrogen to penetrate from the surface entirely or locally at an appropriately elevated temperature for an appropriate period, thereby forming a nitride layer.

Thus, the pulverization surfaces of the rotor and/or the stator may preferably be provided through a surface-roughening treatment as a pretreatment and then a nitriding treatment as a post-treatment, so as to effect the pulverization step stably over a long period for providing a toner with a good developing performance while suppressing the occurrence of isolated magnetic iron oxide particles.

Figure 8:
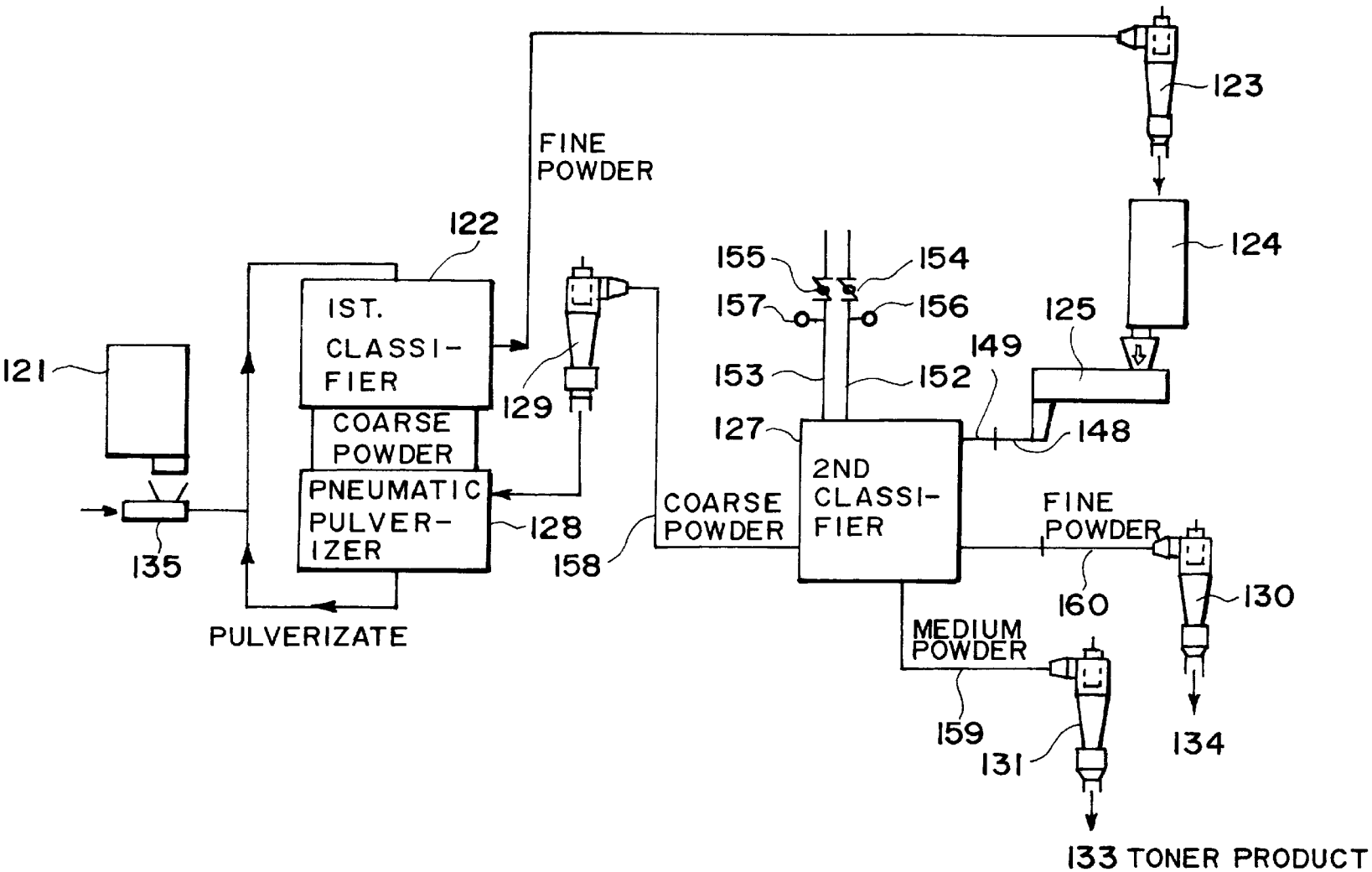
FIG. 8 is a diagram illustrating a conventional toner production system.

The effective pulverization achieved by the above-mentioned mechanical pulverizer allows the omission of a pre-classification step liable to result in overpulverization and omission of the large-volume pulverization air supply required in the pneumatic pulverizer as used in the system of FIG. 8.

Next, a pneumatic classifier as a preferred classification means for toner production.

FIG. 6 is a sectional view of an embodiment of a preferred multi-division pneumatic classifier.

Referring to FIG. 6, the classifier includes a side wall 22 and a G-block 23 defining a portion of the classifying chamber, and classifying edge blocks 24 and 25 equipped with knife edge-shaped classifying edges 17 and 18. The G-block 23 is disposed slidably laterally. The classifying edges 17 and 18 are disposed swingably about shafts 17*a* and 18*a* so as to change the positions of the classifying edge tips. The classifying edge blocks 17 and 18 are slidable laterally so as to change horizontal positions relatively together with the classifying edges 17 and 18. The classifying edges 17 and 18 divide a classification zone of the classifying chamber 32 into 3 sections.

A feed port 40 for introducing a powdery feed is positioned at the nearest (most upstream) position of a feed supply nozzle 16, which is also equipped with a high-pressure air nozzle 41 and a powdery feed-introduction nozzle 42 and opens into the classifying chamber 32. The nozzle 16 is disposed on a right side of the side wall 22, and a Coanda block 26 is disposed so as to form a long elliptical arc with respect to an extension of a lower tangential line of the feed supply nozzle 16. A left block 27 with respect to the classifying chamber 32 is equipped with a gas-intake edge 19 projecting rightwards in the classifying chamber 32. Further, gas-intake pipes 14 and 15 are disposed on the left side of the classifying chamber 32 so as to open into the classifying chamber 32. Further, the gas-intake pipes 14 and 15 are equipped with first and second gas introduction control means 20 and 21, like dampers, and static pressure gauges 28 and 29 (as shown in FIG. 2).

The positions of the classifying edges 17 and 18, the G-block 23 and the gas-intake edge 18 are adjusted depending on the pulverized powdery feed to the classifier and desired particle size of the product toner.

On the right side of the classifying chamber 32, there are disposed exhaust ports 11, 12 and 13 communicative with the classifying chamber corresponding to respective classified fraction zones. The exhaust ports 11, 12 and 13 are connected with communication means such as pipes (11*a*, 12*a* and 13*a* as shown in FIG. 2) which can be provided with shutter means, such as valves, as desired.

The feed supply nozzle 16 may comprise an upper straight tube section and a lower tapered tube section. The inner diameter of the straight tube section and the inner diameter of the narrowest part of the tapered tube section may e set to a ratio of 20:1 to 1:1, preferably 10:1 to 2:1, so as to provide a desirable introduction speed.

The classification by using the above-organized multi-division classifier may be performed in the following manner. The pressure within the classifying chamber 32 is reduced by evacuation through at least one of the exhaust ports 11, 12 and 13. The powdery feed is introduced through the feed supply nozzle 16 at a flow speed of preferably 10–350 m/sec under the action of a flowing air caused by the reduced pressure and an ejector effect caused by compressed air ejected through the high-pressure air supply nozzle and ejected to be dispersed in the classifying chamber 32.

The particles of the powdery feed introduced into the classifying chamber 32 are caused to flow along curved lines under the action of the Coanda effect exerted by the Coanda block 26 and the action of introduced gas, such as air, so that coarse particles form an outer stream to provide a first fraction outside the classifying edge 18, medium particles form an intermediate stream to provide a second fraction between the classifying edges 18 and 17, and fine particles form an inner stream to provide a third fraction inside the classifying edge 17, whereby the classified coarse particles are discharged out of the exhaust port 11, the medium particles are discharge out of the exhaust port 12 and the fine particles are discharged out of the exhaust port 13, respectively.

In the above-mentioned powder classification, the classification (or separation) points are principally determined by the tip positions of the classifying edges 17 and 18 corresponding to the lowermost part of the Coanda block 26, while being affected by the suction flow rates of the classified air stream and the powder ejection speed through the feed supply nozzle 16.

According to the above-mentioned toner production system, it is possible to effectively produce a toner having a weight-average particle size of 5–12 μm, particularly 5–10 μm, and a narrow particle size distribution by controlling the pulverization and classification conditions.

Various machines are commercially available for production of the toner according to the present invention. Several examples thereof are enumerated below together with the makers thereof. For example, the commercially available blenders may include:

Henschel mixer (mfd. by Mitsui Kozan K.K.), Super Mixer (Kawata K.K.), Conical Ribbon Mixer (Ohkawara Seisakusho K.K.); Nautamixer, Turbulizer and Cyclomix (Hosokawa Micron K.K.); Spiral Pin Mixer (Taiheiyo Kiko K.K.), Lodige Mixer (Matsubo Co. Ltd.). The kneaders may include: Buss Cokneader (Buss Co.), TEM Extruder (Toshiba Kikai K.K.), TEX Twin-Screw Kneader (Nippon Seiko K.K.), PCM Kneader (Ikegai Tekko K.K.); Three Roll Mills, Mixing Roll Mill and Kneader (Inoue Seisakusho K.K.), Kneadex (Mitsui Kozan K.K.); MS-Pressure Kneader and Kneadersuder (Moriyama Seisakusho K.K.), and Bambury Mixer (Kobe Seisakusho K.K.). As the pulverizers, Cowter Jet Mill, Micron Jet and Inomizer (Hosokawa Micron K.K.); IDS Mill and PJM Jet Pulverizer (Nippon Pneumatic Kogyo K.K.); Cross Jet Mill (Kurimoto Tekko K.K.), Ulmax (Nisso Engineering K.K.), SK Jet O. Mill (Seishin Kigyo K.K.), Krypron (Kawasaki Jukogyo K.K.), and Turbo Mill (Turbo Kogyo K.K.). As the classifiers, Classiell, Micron Classifier, and Spedic Classifier (Seishin Kigyo K.K.), Turbo Classifier (Nisshin Engineering K.K.); Micron Separator and Turboplex (ATP); Micron Separator and Turboplex (ATP); TSP Separator (Hosokawa Micron K.K.); Elbow Jet (Nittetsu Kogyo K.K.), Dispersion Separator (Nippon Pneumatic Kogyo K.K.), YM Microcut (Yasukwa Shoji K.K.). As the sieving apparatus, Ultrasonic (Koei Sangyo K.K.), Rezona Sieve and Gyrosifter (Tokuju Kosaku K.K.), Ultrasonic System (Dolton K.K.), Sonicreen (Shinto Kogyo K.K.), Turboscreener (Turbo Kogyo K.K.), Microshifter (Makino Sangyo K.K.), and circular vibrating sieves.

As for the pulverization and classification step, however, it is preferred to use the apparatus system described with reference to FIGS. 1 to 6.

Figure 11:
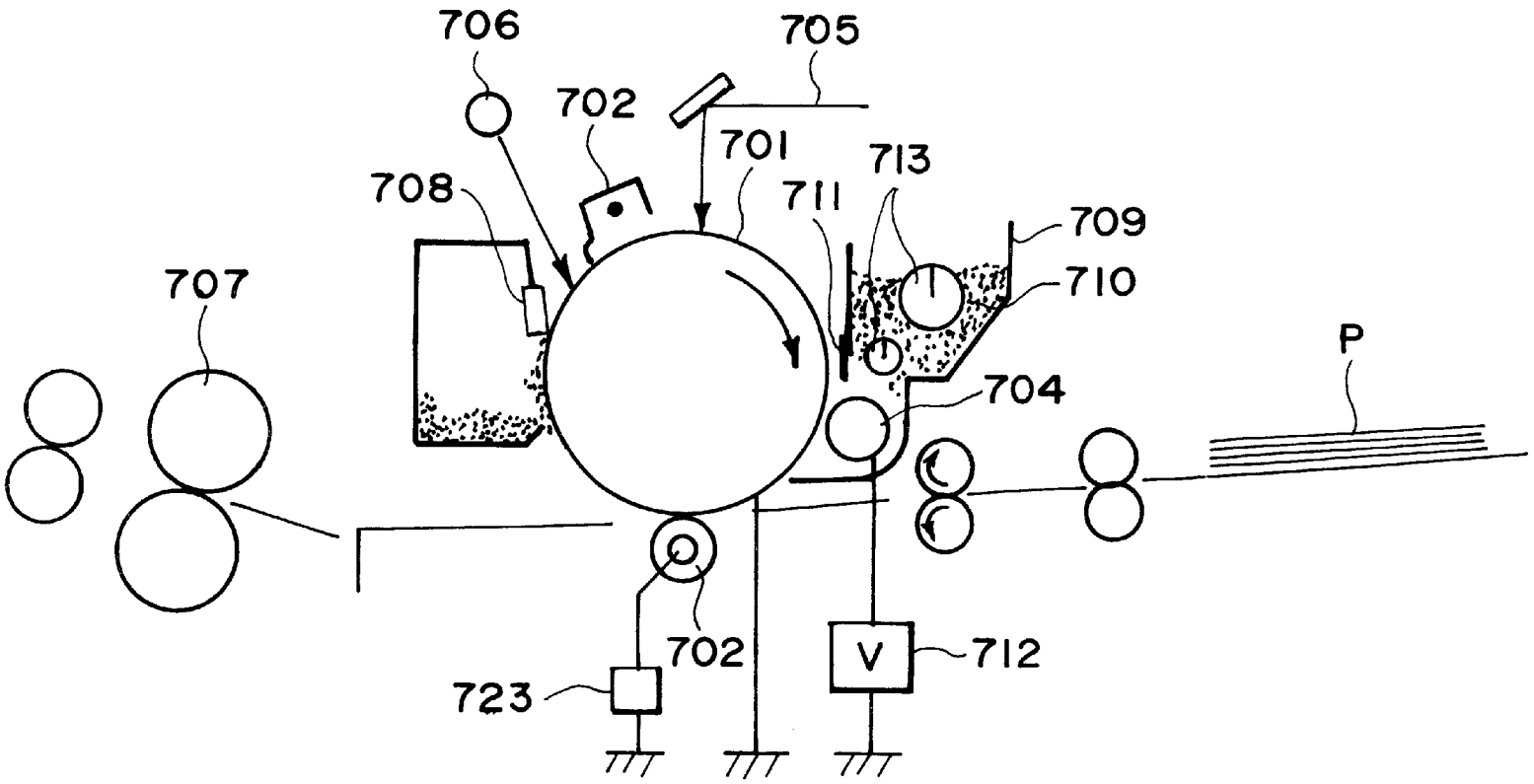
FIGS. 11–13 are respectively a schematic illustration of an example of image forming apparatus suitable for image formation by using a magnetic toner according to the invention.

Now, an embodiment of the image forming method according to the present invention will be described with reference to FIG. 11.

The surface of a photosensitive drum 701 is negatively charged by a primary charger 702 and then exposed to image scanning by laser exposure beam 705 to form a digital latent image on the photosensitive drum 70. Then, the latent image is reversely developed with a dry magnetic toner (monocomponent magnetic developer) 710 carried on a magnetic sleeve 704 equipped with a magnetic blade 711 and enclosing a magnet 714 therein of a developing device 709. In the developing zone, the electroconductive substrate of the photosensitive drum 701 is grounded, and the developing sleeve 704 is supplied with an alternating, pulse and/or DC bias voltage from bias voltage application means 712. The developed toner is then moved to a transfer zone along with the rotation of the photosensitive drum 701, and a transfer paper P is conveyed to the transfer zone where the toner image is transferred onto the transfer paper under application of a transfer voltage from a voltage supply 723 via a contact roller transfer means 702 onto the backside (opposite side with respect to the photosensitive drum) of the transfer paper. The transfer paper P carrying the transfered toner image and separated from the photosensitive drum 701 is subjected to fixation by a heat-pressure roller fixing device 707 to fix the tone image onto the transfer paper P. The toner image on the photosensitive drum can be once transferred onto an intermediate transfer member and then onto the transfer paper, instead of direct transfer from the photosensitive drum to the transfer paper as illustrated in FIG. 11.

The dry magnetic toner remaining on the photosensitive drum 701 after the transfer step is removed by a cleaning means 708 comprising a cleaning blade. Such a cleaning step can be omitted in the case when the residual magnetic toner is small in amount. The photosensitive drum after the cleaning step is charge-removed by erase exposure light 706. Then, a subsequent image forming cycle starting from the charging step by the primary charger 702 is restarted.

The photosensitive drum (i.e., electrostatic image-bearing member) 701 comprises a photosensitive layer and an electroconductive substrate and is rotated in an indicated arrow direction. The developing sleeve (i.e., toner-carrying member) 704 is rotated so as to move in the same direction as the surface of the photosensitive drum 701 in the developing zone. Inside the developing sleeve, a multi-polar permanent magnet (magnet roll) as a magnetic field generating means is disposed so as not to rotate. The insulating dry-magnetic toner 710 in the developing device 709 is applied on the developing sleeve 704 (which is a non-magnetic cylindrical body) and is provided with, e.g., a negative triboelectric charge through friction with the developing sleeve 704 surface. An iron-made magnetic doctor blade 711 is disposed in proximity to the developing sleeve 704 surface (with a gap of 50–500 μm) so as to be opposite to a magnetic pole of the multi-polar permanent magnet in the developing sleeve 704, thereby forming a thin (30–300 μm) and a uniform magnetic toner layer on the developing sleeve. The magnetic toner layer thickness is smaller than the gap between the developing sleeve 704 and the photosensitive drum 721 in the developing zone. The rotation speed of the developing sleeve 704 is controlled so as to provide a surface speed which is substantially identical to or close to that of the photosensitive drum. Instead of the magnetic iron doctor blade 711, a permanent magnet doctor blade can be used to provide a counter magnetic pole. In the developing zone, it is also possible to apply an alternating or pulse bias voltage at a frequency f of 200–4000 Hz and a Vpp of 500–3000 volts.

In the developing zone, the magnetic toner is moved from the developing sleeve onto an electrostatic image on the photosensitive drum under the action of an electrostatic force acting on the photosensitive drum surface and a bias electric field acting between the developing sleeve and the photosensitive drum.

Instead of the magnetic doctor blade 711, it is also possible to use an elastic blade comprising an elastic material, such as silicone rubber, for application of a magnetic toner by an elastic pressing force to form a magnetic toner layer in a controlled thickness.

Figure 12:
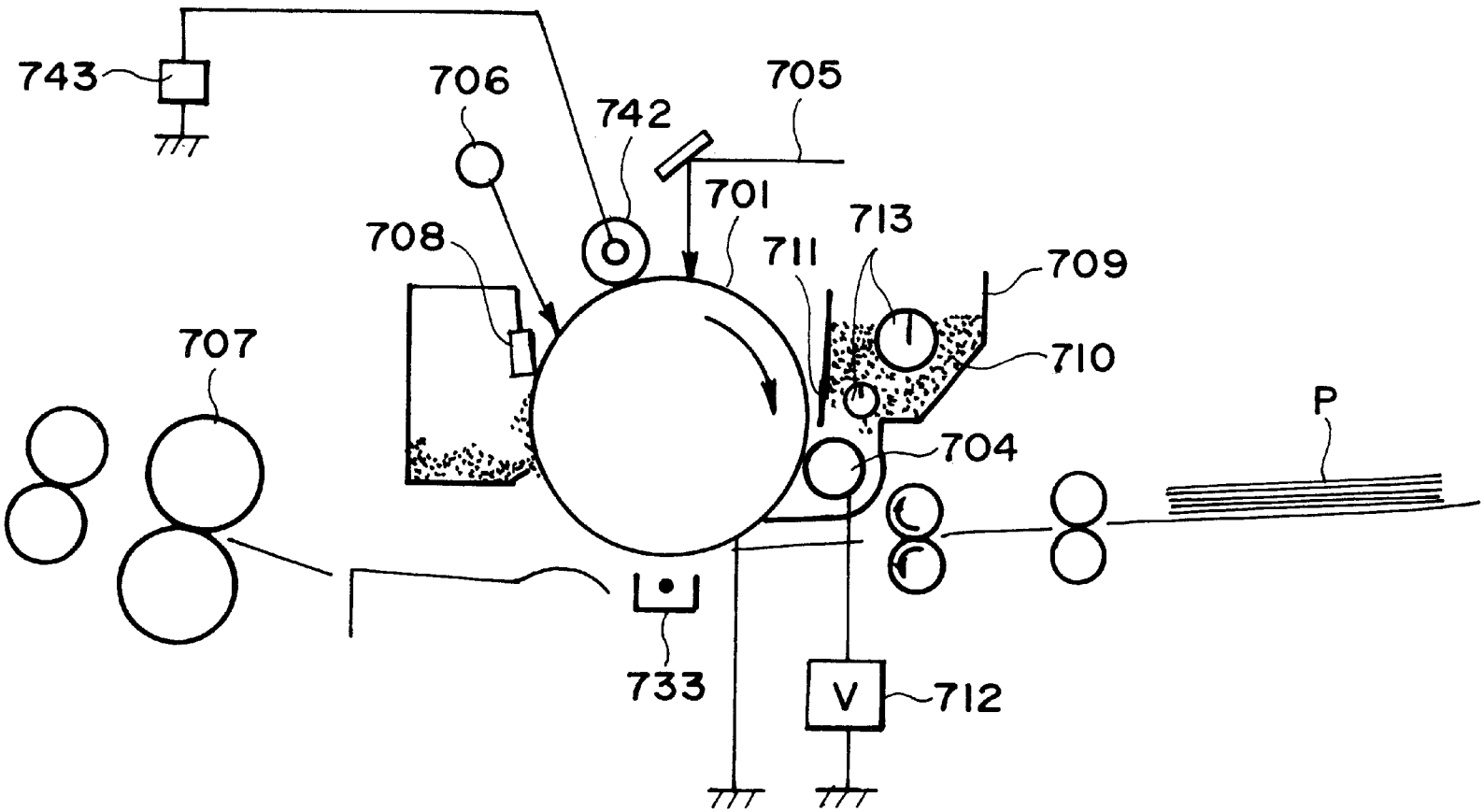

FIG. 12 illustrates an image forming system including a contact charging means 742 as a primary charger receiving a voltage supply from a bias voltage source 743 and a corona charger transfer means 733.

Figure 13:
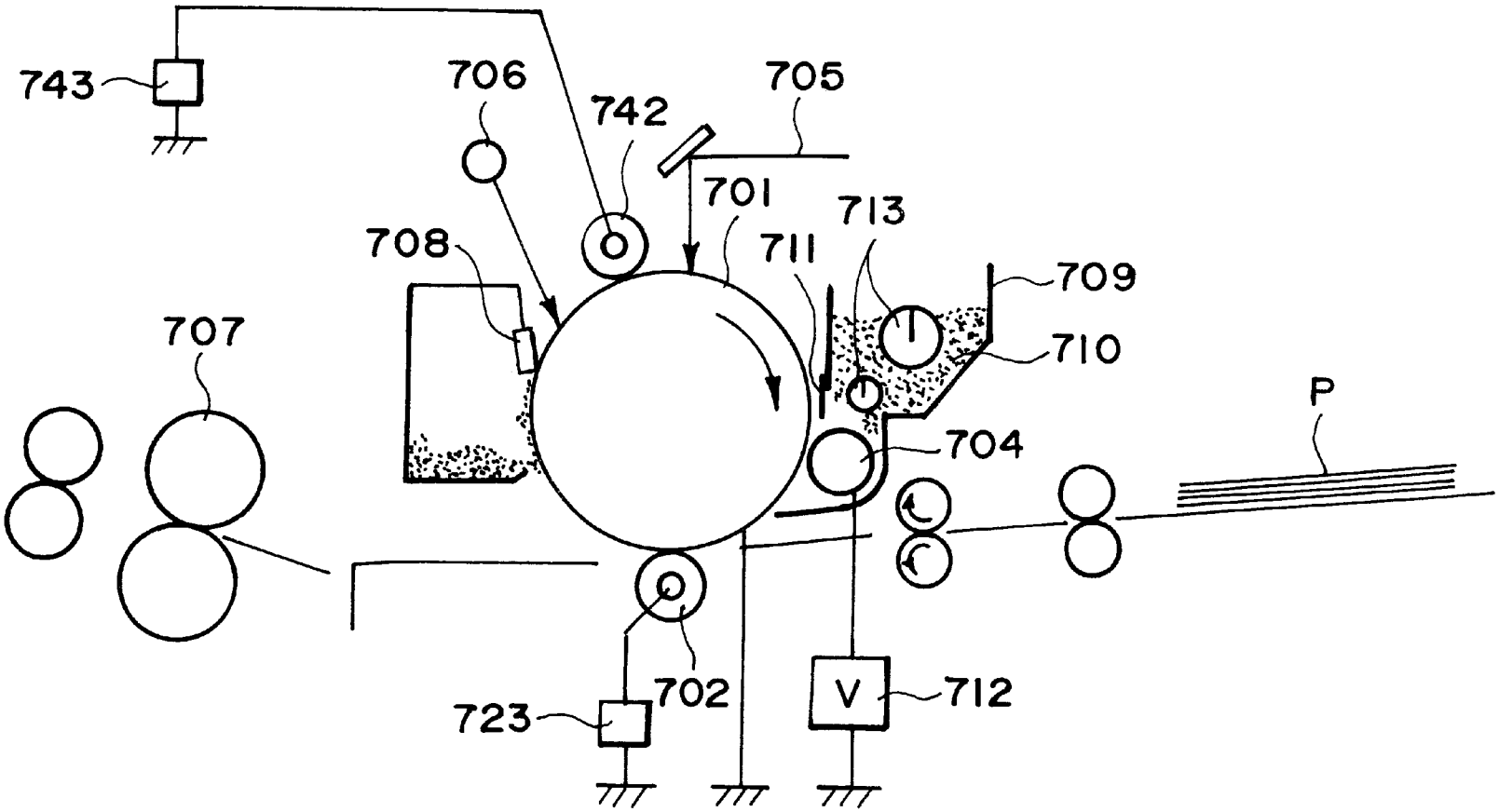

FIG. 13 illustrates an image forming system including a contact charging means 742 and a contact transfer means 702.

Figure 14:
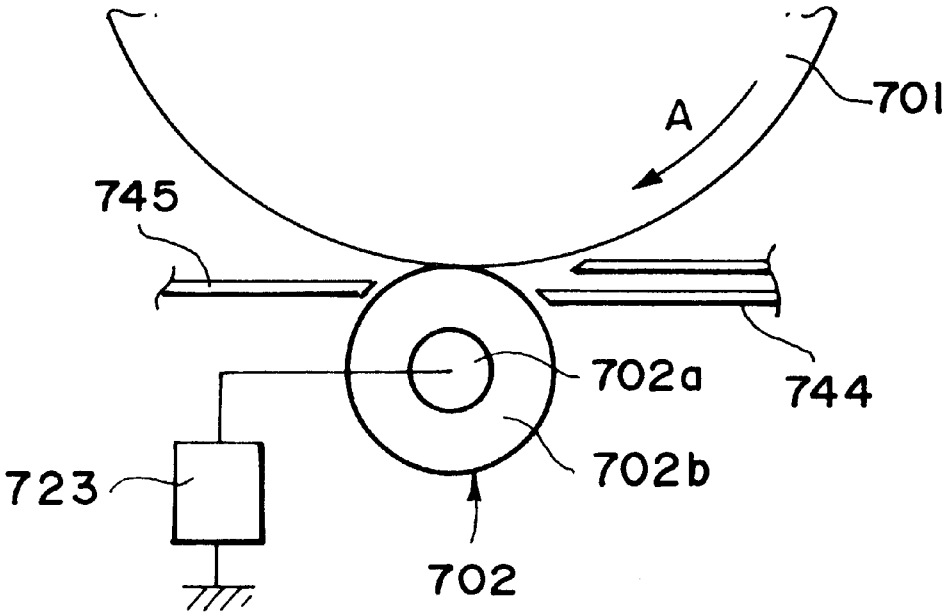
FIG. 14 is a schematic illustration of a transfer device.

FIG. 14 illustrates an organization and an operation of a transfer roller 702. The transfer roller 702 basically comprises a core metal 702*a* and a conductive elastic layer 702*b* coating the circumference thereof. The transfer roller 702 presses a transfer paper against the photosensitive drum 701 and is rotated at a circumferential speed identical to or differing from that of the photosensitive drum 701. A transfer paper is conveyed between the photosensitive drum 701 and the transfer roller 702 via a guide 744 while being supplied with a bias voltage of a polarity opposite to that of the toner from at transfer bias voltage source 723 via the transfer roller 702 to receive a toner image on its surface facing the photosensitive drum, and then conveyed to a guide 745.

The conductive elastic layer 702*b* may comprise an elastic material, such as polyurethane or ethylene-propylene-diene terpolymer (EPDM) with an electroconductive material, such as carbon dispersed therein to have a volume resistivity of $10^6$–$10^{10}$ ohm·cm.

Preferred transfer process conditions may include a roller abutting pressure of $0.16\times10^{-2}$–$24.5\times10^{-2}$ MPa, and a DC voltage of ±0.2 to ±10 kV.

Figure 15:
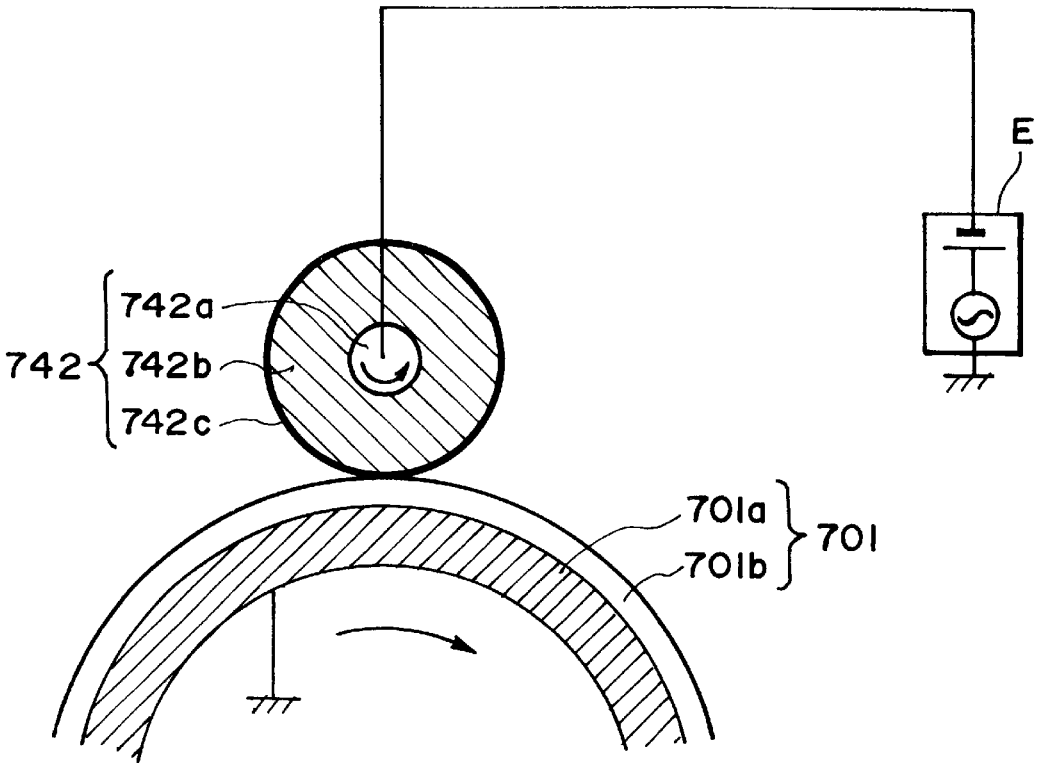
FIG. 15 is a schematic illustration of a charging roller.

FIG. 15 illustrates a contact charging system. Referring to FIG. 15, a photosensitive drum (electrostatic image bearing member) 701 basically comprises an electroconductive substrate 701*a* of aluminum, etc., and a photoconductor layer 701*b* circumferentially coating the substrate 701*a*, and is designed to rotate in a clockwise arrow direction at a prescribed circumferential speed (process speed).

A charging roller 742 basically comprises a core metal 742*a*, a conductive elastic layer 742*b* and a surface layer 742*c*. The charging roller 742 is pressed against the photosensitive drum 701 so as to be rotated following the rotation of the photosensitive drum 701. The charging roller 742 is supplied with a bias voltage from a bias voltage source E, thereby charging the surface of the photosensitive drum 701 to prescribed polarity and potential. The thus-charged photosensitive drum is then exposed imagewise to form an electrostatic image thereon, which is then developed by developing means to provide a toner image as described with reference to FIG. 11.

Preferred charging roller conditions may include a roller abutting pressure of $0.49\times10^{-2}$ to $98\times10^{-2}$ MPa, and an AC/DC superposed voltage of $V_{AC}$=0.5–5 kVpp (f=50–5 kHz)/$V_{DC}$=±0.2 to ±1.5 kV, or a DC bias voltage of $V_{DC}$=±0.2 to ±5 kV.

The charging roller (or charging blade when used instead thereof) may comprise conductive rubber which may be surface-coated with a release film comprising nylon, PVDF (polyvinylidene fluoride) or PVDC (polyvinylidene chloride).

Figure 16:
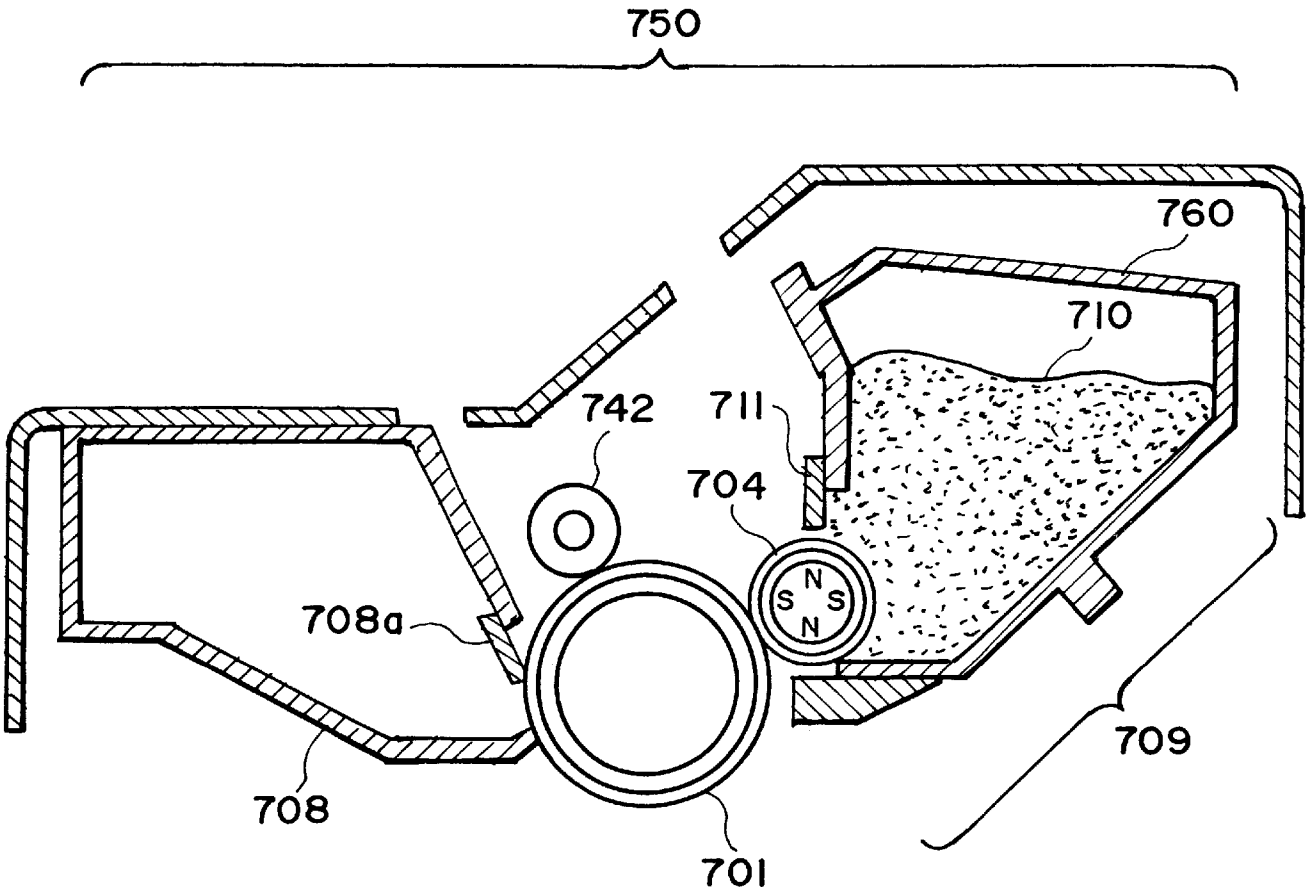
FIG. 16 illustrates an embodiment of the process cartridge of the invention.

FIG. 16 illustrates an embodiment of the process cartridge according to the present invention. The process cartridge may comprise at least a developing means and an electrostatic image-bearing member integrally supported to form a cartridge, which is detachably mountable to a main assembly of an image forming apparatus (such as a copying machine or a printer).

FIG. 16 shows a process cartridge 750 integrally including a developing means 709, a photosensitive drum 701, a cleaner 708 having a cleaning blade 708*a*, and a primary charger (charging roller) 704.

In the embodiment shown in FIG. 16, the developing means 709 includes a magnetic blade 711 and a magnetic toner 710 in a toner vessel 760. In order to suitably perform a developing operation under the action of a prescribed electric field between the photosensitive drum 701 and the developing sleeve 704 with the magnetic toner 710, a gap between the photosensitive drum 701 and the developing sleeve 704 is a very important factor.

Figure 17:
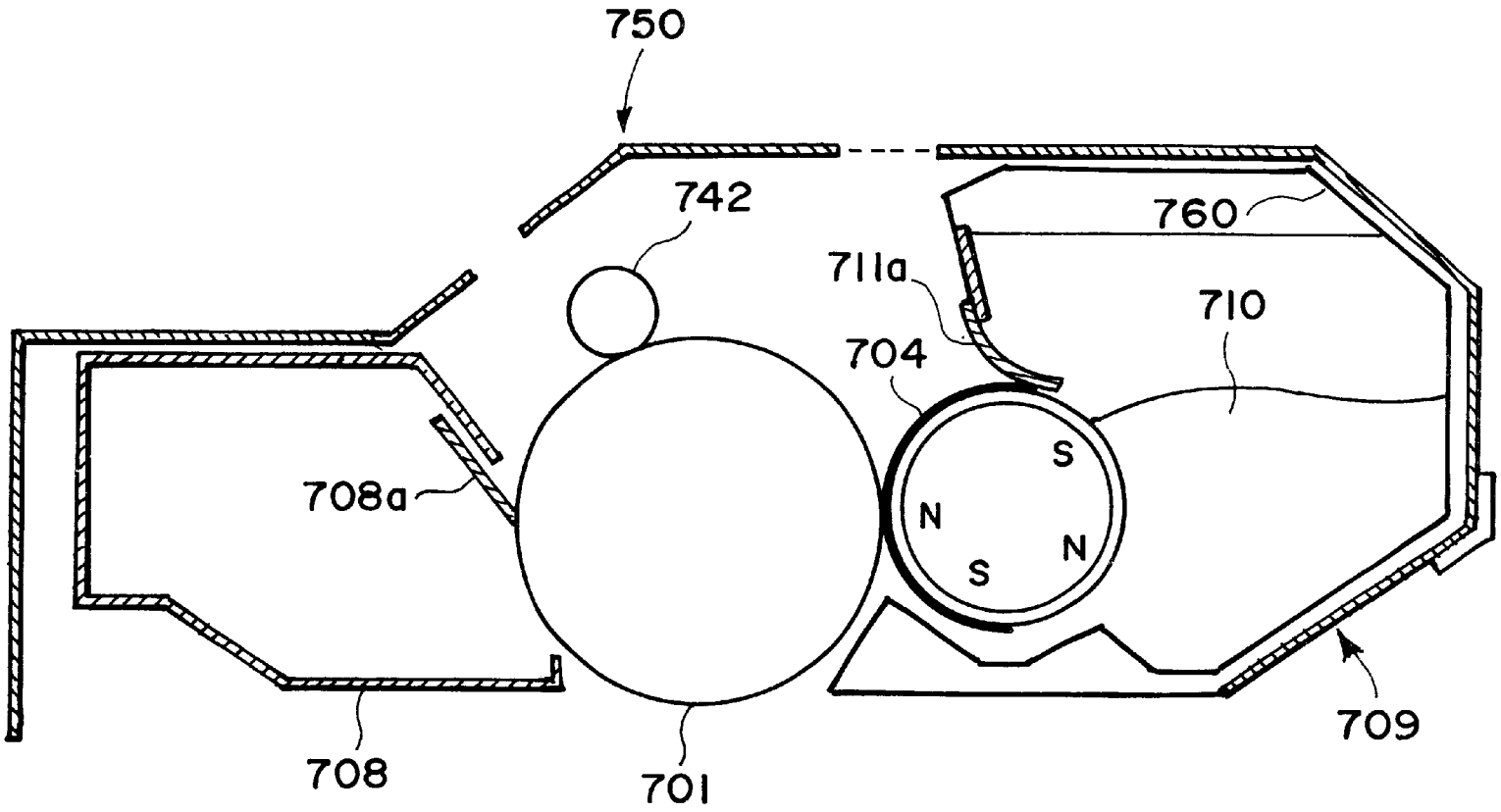
FIG. 17 illustrates an embodiment of the process cartridge of the invention using an elastic blade.

FIG. 17 shows another embodiment of the process cartridge 750 including an elastic blade 711*a* as a toner application means.

Figure 18:
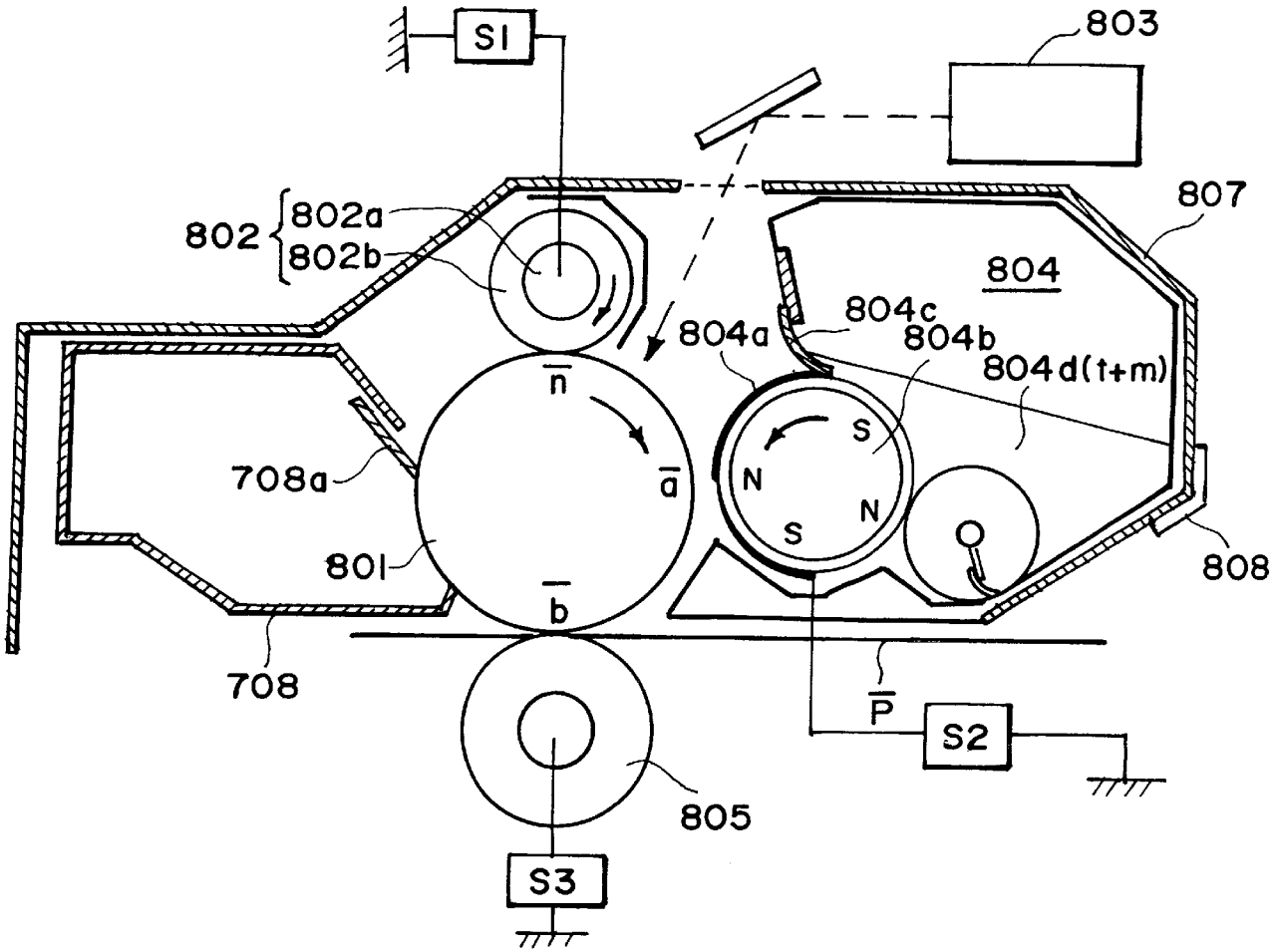
FIG. 18 illustrates an embodiment of the process cartridge according to the invention including an injection charging system.

FIG. 18 shows another embodiment of the process cartridge including an injection charging system wherein a rotating drum-type OPC photosensitive member 801 is rotated in an indicated arrow (clockwise) direction and is charged by a charging roller as a contact charging means 802. The charging roller 802 is pressed against the photosensitive member 801 so as to form a charging nip n therebetween and is rotated in an opposite surface moving direction with respect to the photosensitive member 801. On the charging roller 802 surface, electroconductive powder m (as described below) is applied so as to form a substantially uniform mono-particle layer.

A metal core 802 of the charging member is designed to receive a DC voltage of −700 volts from a charging bias voltage supply source S1 (to be disposed on the main assembly side). In this embodiment, the photosensitive member 801 surface is uniformly charged to a potential (−680 volts) which is substantials equal to the voltage supplied to the charging roller 802, by the direct injection charging scheme.

The photosensitive member 801 is also designed to be exposed to a laser beam emitted from a laser beam scanner 803 (to be disposed on the main assembly side) which includes a laser diode, a polygonal mirror, etc. The laser beam scanner 803 outputs laser beam (wavelength=740 nm) of which intensity has been modified corresponding to time-serial electrical digital image signals based on objective image data, and the uniformly charged surface of the photosensitive member 801 is scanningly exposed to the laser beam, whereby an electrostatic latent image corresponding to the objective image data is formed on the photosensitive member 801.

The cartridge includes a developing device 804, by which the electrostatic latent image on the photosensitive member 801 is developed into a toner image. The developing device 804 is a reversal development device including magnetic toner 804*d* comprising magnetic toner particles (t) and electroconductive fine powder (m), and also a 16 mm-dia. non-magnetic developing sleeve 804 a enclosing a magnet roll 804*b*. The developing sleeve 804*a* is disposed opposite to the photosensitive member 801 with a gap of 320 μm therefrom in the developing zone and is designed to rotate at a circumferential speed which is 120% of the photosensitive member 801 in the identical surface moving direction.

The magnetic toner 804*d* is applied in a thin layer on the developing sleeve 804*a* by the elastic blade 804*c* while being simultaneously charged thereby.

The magnetic toner 804*d* applied on the developing sleeve 804*a* is conveyed to the developing zone a along with the rotation of the developing sleeve 804*a*.

The developing sleeve 804*a* is also supplied with a developing bias voltage which is a super-position of a DC voltage of −420 volts and a rectangular AC voltage of f=1500 Hz and Vpp=1600 volts (electric field intensity=5×$10^6$ volts/m) from a developing bias voltage source S2 to effect mono-component jumping development between the developing sleeve 804*a* and the photosensitive member 801. The electroconductive fine powder (m) can also be applied on the charging roller 802.

The presence of the electroconductive fie powder (m) allows an intimate contact and a low contact resistance between the charging roller 802 and the photosensitive member 801, thereby allowing a direct injection charging of the photosensitive member 801 by the charging roller 802.

More specifically, the charging roller 802 intimately contacts the photosensitive member 801 via the electroconductive fine powder (m) and the electroconductive fine powder (m) rubs the photosensitive member 801, so that the photosensitive member 801 can be charged by the charging roller 802 according to a charging mechanism predominantly governed by stable and safe direct charging mechanism without substantially relying on a discharge phenomenon, thus realizing a high charging efficiency not realized by conventional roller charging. Accordingly, the photosensitive member 801 can be charged to a potential which is substantially identical to a voltage applied to the charging roller 802. A toner image on the photosensitive member 801 is transferred onto a transfer paper p by means of a transfer roller 805 supplied with a transfer bias voltage from a transfer bias voltage source S3 at a transfer position b. At the time of transfer, the transfer roller 85 presses the transfer paper P at a linear pressure of 1–80 g/cm.

Hereinbelow, the present invention will be described based on Examples, which however should not be construed to restrict the scope of the present invention. "Part(s)" used hereinafter for describing a relative amount of a material means "part(s) by weight".

Regarding toner ingredients used in Examples and Comparative Examples described hereinafter, source resins (and characteristic properties) are shown in Table 1, some waxes are shown in Table 2, and some magnetic iron oxide particles are shown in Table 3, respectively appearing hereinafter. Regarding the resins, vinyl resins (styrene-based resins) were prepared according to solution polymerization or suspension polymerization, and polyester resins were prepared by dehydrocondensation. Hereinbelow, some production examples for providing magnetic iron oxide particles shown in Table 3 are described.

PRODUCTION EXAMPLE 1 FOR MAGNETIC IRON OXIDE PARTICLES

Into a ferrous sulfate aqueous solution, an aqueous solution of sodium hydroxide in an amount of 0.95 equivalent to $Fe^{2+}$ in the ferrous sulfate solution was added and mixed therewith to form a ferrous salt aqueous solution containing $Fe(OH)_2$. Then, sodium silicate containing 1.0 wt. % of silicon (Si) based on the iron in the ferrous salt solution was added thereto. Then, air was blown into the ferrous salt solution containing $Fe(OH)_2$ and silicon at 90° C. to cause oxidation at pH 6 to 7.5, thereby forming a suspension liquid containing silicon (Si)-containing magnetic iron oxide particles. Into the suspension liquid, an aqueous solution of hydroxide in an amount of 1.05 equivalent to $Fe^{2+}$ remaining in the slurry and containing sodium silicate including 0.1 wt. % of silicon (Si) based on the iron was added, and oxidation was continued under heating at 90° C. and at pH 8–11.5 to obtain Si-containing magnetic iron oxide particles, which were then washed, recovered by filtration and dried in an ordinary manner.

The resultant magnetic iron oxide particles contained agglomerated primary particles and therefore were disintegrated by application of compression and shearing forces by means of a treating machine ("MIX-MULLER", available from Shinto Kogyo K.K.) into primary particles having smooth surfaces, thereby obtaining Magnetic iron oxide particles (1) having properties shown in Table 3. Magnetic iron oxide particles (1) exhibited an average particle size (D1) of 0.21 $\mu$m and the surface thereof was found to comprise iron oxide and silicon oxide.

PRODUCTION EXAMPLE 2

Magnetic iron oxide particles (2) were prepared in the same manner as in Production Example 1 except for changing the amount of silicon (Si). The surface of Magnetic iron oxide particles (2) was found to comprise iron oxide and silicon oxide.

PRODUCTION EXAMPLES 3 AND 4

Into slurries containing magnetic iron oxide particles prepared in Production Example 2 and before the filtration for recovery, two prescribed amounts of aluminum sulfate were added respectively, and the pH was adjusted to a range of 6–8 to cause surface deposition of aluminum hydroxide onto the magnetic iron oxide particles. Two lots of magnetic iron oxide particles thus produced were respectively subjected disintegration by the MIX-MALLER in the same manner as in Production Example 1 to obtain Magnetic iron oxide particles (3) and (4), which were both found to have surfaces comprising iron oxide, silicon oxide and aluminum oxide.

PRODUCTION EXAMPLES 5 AND 6

Into two batches of ferrous salt aqueous solution containing $Fe(OH)_2$ in Production Example 1, two different amounts of silicon (Si) in the form of sodium silicate were respectively added at a time (i.e., without leaving an amount to be added later) and first step oxidation reactions were performed by blowing air into the liquids similarly as in Production Example 1 except for changing pH conditions by adding amounts of sodium hydroxide exceeding one equivalent to $Fe^{2+}$, followed by post treatments similarly as in Production Example 1 to obtain Magnetic iron oxide particles (5) and (6), respectively, which were both found to have surfaces comprising iron oxide and silicon oxide.

PRODUCTION EXAMPLE 7

Into a ferrous sulfate aqueous solution, sodium silicate containing 1.8 wt. % of Si based on Fe in the solution was added, and then an aqueous solution of sodium hydroxide in an amount of 1.0–1.1 equivalent to $Fe^{2+}$ in the solution was added thereto to form a ferrous salt solution containing $Fe(OH)_2$. Then, while maintaining the pH of the aqueous solution at 9, air was blown into the solution at 85° C. to cause oxidation to form a suspension liquid containing Si-containing magnetic iron oxide particles. Into the suspension liquid, an aqueous solution of ferrous sulfate in an amount of 1.1 equivalent to the amount of alkali already added (i.e., the total sodium content in the sodium silicate and the sodium silicate) was added, and while maintaining the pH of the liquid at 8, air was blown into the liquid to cause oxidation until a final period at which the system was adjusted at a weakly alkaline pH to obtain magnetic iron oxide particles.

The magnetic iron oxide particles were then washed, recovered by filtration and dried in an ordinary method, followed further by an ordinary disintegration treatment to obtain Magnetic iron oxide particles (7), which were found to have a surface comprising iron oxide and silicon oxide.

Together with the binder resins, waxes and magnetic iron oxide particles shown in Tables 1–3 below, the following charge control agents A, B and C were used for toner production.

Charge control agent A

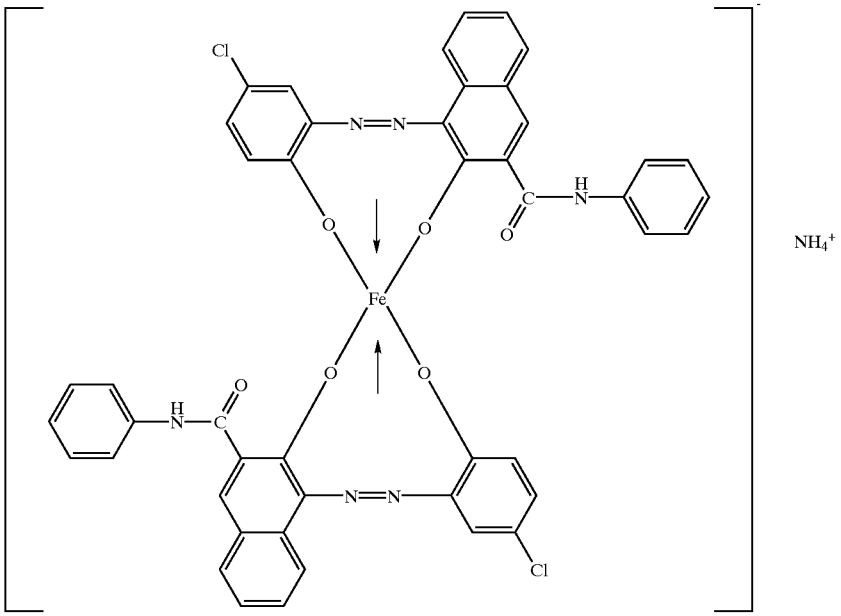

Charge control agent B

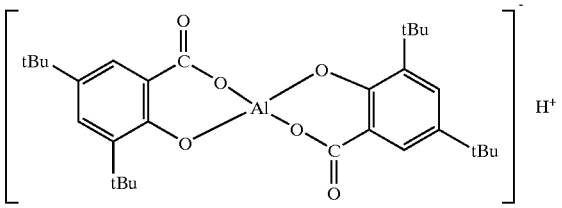

Charge control agent C

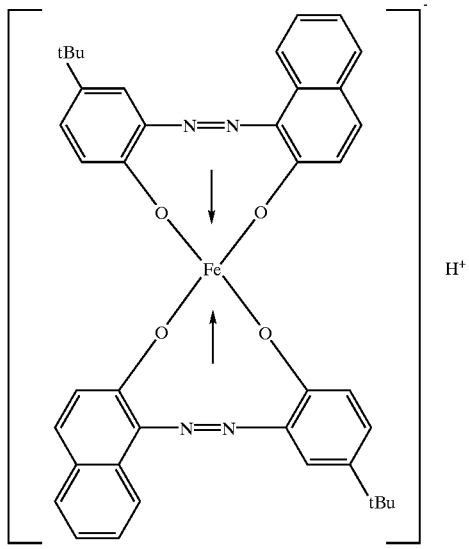

TABLE 1

| Binder resins | | | | | | |
|---|---|---|---|---|---|---|
| | Monomers | | | | | |
| Binder resin | Species *1 | Ratio parts (or mol) | Mw ($\times 10^4$) | Mn ($\times 10^4$) | Mw/Mn (–) | Acid value (mgKOH/g) |
| A | st | 78.0 | 30.1 | 1.1 | 27.4 | 2.2 |
| | nBA | 20.0 | | | | |
| | MnBM | 1.5 | | | | |
| | DVB | 0.5 | | | | |
| B | st | 74.5 | 31.9 | 0.75 | 42.5 | 20 |
| | nBA | 20.0 | | | | |
| | MnBM | 5 | | | | |
| | DVB | 0.5 | | | | |
| C | TPA | 28 (mol) | | | | |
| | TMA | 6 (mol) | 8.5 | 0.64 | 13.3 | 9.2 |
| | DDSA | 16 (mol) | | | | |
| | POBPA | 50 (mol) | | | | |
| D | st | 79.5 | 25.5 | 0.87 | 29.0 | 0.1 |
| | nBA | 20.0 | | | | |
| | DVB | 0.5 | | | | |

*1:
st = styrene, nBA = n-butyl acrylate
MnBM = mono-n-butyl maleate, DVB = divinylbenzene
TPA = terephthalic acid, TMA = trimellitic anhydride
DDSA = dodecenylsuccinicc acid, POBPA = propoxy-bisphenol A

TABLE 2

| Waxes | | |
|---|---|---|
| Wax | species | $T_{abs\cdot max}$ (° C.) |
| (a) | polypropylene | 140 |
| (b) | polyethylene | 127 |
| (c) | paraffin | 75 |
| (d) | Fischer-Tropschc | 101 |
| (e) | higher alcohol | 100 |

The melt-kneaded product was coarsely crushed to below 1 mm by a cutter mill.

The thus-formed coarsely crushed material (as a powdery feed) were supplied to a mechanical pulverizer 301 (as shown in FIGS. 2 and 3) for pulverization, and the pulverized material was classified by a multi-division classifier 1 (FIGS. 2 and 6) to obtain magnetic toner particles having a weight-average particle size (D4) of 6.5 $\mu$m.

The mechanical pulverizer 301 used in this Example included a rotor 314 and a stator 310, of which the pulverization surfaces had been subjected to nitriding as an anti-wearing treatment. The treated surfaces exhibited a central line-average roughness (Ra) of 1.1 $\mu$m, a maximum roughness (Ry) of 20.6 $\mu$m and a ten point-average roughness (Rz) of 12.3 $\mu$m. For the pulverization, the rotor 314 was rotated at a circumferential speed of 117 m/s, and the stator 310 was disposed with a gap of 1.3 mm from the rotor 314. The inlet temperature T1 was −10° C., and the outlet temperature T2 was 42° C.

Figure 24A:
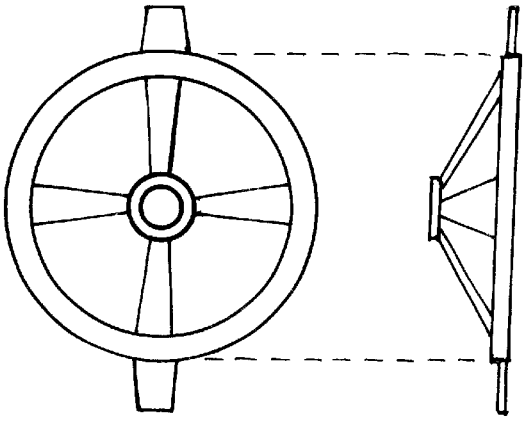
FIGS. 24A–24D each includes a pair of a front view and a side view for illustrating a stirring vane used for blending with an external additive used in Examples.
Figure 24B:
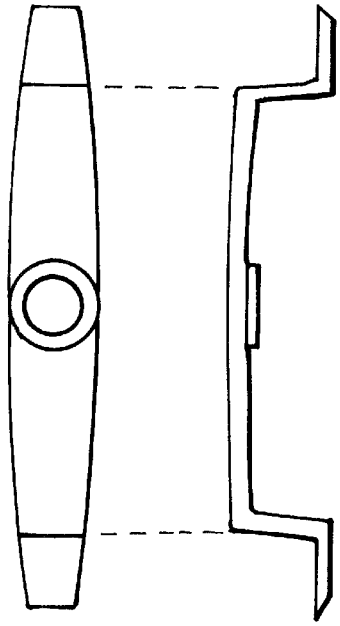
Figure 24C:
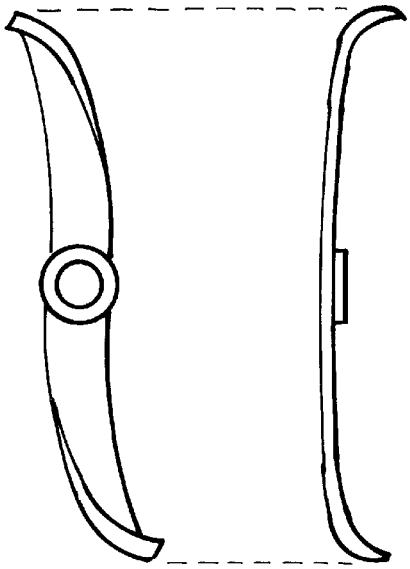
Figure 24D:
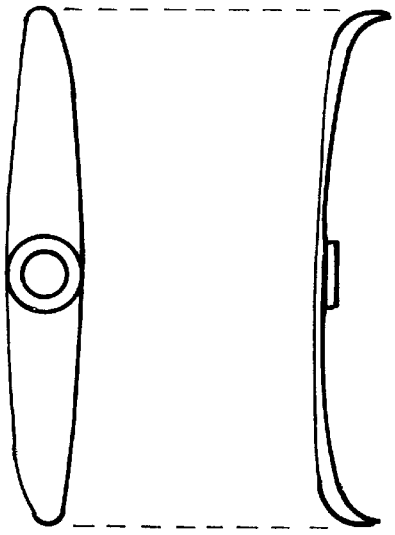

100 wt. parts of the above-obtained magnetic toner particles were externally blended with negatively chargeable hydrophobic silica ($S_{BET}$=120 $m^2$/g, a methanol wettability ($H_{MeOH}$) of 80%) obtained after hydrohobization with 15 wt. % of hexamethyldisilazane and 15 wt. % of dimethylsilicone, by means of a Henschel mixer ("FM10C/1", made by Mitsui Kozan K.K.) including a Y0 vane (shown in FIG. 24A) and an S0 vane (shown in FIG. 24C) under the conditions of a toner apparent volume packing rate of 12% and a rotation speed of 45 rps. for 1 min. and then 50 rps for 2 min., thereby obtaining Magnetic toner No. 1.

Figure 20:
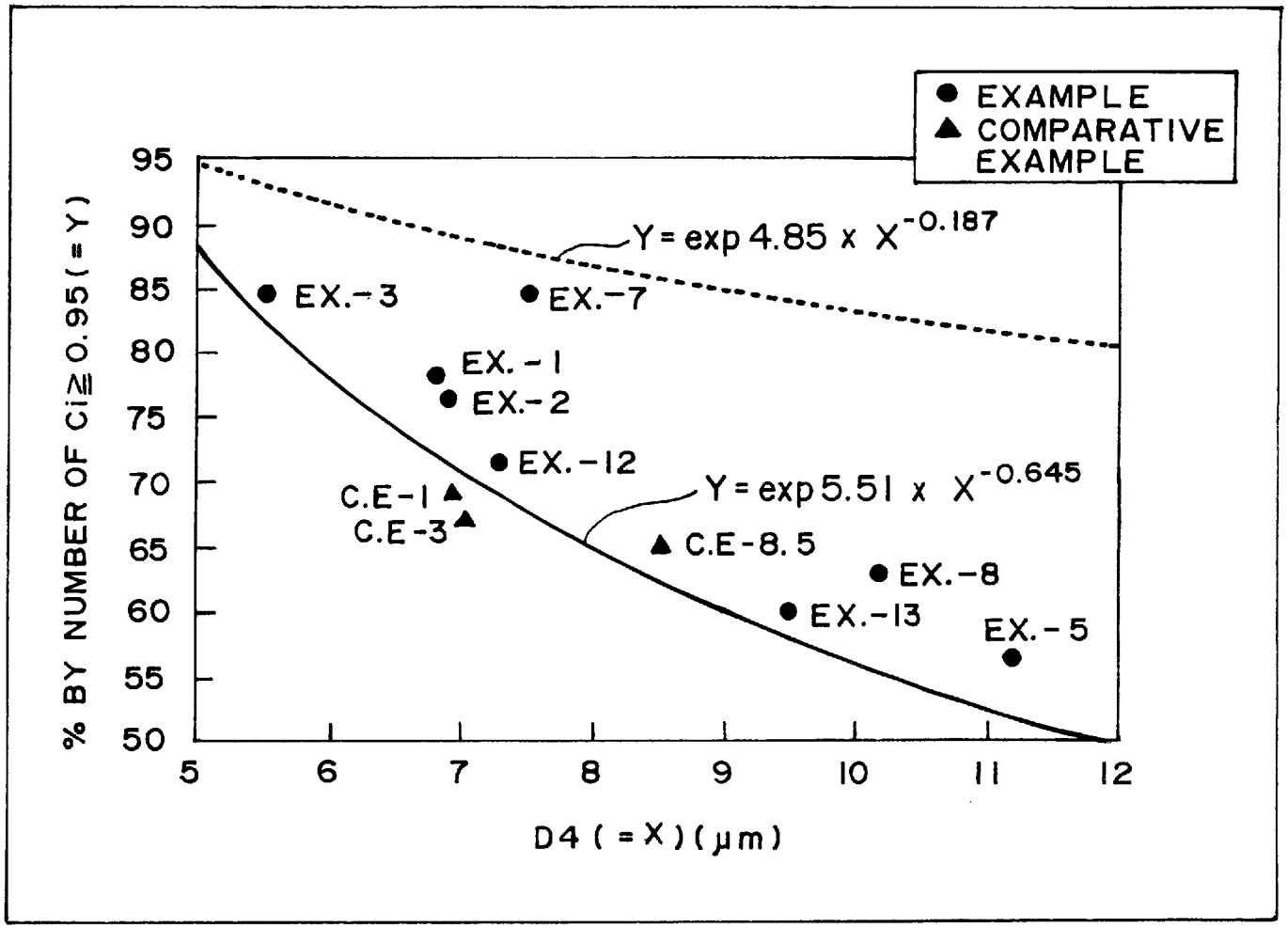
FIGS. 20, 21, 25 and 26 are respectively a graph sowing a relationship between circularity (Ci) and average particle size of toners.
Figure 21:
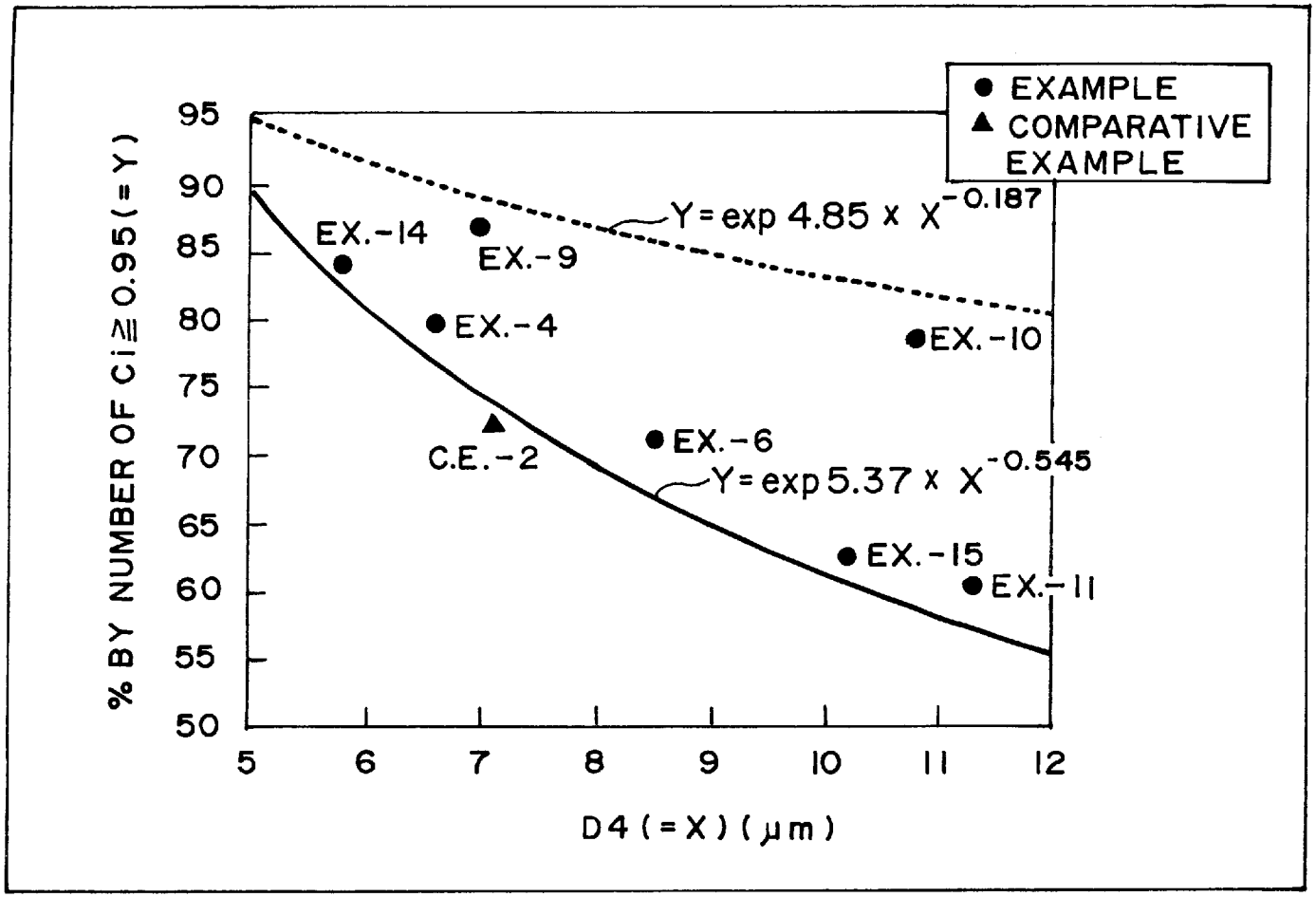

Toner prescriptions, pulverization conditions and some physical properties of Magnetic toner No. 1 are shown in Table 4, a relationship between % by number of particles of Ci (circularity)≧0.950 (=Y) and weight-particle size (D4=X) is shown in FIG. 20, and a relationship between a peak particle size (=x) and a half-value width ($W_{H1/2}$=y) is shown in FIG. 22, together with those of magnetic toners prepared in Examples and Comparative Examples appearing hereinafter.

TABLE 3

| Magnetic iron oxide particles | | | | | | | | | |
|---|---|---|---|---|---|---|---|---|---|
| Magnetic iron oxide particles | D1 ($\mu$m) | Si (%) | Surface Fe/Si (XPS) | Smoothness | $d_B$ (g/cm$^3$) | $S_{BET}$ ($m^2$/g) | Al (%) | Surface Fe/Al (XPS) | Hydro-phobicity (%) |
| (1) | 0.21 | 1.09 | 1.8 | 0.53 | 1.10 | 10.0 | — | — | 0 |
| (2) | 0.21 | 0.80 | 2.4 | 0.57 | 1.15 | 9.7 | — | — | 1 |
| (3) | 0.21 | 0.80 | 2.4 | 0.60 | 1.10 | 9.1 | 0.25 | 1.4 | 1 |
| (4) | 0.21 | 0.80 | 2.4 | 0.59 | 1.11 | 9.3 | 0.05 | 8.7 | 2 |
| (5) | 0.21 | 0.25 | 4.2 | 0.81 | 1.06 | 6.8 | — | — | 3 |
| (6) | 0.20 | 2.40 | 0.9 | 0.28 | 0.60 | 20.4 | — | — | 0 |
| (7) | 0.21 | 1.80 | 0.8 | 0.24 | 0.49 | 23.0 | — | — | 0 |

EXAMPLE 1

| | |
|---|---|
| Binder resin A | 100 parts |
| Magnetic iron oxide particles (3) | 90 parts |
| Wax (c) | 4 parts |
| Charge control agent A (azo iron complex) | 2 parts |

The above ingredients were pre-blended in a Henschel mixer and melt-kneaded by a twin-screw extruder at 130° C.

Magnetic toner No. 1 was charged in a commercially available laser beam printer having an organization as illustrated in FIG. 13 ("LBP-950", made by Canon K.K.) after remodeling for increasing the process speed to 235 mm/sec (1.5 times the original) and subjected to a continuous printing test on $1.5\times10^4$ sheets in each of normal temperature/normal humidity (23° C./65%RH) environment, high temperature/high humidity (30° C./80%RH) environment, and low temperature/low humidity (15° C./10%RH) environment. The image forming performances were evaluated with respect to the following items.

Image density (ID) was measured in terms of a reflection density with respect to a 5 mm-square solid image by means of a Macbeth densitometer (available from Macbeth Co.) with an SPI filter. Fog was determined by measuring a highest reflection density Ds of a white background portion of a printed image on a white transfer paper and also an average reflection density Dr of the white transfer paper before the printing to determine a difference Ds−Dr as a value of fog. A lower fog value represents a better fog suppression state.

The measurement of the above items was performed at the initial stage and after printing on 15000 sheets in the continuous printing test, and after standing outside the printer for 1 day after the continuous printing test, in each environment. The results are inclusively shown in Tables 6, 7 and 8 together with those of Examples are Comparative Examples described hereinafter.

Transfer efficiency (%) was measured at an initial stage and after printing on 10,000 sheets in an environment of 23° C./65%RH by using a commercially available laser beam printer ("LBP-950", made by Canon K.K.). For printing, plain paper of 75 g/m$^2$ was used as transfer paper. For the evaluation of transfer rate, a toner image on the OPC photosensitive member before the transfer and a transfer residual toner were respectively peeled off by polyester adhesive tapes and applied onto white paper to measure Macbeth densities Di and Dr. Separately, the polyester adhesive tape in a blank state was applied onto the white paper to measure a Macbeth density Do. The transfer efficiency was calculated according to the following formula:

$$\text{Transfer efficiency } (\%)=((Di-Dr)/(Di-D_0))\times 100$$

The results are shown in Table 9.

Toner consumption and line width were evaluated by using a laser beam printer ("LBP-1760", made by Canon K.K.) after remodeling for changing the process speed from 16 sheets/min. to 24 sheets/min. After image formation on 1000 sheets in an NT/NH (23° C./65%RH) environment, an image in an areal image percentage of 4% comprising lateral lines in latent image width of ca. 420 μm comprising 10 dots of 600 dpi was printed on 5000 sheets of A4-size paper, and a decreased magnetic toner amount in the developing device was measured to calculate a toner consumption rate (g/sheet). Then, a solid black image was printed to measure an image density (I.D.) at that time.

Further, lateral lines in latent image width of 420 μm comprising 10 dots of 600 dpi were formed with a 1 cm spacing and developed with the toner, and the resultant toner image was transferred onto an OHP film of polyethylene terephthalate and fixed thereon. The fixed lateral pattern image was subjected to a roughness measurement by using a surface roughness meter ("SURFCODER SE-30H", made by K.K. Kosaka Kenkyusho) to measure a toner line width based on a detected roughness profile. It has been empirically confirmed that a toner line image showing a line width slightly exceeding a latent image width provides an image of highest clarity, and a narrower line width results in a lower thin-line reproducibility. A magnetic toner showing a high image density and providing an appropriate line width at a low toner consumption is generally preferred, whereas a magnetic toner giving a lower image density at a low toner consumption or a magnetic toner giving a smaller line width at a low toner consumption is not preferred.

Image qualities were evaluated in terms of Dot reproducibility and Tailing. More specifically, Dot reproducibility (Dot) was evaluated by forming an isolated one-dot image by the above printer and observing the dot image through an optical microscope for evaluation according to the following standard.

A: A magnetic toner image completely reproduces one dot without protrusion out of the latent dot image at all.

B: Some protrusion of the toner image out of the latent image is observed at some parts.

C: Some degree of protrusion of the toner image out of the latent image is observed.

D: Much protrusion of the toner image out of the latent image is observed.

Tailing was evaluated by printing a pattern of 50 lateral lines each having a length of ca. 20 cm and a width of 4 dots with a spacing of 175 dots between lines on a A4-size paper by using the above printer and counting the number of lines accompanied with at least one tailing (projection) recognizable with eyes for evaluation according to the following standard.

A: No tailing at all.

B: Tailing on 2 lines or less.

C: Tailing on 3–6 lines.

D: Tailing on 7–14 lines.

E: Tailing on 15 lines or more.

The results of the above evaluation are shown in Tables 6–10 together with those of the following Examples and Comparative Examples.

EXAMPLE 2

Magnetic toner No. 2 was prepared in the same manner as in Example 1 except for using the toner prescription (including the composition for providing toner particles and the external additive) as shown in Table 4 and changing the rotor peripheral speed in the mechanical pulverizer to 125 m/s. At this time, the inlet temperature T1 was −10° C. and the outlet temperature T2 was 37° C.

EXAMPLE 3

Magnetic toner No. 3 was prepared in the same manner as in Example 1 except for using the toner prescription shown in Table 4 and changing the rotor peripheral speed in the mechanical pulverizer to 150 m/s. The inlet temperature T1 was −10° C. and the outlet temperature T2 was 53° C.

EXAMPLE 4

Magnetic toner No. 4 was prepared in the same manner as in Example 1 except for using the toner prescription shown in Table 4 and changing the rotor peripheral speed in the mechanical pulverizer to 114 m/s. The inlet temperature T1 was −10° C. and the outlet temperature T2 was 45° C.

EXAMPLE 5

Magnetic toner No. 5 was prepared in the same manner as in Example 1 except for using the toner prescription shown in Table 4 and changing the rotor peripheral speed in the mechanical pulverizer to 115 m/s. The inlet temperature T1 was −10° C. and the outlet temperature T2 was 40° C.

EXAMPLE 6

Magnetic toner No. 6 was prepared in the same manner as in Example 1 except for using the toner prescription shown in Table 4 and changing the rotor peripheral speed in the mechanical pulverizer to 144 m/s. The inlet temperature T1 was −10° C. and the outlet temperature T2 was 55° C.

EXAMPLE 7

Magnetic toner No. 7 was prepared in the same manner as in Example 1 except for using the toner prescription shown in Table 4, changing the rotor peripheral speed in the mechanical pulverizer to 144 m/s (the inlet temperature T1 was −10° C. and the outlet temperature T2 was 55° C.), inserting a medium pulverization step before the pulverization step, and further using a Z0 vane (shown in FIG. 24B) and an S0 vane (shown in FIG. 24C) in the Henschel mixer for external additive blending. The medium pulverization step was performed by using a mechanical pulverizer as shown in FIG. 2 and under the same conditions as in the pulverization step except that the gap between the rotor 314 and the stator 310 was increased to 2.0 mm.

EXAMPLE 8

Magnetic toner No. 8 was prepared in the same manner as in Example 7 except for using the toner prescription shown in Table 4.

EXAMPLE 9

Magnetic toner No. 9 was prepared in the same manner as in Example 7 except for using the toner prescription shown in Table 4.

EXAMPLE 10

Magnetic toner No. 10 was prepared in the same manner as in Example 7 except for using the toner prescription shown in Table 4.

EXAMPLE 11

Magnetic toner No. 11 was prepared in the same manner as in Example 1 except for using the toner prescription shown in Table 4 and changing the rotor peripheral speed in the mechanical pulverizer to 90 m/s. The inlet temperature T1 was −10° C. and the outlet temperature T2 was 30° C.

EXAMPLE 12

Magnetic toner No. 12 was prepared in the same manner as in Example 1 except for using the toner prescription shown in Table 4 and changing the rotor peripheral speed in the mechanical pulverizer to 120 m/s. The inlet temperature T1 was −10° C. and the outlet temperature T2 was 50° C.

EXAMPLE 13

Magnetic toner No. 13 was prepared in the same manner as in Example 1 except for using the toner prescription shown in Table 4 and changing the rotor peripheral speed in the mechanical pulverizer to 150 m/s while changing the roughnesses of the rotor and the stator to Ra=1.7 μm, Ry=35.6 μm and Rz=21.3 μm. The inlet temperature T1 was −10° C. and the outlet temperature T2 was 46° C.

EXAMPLE 14

Magnetic toner No. 14 was prepared in the same manner as in Example 1 except for using the toner prescription shown in Table 4 and changing the rotor peripheral speed in the mechanical pulverizer to 135 m/s. The inlet temperature T1 was −10° C. and the outlet temperature T2 was 33° C.

EXAMPLE 15

Magnetic toner No. 15 was prepared in the same manner as in Example 1 except for using the toner prescription shown in Table 4 and changing the rotor peripheral speed in the mechanical pulverizer to 115 m/s. The inlet temperature T1 was −10° C. and the outlet temperature T2 was 48° C.

COMPARATIVE EXAMPLE 1

Comparative Magnetic toner No. (i) was prepared in the same manner as in Example 1 except for using the toner prescription shown in Table 4 and that the pulverization step was performed by using a rotor and a stator of which surfaces had been mirror-finished and nitrided for anti-wearing to provide roughnesses Ra=0.9 μm, Ry=9.0 μm and Rz=6.4 μm, while rotating the rotor at a peripheral speed of 150 m/s with a gap of 1.3 mm from the stator so that T1=−10° C. and T2=53° C.

COMPARATIVE EXAMPLE 2

Comparative Magnetic toner No. (ii) was prepared in the same manner as in Example 1 except for using the toner prescription shown in Table 4 and that the pulverization step was performed by using a rotor and a stator of which surfaces had been blasted and nitrided for anti-wearing to provide roughnesses Ra=3.2 μm, Ry=43.5 μm and Rz=35.4 μm, while rotating the rotor at a peripheral speed of 90 m/s with a gap of 1.0 mm from the stator so that T1=−10° C. and T2=31° C.

COMPARATIVE EXAMPLE 3

Comparative Magnetic toner No. (iii) was prepared in the same manner as in Example 1 except for using the toner prescription shown in Table 4 and that the pulverization step was performed by using an impingement-type pneumatic pulverizer.

COMPARATIVE EXAMPLE 4

Comparative Magnetic toner No. (i) was prepared in the same manner as in Example 1 except for using the toner prescription shown in Table 4 and that the pulverization step was performed by using an impingement type pneumatic pulverizer, and the classified toner particles were further subjected to modification of particle shape and surface properties by using a hybridizer.

EXAMPLES 16–20

Magnetic toner Nos. 1, 2, 12, 13 and 15 prepared in Examples 1, 2, 12, 13 and 15 were used.

Each magnetic toner was charged in a process cartridge of a commercially available laser beam printer ("LBP-250", made by Canon) after remodeling the process cartridge into a form as illustrated in FIG. 18. More specifically, electroconductive fine conductor comprising Al-containing zinc oxide fine powder having a resistivity of 100 ohm·cm was applied onto a charging roller 802 which was designed to be supplied with a DC voltage of −700 volts from a charging bias voltage source S1. As a result, the OPC photosensitive member 1 surface was uniformly surface-charged to a potential (−680 volts) which was substantially equal to the bias voltage supplied to the charging roller 2. A developing bias voltage comprising a superposition of a DC voltage of −420 volts and a rectangular AC voltage of f=1500 Hz and Vpp=1600 volts (electric field intensity=$5\times10^6$ V/m) was applied between the developing sleeve 804*a* and the OPC photosensitive member 801.

The remodeled printer ("LBP-250") loaded with the above cartridge and also remodeled so as to provide a process speed of 120 mm/sec was used for evaluation of each magnetic toner for evaluation of image qualities (inclusive of toner consumption, image density, line width, dot reproducibility and tailing). The results are shown in Table 11.

TABLE 4

Toner Prescription, Physical properties & Pulverization conditions

| Example | 1 | 2 | 3 | 4 | 5 | 6 | 7 | 8 | 9 |
|---|---|---|---|---|---|---|---|---|---|
| Toner No. | 1 | 2 | 3 | 4 | 5 | 6 | 7 | 8 | 9 |
| Composition | | | | | | | | | |
| Binder Resin | A | A | B | B | C | C | A | B | B |
| Charge controller | A | C | A | C | A | C | C | B | A |
| Wax | c | e | d | a/e | e | a/d | c | c | d |
| Magnetic | 3 | 1 | 4 | 2 | 1 | 4 | 2 | 3 | 5 |
| Ext. additive (wt. parts) | | | | | | | | | |
| hydrophobic silica | 1.2 | 1.2 | 1.2 | 1.2 | 1.2 | 1.2 | 1.0 | 1.2 | 1.2 |
| strontium titanate | 1.0 | 0.8 | 0.8 | 2.0 | 0.4 | 2.4 | 0.8 | 1.0 | 2.4 |
| Mixing conditions | | | | | | | | | |
| 1st: speed (rps)/time (min) | 45/1 M | 45/1 M | 45/1 M | 45/1 M | 45/1 M | 53.33/1 M | 53.33/1 M | 53.33/1 M | 53.33/1 M |
| 2nd: speed (rps)/time (min) | 50/2 M | 50/2 M | 50/2 M | 50/2 M | 50/2 M | 70/2 M | 70/2 M | 70/2 M | 70/2 M |
| Vane (vpper/lower) | YO/SO | YO/SO | YO/SO | YO/SO | YO/SO | ZO/SO | ZO/SO | ZO/SO | ZO/SO |
| Rotor/stator roughnesses | | | | | | | | | |
| Ra ($\mu$m) | 1.1 | 1.1 | 1.1 | 1.1 | 1.1 | 1.1 | 1.1 | 1.1 | 1.1 |
| Ry ($\mu$m) | 20.6 | 20.6 | 20.6 | 20.6 | 20.6 | 20.6 | 20.6 | 20.6 | 20.6 |
| Rz ($\mu$m) | 12.3 | 12.3 | 12.3 | 12.3 | 12.3 | 12.3 | 12.3 | 12.3 | 12.3 |
| Inlet $T_1$ (° C.) | −10 | −10 | −10 | −10 | −10 | −10 | −10 | −10 | −10 |
| Outlet $T_2$ (° C.) | 42 | 37 | 53 | 45 | 40 | 55 | 55 | 55 | 55 |
| $\Delta T$ (= $T_2$-$T_1$) | 52 | 47 | 63 | 55 | 50 | 65 | 65 | 65 | 65 |
| Rotor speed (m/sec) | 117 | 125 | 150 | 114 | 115 | 144 | 144 | 144 | 144 |
| Rotor/stator gap (mm) | 1.3 | 1.3 | 1.3 | 1.3 | 1.3 | 1.3 | 1.3 | 1.3 | 1.3 |
| Properties Mw ($\times 10^4$) | 14.8 | 14.7 | 15.2 | 15.2 | 4.9 | 4.9 | 14.8 | 15.2 | 15.2 |
| Mn ($\times 10^4$) | 0.95 | 0.92 | 0.69 | 0.69 | 0.57 | 0.55 | 0.95 | 0.69 | 0.69 |
| Mp ($\times 10^4$) | 1.57 | 1.59 | 1.35 | 1.35 | 0.78 | 0.78 | 1.57 | 1.35 | 1.35 |
| Tg (° C.) | 60.2 | 60.0 | 59.7 | 59.5 | 57.8 | 57.6 | 60.2 | 59.7 | 59.7 |
| $D_4$ ($\mu$m) = X | 6.8 | 6.9 | 5.5 | 6.6 | 11.2 | 8.5 | 7.5 | 10.2 | 7.0 |
| $W_{H½}$ = y | 5.5 | 6.0 | 2.3 | 5.2 | 15.3 | 9.2 | 7.2 | 12.5 | 5.8 |
| $T_{abs\text{-}max}$ (° C.) | 73.0 | 100.0 | 102.0 | 141/101 | 101.0 | 141/102 | 73.0 | 73.0 | 100.5 |
| Carr's index (flood) | 86.0 | 84.5 | 82.0 | 83.0 | 83.5 | 85.0 | 86.0 | 83.0 | 84.5 |
| Carr's index (flow) | 73.5 | 66.0 | 67.5 | 62.5 | 75.0 | 68.0 | 70.5 | 62.5 | 73.0 |
| Qd ($\mu$C/g) | −30.8 | −29.4 | −28.5 | −32.5 | −26.3 | −31.5 | −42.3 | −50.3 | −51.8 |
| 5.3 × X | 36.0 | 36.6 | 29.2 | 35.0 | 59.4 | 45.1 | 39.8 | 54.1 | 37.1 |
| Cut percentage Z (%) | 13.5 | 15.6 | 10.9 | 40.3 | 31.8 | 48.3 | 33.7 | 40.8 | 38.9 |
| Ci ≧ 0.900 (% N) | 94.9 | 95.6 | 93.4 | 96.3 | 91.6 | 95.4 | 97.5 | 98.6 | 97.9 |
| Ci ≧ 0.950 (% N) | 77.9 | 76.1 | 84.2 | 79.4 | 56.3 | 70.9 | 84.3 | 80.1 | 86.7 |
| exp 5.51 × $X^{0.645}$ | 71.8 | 71.1 | 82.3 | — | 52.0 | — | 67.4 | 55.3 | — |
| exp 5.37 × $X^{0.545}$ | — | — | — | 76.8 | — | 66.9 | — | — | 74.4 |
| Isolated iron particles per 10000 toner particles) | 120 | 152 | 241 | 125 | 218 | 165 | 123 | 120 | 124 |

| Example | 10 | 11 | 12 | 13 | 14 | 15 | Comp. Ex. 1 | Comp. Ex. 2 | Comp. Ex. 3 | Comp. Ex. 4 |
|---|---|---|---|---|---|---|---|---|---|---|
| Toner No. | 10 | 11 | 12 | 13 | 14 | 15 | 16 | 17 | 18 | 19 |
| Composition | | | | | | | | | | |
| Binder Resin | C | D | A | D | D | D | C | D | C | C |
| Charge controller | B | B | A | B | C | B | C | B | B | B |
| Wax | e | a | b | a/b | b | a | e | a | b | b |
| Magnetic | 4 | 7 | 5 | 6 | 7 | 7 | 6 | 6 | 6 | 6 |
| Ext. additive (wt. parts) | | | | | | | | | | |
| hydrophobic silica | 1.0 | 1.0 | 1.2 | 1.2 | 1.2 | 1.0 | 1.2 | 1.2 | 1.2 | 1.2 |
| strontium titanate | 2.4 | 2.4 | 1.0 | 0.8 | 2.4 | 2.0 | 0.8 | 2.0 | 1.0 | 1.0 |
| Mixing conditions | | | | | | | | | | |
| 1st: speed (rps)/time (min) | 53.33/1 M | 53.33/1 M | 45/1 M | 45/1 M | 45/1 M | 53.33/1 M | 53.33/1 M | 53.33/1 M | 53.33/1 M | 45/3 M |
| 2nd: speed (rps)/time (min) | 70/2 M | 70/2 M | 50/2 M | 50/2 M | 50/2 M | 70/2 M | 70/2 M | 70/2 M | 70/2 M | |
| Vane (vpper/lower) | ZO/SO | ZO/SO | YO/SO | YO/SO | YO/SO | ZO/SO | ZO/SO | ZO/SO | ZO/AO | ZO/AO |
| Rotor/stator roughnesses | | | | | | | | | Pneumatic pulverizer | Pneumatic pulverizer + Hybridizer |
| Ra ($\mu$m) | 1.1 | 1.1 | 1.1 | 1.7 | 1.1 | 1.1 | 0.9 | 3.2 | | |
| Ry ($\mu$m) | 20.6 | 20.6 | 20.6 | 35.6 | 20.6 | 20.6 | 9.0 | 43.5 | | |
| Rz ($\mu$m) | 12.3 | 12.3 | 12.3 | 21.3 | 12.3 | 12.3 | 6.4 | 35.4 | | |
| Inlet $T_1$ (° C.) | −10 | −10 | −10 | −10 | −10 | −10 | −10 | −10 | | |
| Outlet $T_2$ (° C.) | 55 | 30 | 50 | 46 | 33 | 48 | 53 | 31 | | |
| $\Delta T$ (= $T_2$-$T_1$) | 65 | 40 | 60 | 56 | 43 | 58 | 63 | 41 | | |
| Rotor speed (m/sec) | 144 | 90 | 120 | 155 | 135 | 115 | 150 | 90 | | |

TABLE 4-continued

| Toner Prescription, Physical properties & Pulverization conditions | | | | | | | | | | |
|---|---|---|---|---|---|---|---|---|---|---|
| Rotor/stator gap (mm) | 1.3 | 1.3 | 1.3 | 1.3 | 1.3 | 1.3 | 1.3 | 1.0 | | |
| Properties Mw ($\times 10^4$) | 4.9 | 13.2 | 14.8 | 13.5 | 13.2 | 13.2 | 4.7 | 13.2 | 14.8 | 14.8 |
| Mn ($\times 10^4$) | 0.57 | 0.85 | 0.95 | 0.88 | 0.85 | 0.85 | 0.55 | 0.85 | 0.95 | 0.95 |
| Mp ($\times 10^4$) | 0.78 | 1.1 | 1.57 | 1.1 | 1.1 | 1.1 | 0.79 | 1.1 | 1.63 | 1.64 |
| Tg (° C.) | 58.0 | 59.3 | 60.2 | 59.3 | 59.3 | 59.3 | 57.7 | 59.3 | 60.5 | 60.5 |
| $D_4$ ($\mu$m) = X | 10.8 | 10.2 | 7.3 | 9.5 | 5.8 | 11.3 | 6.9 | 7.1 | 7.0 | 8.5 |
| $W_{H^{1/2}}$ = y | 14.3 | 12.5 | 7.2 | 10.8 | 4.2 | 14.9 | 5.9 | 5.8 | 6.5 | 10.1 |
| $T_{abs\text{-}max}$ (° C.) | 100.0 | 141.0 | 128.0 | 140/126 | 127.0 | 139.0 | 99.0 | 142.0 | 128.0 | 127.0 |
| Carr's index (flood) | 87.0 | 86.0 | 86.0 | 82.0 | 84.5 | 87.0 | 83.0 | 84.0 | 86.0 | 79.0 |
| Carr's index (flow) | 75.0 | 76.0 | 70.5 | 63.5 | 73.0 | 61.0 | 70.5 | 66.0 | 72.0 | 74.0 |
| Qd ($\mu$C/g) | −43.7 | −24.3 | −29.3 | −31.2 | −28.6 | −25.5 | −30.6 | −32.4 | −26.5 | −40.3 |
| 5.3 × X | 57.2 | 54.1 | 38.7 | 50.4 | 30.7 | 59.9 | 36.6 | 37.6 | 37.1 | 45.1 |
| Cut percentage Z (%) | 60.3 | 61.3 | 32.8 | 44.3 | 34.5 | 62.1 | 13.5 | 46.2 | 11.5 | 19.4 |
| Ci ≧ 0.900 (% N) | 98.3 | 93.5 | 95.7 | 93.2 | 92.7 | 92.9 | 98.1 | 91.8 | 89.4 | 93.5 |
| Ci ≧ 0.950 (% N) | 78.6 | 62.7 | 71.2 | 59.8 | 83.9 | 60.5 | 69.2 | 72.3 | 66.8 | 66.3 |
| exp 5.51 × $X^{0.645}$ | — | — | 68.6 | 57.9 | — | — | 71.1 | — | 70.4 | 62.2 |
| exp 5.37 × $X^{0.545}$ | 58.7 | 60.6 | — | — | 82.4 | 57.3 | — | 73.8 | — | — |
| Isolated iron particles (per 10000 toner particles) | 128 | 283 | 110 | 330 | 190 | 105 | 72 | 360 | 418 | 85 |

TABLE 5

| Powder properties for calculating Carr's indexes | | | | | | | | | |
|---|---|---|---|---|---|---|---|---|---|
| Example | 1 | 2 | 3 | 4 | 5 | 6 | 7 | 8 | 9 |
| Toner No. | 1 | 2 | 3 | 4 | 5 | 6 | 7 | 8 | 9 |
| Angle of repose (deg) (score) | 30 (22.5) | 32 (21) | 36 (19.5) | 38 (18) | 28 (24) | 33 (21) | 35 (20) | 38 (18) | 30 (22.5) |
| Compressibility (deg) (score) | 25 (15) | 30 (12) | 27 (12) | 32 (9.5) | 26 (14.5) | 31 (10) | 28 (12) | 32 (9.5) | 26 (14.5) |
| Angle of spatula (deg) (score) | 27 (24) | 34 (21) | 30 (24) | 29 (24) | 32 (22) | 25 (25) | 30 (24) | 29 (24) | 29 (24) |
| Cohesion (%) (score) | 15 (12) | 18.2 (12) | 20.1 (12) | 19.1 (12) | 8.9 (14.5) | 12.3 (12) | 9.5 (14.5) | 19.1 (12) | 20.2 (12) |
| Flowability index (–) | 73.5 | 66 | 67.5 | 62.5 | 75 | 68 | 70.5 | 62.5 | 73 |
| Flowability score | 25 | 25 | 25 | 25 | 25 | 25 | 25 | 25 | 25 |
| Angle of fall (deg) (score) | 18 (24) | 20 (22.5) | 22 (21) | 23 (21) | 17 (24) | 19 (24) | 22 (21) | 23 (21) | 20 (22.5) |
| Angle of difference (score) | 13 (12) | 12 (12) | 15 (15) | 17 (16) | 14 (14.5) | 12 (12) | 16 (16) | 17 (16) | 12 (12) |
| Dispersibility (deg) (score) | 55 (25) | 52 (25) | 41 (21) | 38 (21) | 35 (20) | 46 (24) | 48 (24) | 38 (21) | 52 (25) |
| Floodability index | 86 | 84.5 | 82 | 83 | 83.5 | 85 | 86 | 83 | 84.5 |
| Example | 10 | 11 | 12 | 13 | 14 | 15 | Comp. Ex. 1 | Comp. Ex. 2 | Comp. Ex. 3 | Comp. Ex. 4 |
| Toner No. | 10 | 11 | 12 | 13 | 14 | 15 | 16 | 17 | 18 | 19 |
| Angle of repose (deg) (score) | 28 (24) | 32 (21) | 35 (20) | 37 (18) | 30 (22.5) | 38 (18) | 30 (22.5) | 38 (18) | 29 (24) | 31 (22) |
| Compressibility (deg) (score) | 26 (14.5) | 19 (18) | 28 (12) | 32 (9.5) | 26 (14.5) | 33 (7) | 25 (15) | 28 (12) | 30 (12) | 18 (18) |
| Angle of spatula (deg) (score) | 32 (22) | 31 (22.5) | 30 (24) | 29 (24) | 29 (24) | 28 (24) | 34 (21) | 29 (24) | 27 (24) | 32 (22) |
| Cohesion (%) (score) | 8.9 (14.5) | 9.5 (14.5) | 9.5 (14.5) | 18.3 (12) | 20.2 (12) | 12.5 (12) | 18.3 (12) | 17.8 (12) | 19.9 (12) | 18.1 (12) |
| Flowability index (–) | 75 | 76 | 70.5 | 63.5 | 73 | 61 | 70.5 | 66 | 72 | 74 |
| Flowability score | 25 | 25 | 25 | 25 | 25 | 25 | 25 | 25 | 25 | 25 |
| Angle of fall (deg) (score) | 23 (21) | 19 (24) | 22 (21) | 18 (24) | 20 (22.5) | 23 (21) | 20 (22.5) | 22 (21) | 18 (24) | 19 (24) |
| Angle of difference (score) | 17 (16) | 13 (12) | 16 (16) | 16 (16) | 13 (12) | 17 (16) | 14 (14.5) | 18 (17) | 13 (12) | 12 (12) |
| Dispersibility (deg) (score) | 54 (25) | 53 (25) | 48 (24) | 48 (24) | 53 (25) | 54 (25) | 41 (21) | 38 (21) | 56 (25) | 32 (18) |
| Floodability index | 87 | 86 | 86 | 82 | 84.5 | 87 | 83 | 84 | 86 | 79 |

TABLE 6

| Image forming performances in NT/NH (23° C./65% RH) | | | | | | |
|---|---|---|---|---|---|---|
| | Initial | | After 15000 sheets | | After standing for 1 day | |
| Example | I.D. | Fog | I.D. | Fog | I.D. | Fog |
| 1 | 1.47 | 0.9 | 1.45 | 1.0 | 1.42 | 1.0 |
| 2 | 1.48 | 0.6 | 1.46 | 0.9 | 1.43 | 0.9 |
| 3 | 1.45 | 0.8 | 1.43 | 1.0 | 1.40 | 1.0 |
| 4 | 1.46 | 1.0 | 1.45 | 1.2 | 1.42 | 1.1 |
| 5 | 1.44 | 0.7 | 1.42 | 0.8 | 1.40 | 0.7 |
| 6 | 1.49 | 1.1 | 1.47 | 1.2 | 1.43 | 1.1 |
| 7 | 1.43 | 0.6 | 1.40 | 0.8 | 1.39 | 0.7 |
| 8 | 1.41 | 1.0 | 1.40 | 1.3 | 1.38 | 1.2 |
| 9 | 1.41 | 1.2 | 1.41 | 1.4 | 1.40 | 1.3 |

TABLE 6-continued

| Image forming performances in NT/NH (23° C./65% RH) | | | | | | |
|---|---|---|---|---|---|---|
| | Initial | | After 15000 sheets | | After standing for 1 day | |
| Example | I.D. | Fog | I.D. | Fog | I.D. | Fog |
| 10 | 1.42 | 0.8 | 1.40 | 1.0 | 1.40 | 1.0 |
| 11 | 1.43 | 0.6 | 1.41 | 0.9 | 1.41 | 0.8 |
| 12 | 1.40 | 1.3 | 1.40 | 1.4 | 1.38 | 1.3 |
| 13 | 1.43 | 1.0 | 1.42 | 1.2 | 1.40 | 1.1 |
| 14 | 1.44 | 1.5 | 1.44 | 1.6 | 1.43 | 1.5 |
| 15 | 1.45 | 1.0 | 1.45 | 1.2 | 1.43 | 1.2 |
| Comp. Ex. 1 | 1.41 | 0.8 | 1.40 | 1.5 | 1.36 | 1.5 |

TABLE 6-continued

| Image forming performances in NT/NH (23° C./65% RH) | | | | | | |
|---|---|---|---|---|---|---|
| | Initial | | After 15000 sheets | | After standing for 1 day | |
| Example | I.D. | Fog | I.D. | Fog | I.D. | Fog |
| Comp. Ex. 2 | 1.40 | 1.7 | 1.37 | 2.1 | 1.33 | 2.0 |
| Comp. Ex. 3 | 1.41 | 1.6 | 1.35 | 1.8 | 1.31 | 1.7 |
| Comp. Ex. 4 | 1.42 | 0.9 | 1.38 | 1.3 | 1.36 | 1.3 |

TABLE 7

| Image forming performances in HT/HH (30° C./80% RH) | | | | | | |
|---|---|---|---|---|---|---|
| | Initial | | After 15000 sheets | | After standing for 1 day | |
| Example | I.D. | Fog | I.D. | Fog | I.D. | Fog |
| 1 | 1.46 | 0.8 | 1.41 | 0.9 | 1.39 | 0.9 |
| 2 | 1.49 | 0.5 | 1.48 | 0.6 | 1.48 | 0.6 |
| 3 | 1.45 | 0.7 | 1.4 | 0.9 | 1.37 | 0.9 |
| 4 | 1.48 | 1.1 | 1.46 | 1.1 | 1.45 | 1.0 |
| 5 | 1.45 | 0.6 | 1.44 | 0.9 | 1.40 | 0.8 |
| 6 | 1.48 | 0.9 | 1.46 | 1.1 | 1.45 | 1 |
| 7 | 1.42 | 0.5 | 1.40 | 0.8 | 1.36 | 0.7 |
| 8 | 1.4 | 0.9 | 1.39 | 1.0 | 1.37 | 1.0 |
| 9 | 1.41 | 1.1 | 1.38 | 1.1 | 1.35 | 1.0 |
| 10 | 1.44 | 0.7 | 1.42 | 0.8 | 1.41 | 0.8 |
| 11 | 1.43 | 0.5 | 1.40 | 0.7 | 1.38 | 0.8 |
| 12 | 1.41 | 1.2 | 1.37 | 1.2 | 1.36 | 1.1 |
| 13 | 1.42 | 0.9 | 1.39 | 1.3 | 1.33 | 1.4 |
| 14 | 1.44 | 1.4 | 1.41 | 1.3 | 1.34 | 1.2 |
| 15 | 1.47 | 0.9 | 1.43 | 1.5 | 1.38 | 1.4 |
| Comp. Ex. 1 | 1.41 | 0.6 | 1.37 | 0.9 | 1.32 | 0.8 |
| Comp. Ex. 2 | 1.41 | 1.5 | 1.33 | 1.8 | 1.28 | 1.8 |
| Comp. Ex. 3 | 1.4 | 0.9 | 1.35 | 1.2 | 1.26 | 1.1 |
| Comp. Ex. 4 | 1.42 | 0.8 | 1.32 | 1.1 | 1.29 | 1.0 |

TABLE 8

| Image forming performances in LT/LH (15° C./10% RH) | | | | | | |
|---|---|---|---|---|---|---|
| | Initial | | After 15000 sheets | | After standing for 1 day | |
| Example | I.D. | Fog | I.D. | Fog | I.D. | Fog |
| 1 | 1.45 | 1.2 | 1.38 | 1.5 | 1.38 | 1.5 |
| 2 | 1.47 | 0.9 | 1.47 | 1.1 | 1.47 | 1.0 |
| 3 | 1.44 | 1.8 | 1.39 | 2.2 | 1.39 | 2.0 |
| 4 | 1.44 | 1.1 | 1.40 | 1.4 | 1.4 | 1.4 |
| 5 | 1.46 | 1.9 | 1.45 | 2 | 1.45 | 1.8 |
| 6 | 1.4 | 1.5 | 1.39 | 1.6 | 1.39 | 1.6 |
| 7 | 1.45 | 1.9 | 1.45 | 2.1 | 1.44 | 2 |
| 8 | 1.43 | 1.9 | 1.40 | 2.2 | 1.38 | 2.2 |
| 9 | 1.42 | 0.9 | 1.41 | 1.5 | 1.38 | 1.5 |
| 10 | 1.40 | 1.3 | 1.39 | 2.1 | 1.39 | 2.1 |
| 11 | 1.44 | 2.4 | 1.39 | 2.5 | 1.39 | 2.5 |
| 12 | 1.45 | 2.4 | 1.45 | 2.5 | 1.44 | 2.5 |
| 13 | 1.40 | 2.5 | 1.38 | 2.5 | 1.37 | 2.4 |
| 14 | 1.43 | 1.9 | 1.40 | 2.3 | 1.38 | 2.2 |
| 15 | 1.4 | 1.5 | 1.37 | 2.6 | 1.35 | 2.6 |
| Comp. Ex. 1 | 1.41 | 3.2 | 1.28 | 4.0 | 1.28 | 3.9 |
| Comp. Ex. 2 | 1.38 | 3.5 | 1.36 | 4.2 | 1.35 | 4.1 |
| Comp. Ex. 3 | 1.37 | 2.0 | 1.33 | 3.1 | 1.32 | 3.0 |
| Comp. Ex. 4 | 1.35 | 2.8 | 1.30 | 3.5 | 1.29 | 3.4 |

TABLE 9

| Transfer efficiency | | | |
|---|---|---|---|
| Example | Initial Ti (%) | After 10000 sheets Tf (%) | Change Ti − Tf (%) |
| 1 | 91.2 | 89.8 | 1.4 |
| 2 | 92.1 | 91.3 | 0.8 |
| 3 | 90.8 | 89.2 | 1.6 |
| 4 | 92.4 | 91.8 | 0.6 |
| 5 | 91.3 | 90.4 | 0.9 |
| 6 | 91.8 | 91.1 | 0.7 |
| 7 | 95.3 | 94.3 | 1.0 |
| 8 | 96.3 | 94.8 | 1.5 |
| 9 | 95.2 | 93.9 | 1.3 |
| 10 | 96.8 | 95.1 | 1.7 |
| 11 | 90.2 | 86.8 | 3.4 |
| 12 | 90.5 | 88.2 | 2.3 |
| 13 | 88.2 | 86.2 | 2.0 |
| 14 | 87.4 | 85.2 | 2.2 |
| 15 | 90.3 | 88.4 | 1.9 |
| Comp. Ex. 1 | 92.3 | 87.7 | 4.6 |
| Comp. Ex. 2 | 87.5 | 80.8 | 6.7 |
| Comp. Ex. 3 | 88.2 | 80.3 | 7.9 |
| Comp. Ex. 4 | 90.8 | 85.1 | 2.2 |

TABLE 10

| Image quality | | | | | |
|---|---|---|---|---|---|
| Example | Consumption (mg/sheet) | I.D. | Line width (μm) | Dot | Tailing |
| 1 | 33 | 1.50 | 440 | A | A |
| 2 | 37 | 1.47 | 430 | A | A |
| 3 | 41 | 1.46 | 420 | A | C |
| 4 | 45 | 1.42 | 440 | A | A |
| 5 | 34 | 1.43 | 390 | A | A |
| 6 | 38 | 1.45 | 410 | A | A |
| 7 | 44 | 1.48 | 420 | A | B |
| 8 | 45 | 1.44 | 440 | A | B |
| 9 | 43 | 1.46 | 420 | B | A |
| 10 | 48 | 1.48 | 410 | A | A |
| 11 | 36 | 1.43 | 400 | C | B |
| 12 | 35 | 1.42 | 380 | A | C |
| 13 | 44 | 1.44 | 400 | C | A |
| 14 | 46 | 1.41 | 380 | A | C |
| 15 | 42 | 1.40 | 390 | C | B |
| Comp. Ex. 1 | 56 | 1.46 | 330 | D | D |
| Comp. Ex. 2 | 44 | 1.37 | 370 | D | E |
| Comp. Ex. 3 | 31 | 1.21 | 310 | D | E |
| Comp. Ex. 4 | 44 | 1.40 | 530 | D | D |

TABLE 11

| Image quality by using a process cartridge including an injection charging system | | | | | |
|---|---|---|---|---|---|
| Example | Consumption (mg/sheet) | I.D. | Line width (μm) | Dot | Tailing |
| 16 | 34 | 1.47 | 430 | A | A |
| 17 | 36 | 1.5 | 420 | A | A |
| 18 | 37 | 1.41 | 440 | A | B |
| 19 | 31 | 1.43 | 370 | C | C |
| 20 | 38 | 1.42 | 390 | A | B |

EXAMPLE 21

| | |
|---|---|
| Binder resin B | 100 parts |
| Magnetic iron oxide particles (3) | 90 parts |
| Wax (c) | 4 parts |
| Charge control agent A (azo iron complex) | 2 parts |

The above ingredients were pre-blended in a Henschel mixer and melt-kneaded by a twin-screw extruder at 130° C. The melt-kneaded product was coarsely crushed to below 1 mm by a cutter mill.

The thus-formed coarsely crushed material (as a powdery feed) were supplied to a mechanical pulverizer 301 (as shown in FIGS. 2 and 3) for pulverization, and the pulverized material was classified by a multi-division classifier 1 (FIGS. 2 and 6) to obtain magnetic toner particles having a weight-average particle size (D4) of 6.5 $\mu$m.

The mechanical pulverizer 301 used in this Example included a rotor 314 and a stator 310, of which the pulverization surfaces had been subjected to nitriding as an anti-wearing treatment. The treated surfaces exhibited a central line-average roughness (Ra) of 5.9 $\mu$m, a maximum roughness (Ry) of 32.4$\mu$m and a ten point-average roughness (Rz) of 21.4 $\mu$m. For the pulverization, the rotor 314 was rotated at a circumferential speed of 117 m/s, and the stator 310 was disposed with a gap of 1.3 mm from the rotor 314. The inlet temperature T1 was −10° C., and the outlet temperature T2 was 42° C.

100 wt. parts of the above-obtained magnetic toner particles were externally blended with negatively chargeable hydrophobic silica ($S_{BET}$=120 $m^2$/g, a methanol wettability ($H_{MeOH}$) of 80%) obtained after hydrohobization with 15 wt. % of hexamethyldisilazane and 15 wt. % of dimethylsilicone, thereby obtaining Magnetic toner No. 16.

Figure 25:
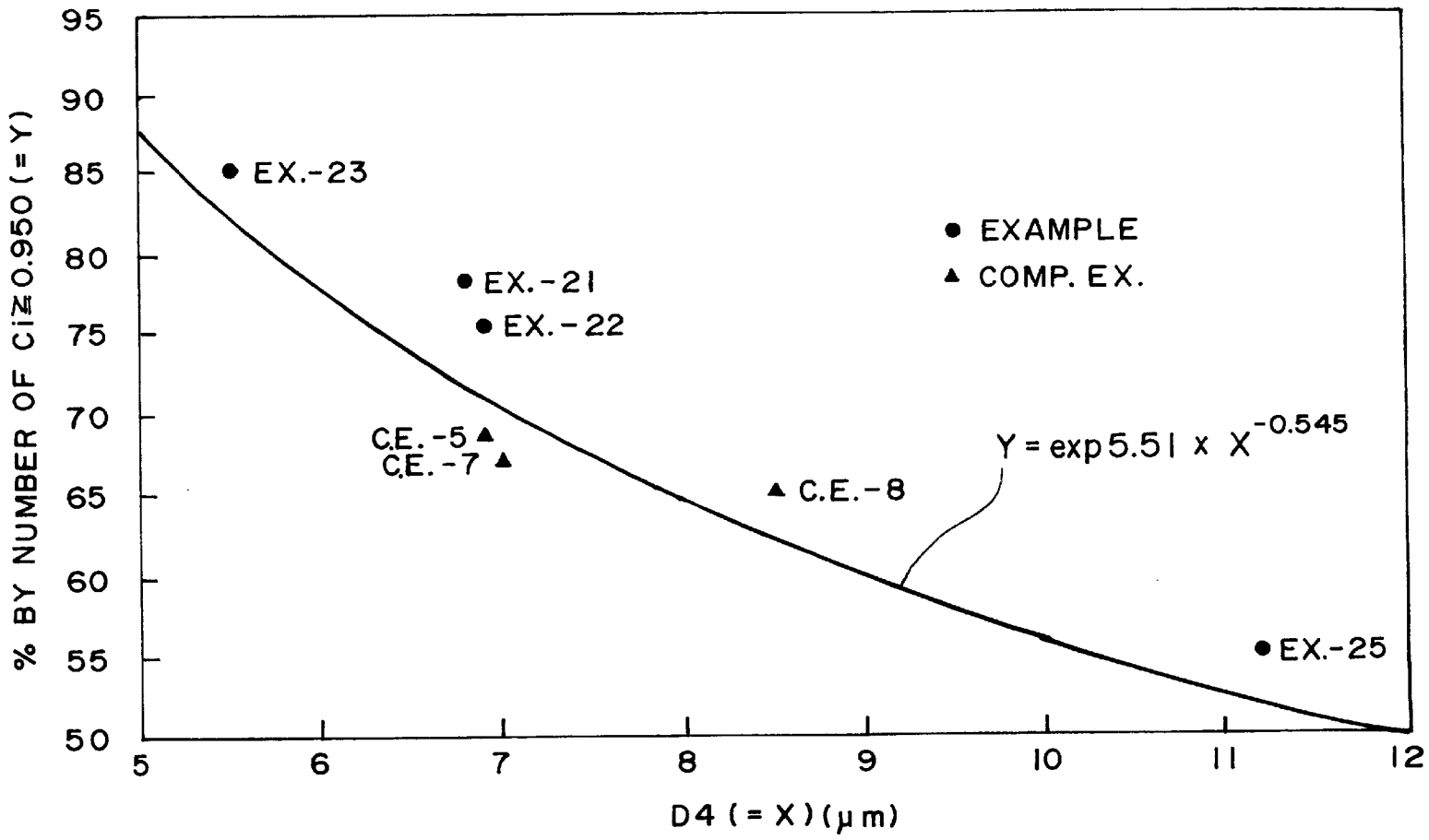

Toner prescriptions, pulverization conditions and some physical properties of Magnetic toner No. 16 are shown in Tables 12 and 13 and a relationship between % by number of particles of Ci (circularity)≧0.950 (=Y) and weight-particle size (D4=X) is shown in FIG. 25, together with those of magnetic toners prepared in Examples and Comparative Examples appearing hereinafter.

The image-forming performances and transferability of Magnetic toner No. 16 were evaluated in the same manner as Example 1. The results are inclusively shown in Tables 14–16 together with those of the following Examples and Comparative Examples.

EXAMPLE 22

Magnetic toner No. 17 was prepared in the same manner as in Example 21 except for using the toner prescription shown in Table 12 and changing the rotor peripheral speed in the mechanical pulverizer to 125 m/s. The inlet temperature Ti was −10° C. and the outlet temperature T2 was 37° C.

EXAMPLE 23

Magnetic toner No. 18 was prepared in the same manner as in Example 21 except for using the toner prescription shown in Table 12 and changing the rotor peripheral speed in the mechanical pulverizer to 150 m/s. The inlet temperature T1 was −10° C. and the outlet temperature T2 was 63° C.

EXAMPLE 24

Magnetic toner No. 19 was prepared in the same manner as in Example 21 except for using the toner prescription shown in Table 12 and changing the rotor peripheral speed in the mechanical pulverizer to 114 m/s. The inlet temperature T1 was −10° C. and the outlet temperature T2 was 45° C.

EXAMPLE 25

Magnetic toner No. 20 was prepared in the same manner as in Example 21 except for using the toner prescription shown in Table 12 and changing the rotor peripheral speed in the mechanical pulverizer to 115 m/s. The inlet temperature T1 was −10° C. and the outlet temperature T2 was 40° C.

EXAMPLE 26

Magnetic toner No. 21 was prepared in the same manner as in Example 21 except for using the toner prescription shown in Table 12 and changing the rotor peripheral speed in the mechanical pulverizer to 144 m/s. The inlet temperature T1 was −10° C. and the outlet temperature T2 was 60° C.

EXAMPLE 27

Magnetic toner No. 22 was prepared in the same manner as in Example 21 except for using the toner prescription shown in Table 12 and changing the rotor peripheral speed in the mechanical pulverizer to 90 m/s. The inlet temperature T1 was −10° C. and the outlet temperature T2 was 30° C.

COMPARATIVE EXAMPLE 5

Comparative Magnetic toner No. (v) was prepared in the same manner as in Example 21 except for using the toner prescription shown in Table 12 and that the pulverization step was performed by using a rotor and a stator of which surfaces had been surface-treated and nitrided for anti-preparing the provide roughnesses Ra=1.8 $\mu$m, Ry=13.5 $\mu$m and Rz=9.8 $\mu$m, while rotating the rotor at a peripheral speed of 150 m/s with a gap of 1.3 mm from the stator so that T1=−10° C. and T2=63° C.

COMPARATIVE EXAMPLE 6

Comparative Magnetic toner No. (vi) was prepared in the same manner as in Example 1 except for using the toner prescription shown in Table 4 and that the pulverization step was performed by using a rotor and a stator of which surfaces had been surface-treated and nitrided for anti-preparing the provide roughnesses Ra=12.3 $\mu$m, Ry=70.8 $\mu$m and Rz=41.3 $\mu$m, while rotating the rotor at a peripheral speed of 90 m/s with a gap of 1.0 mm from the stator so that T1=−10° C. and T2=31° C.

COMPARATIVE EXAMPLE 7

Comparative Magnetic toner No. (vii) was prepared in the same manner as in Example 21 except for using the toner prescription shown in Table 12 and that the pulverization step was performed by using an impingement-type pneumatic pulverizer.

COMPARATIVE EXAMPLE 8

Comparative Magnetic toner No. (viii) was prepared in the same manner as in Example 21 except for using the toner prescription shown in Table 12 and that the pulverization step was performed by using an impingement type pneumatic pulverizer, and the classified toner particles were further subjected to modification of particle shape and surface properties by using a hybridizer.

Figure 26:
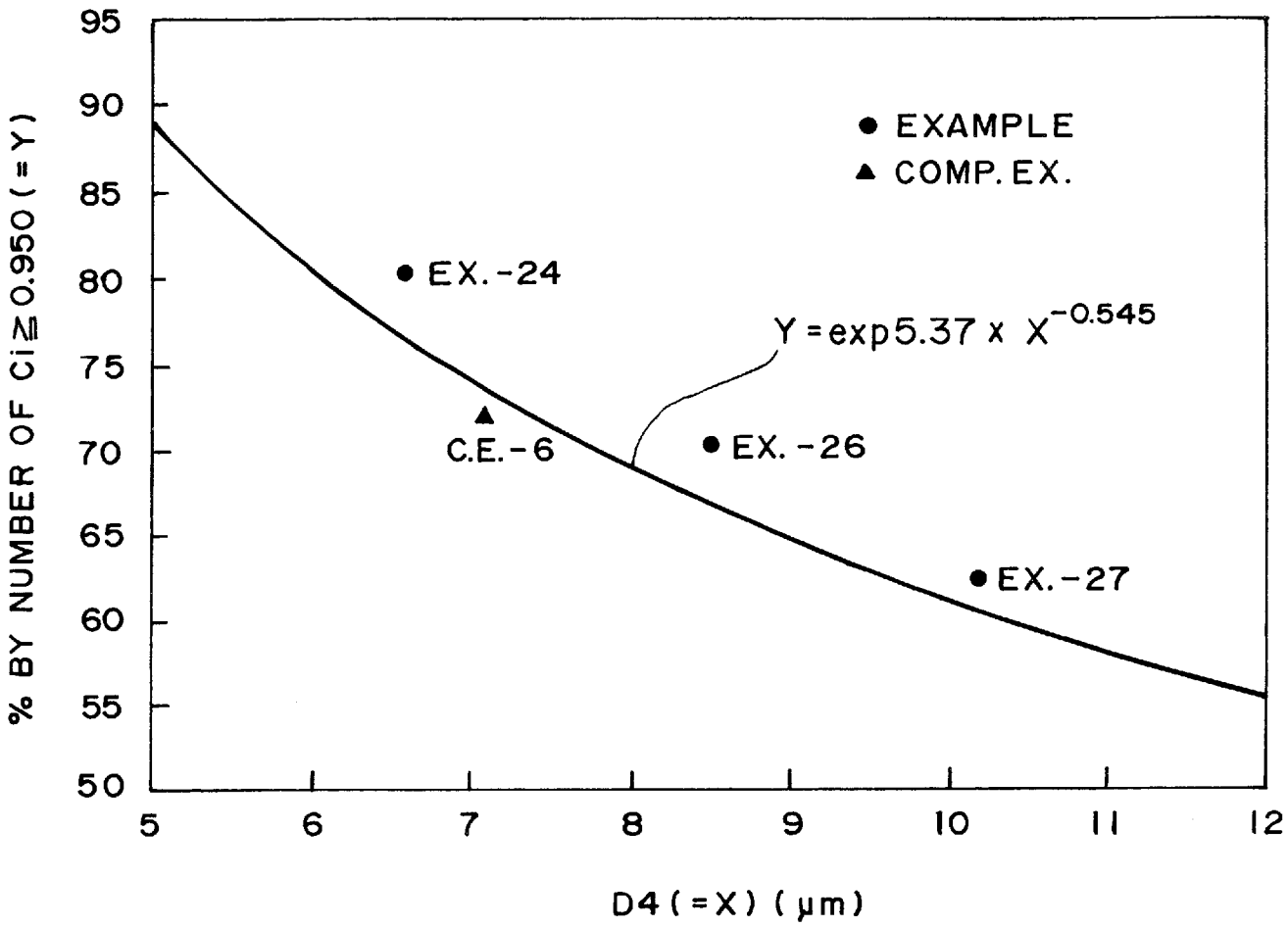

The results of the above Examples and Comparative Examples are inclusively shown in Tables 14–17 and FIGS. 25–26.

TABLE 12

Toner Prescription, Physical properties & Pulverization conditions

| Example | 21 | 22 | 23 | 24 | 25 | 26 | 27 | Comp. Ex. 5 | Comp. Ex. 6 | Comp. Ex. 7 | Comp. Ex. 8 |
|---|---|---|---|---|---|---|---|---|---|---|---|
| Toner No. | 16 | 17 | 18 | 19 | 20 | 21 | 22 | (v) | (vi) | (vii) | (viii) |
| Composition | | | | | | | | | | | |
| Binder Resin | B | A | D | A | C | B | D | C | D | A | A |
| Charge controller | A | C | B | A | C | C | B | B | C | A | A |
| Wax | c | e | d | b | a | b | e | e | a | b | b |
| Magnetic | 3 | 1 | 4 | 5 | 7 | 2 | 6 | 6 | 6 | 6 | 6 |
| | | | | Rotor/stator roughnesses | | | | | | | |
| Ra (μm) | 5.9 | 5.9 | 5.9 | 5.9 | 5.9 | 5.9 | 5.9 | 1.8 | 12.3 | Pneumatic pulverizer | Pneumatic pulverizer + Hybridizer |
| Ry (μm) | 32.4 | 32.4 | 32.4 | 32.4 | 32.4 | 32.4 | 32.4 | 13.5 | 70.8 | | |
| Rz (μm) | 21.4 | 21.4 | 21.4 | 21.4 | 21.4 | 21.4 | 21.4 | 9.8 | 41.3 | | |
| Inlet $T_1$ (° C.) | −10 | −10 | −10 | −10 | −10 | −10 | −10 | −10 | −10 | | |
| Outlet $T_2$ (° C.) | 42 | 37 | 63 | 45 | 40 | 60 | 30 | 63 | 31 | | |
| $\Delta T$ (= $T_2 - T_1$) | 52 | 47 | 73 | 55 | 50 | 70 | 40 | 73 | 41 | | |
| Rotor speed (m/sec) | 117 | 125 | 150 | 114 | 115 | 144 | 90 | 150 | 90 | | |
| Rotor/stator gap (mm) | 1.3 | 1.3 | 1.3 | 1.3 | 1.3 | 1.3 | 1.3 | 1.3 | 1.3 | | |
| Properties Mw ($\times 10^4$) | 15.2 | 14.8 | 12.8 | 14.7 | 4.9 | 15.1 | 12.9 | 4.7 | 13.2 | 14.8 | 14.8 |
| Mn ($\times 10^4$) | 0.69 | 0.95 | 0.81 | 0.95 | 0.57 | 0.72 | 0.84 | 0.55 | 0.85 | 0.95 | 0.95 |
| Tg (° C.) | 59.7 | 60.2 | 59.2 | 60.0 | 57.8 | 59.8 | 59.3 | 57.7 | 59.3 | 60.5 | 60.5 |
| $D_4$ (μm) = X | 6.8 | 6.9 | 5.5 | 6.6 | 11.2 | 8.5 | 10.2 | 6.9 | 7.1 | 7.0 | 8.5 |
| % N (≦4 μm) | 20.3 | 20.6 | 34.6 | 21.4 | 2.3 | 6.7 | 1.9 | 20.5 | 17.6 | 18.2 | 4.7 |
| % V (≧10.1 μm) | 2.1 | 2.0 | 0.6 | 2.2 | 52.8 | 30.7 | 51.6 | 1.8 | 2.1 | 1.9 | 31.5 |
| Ext. additive (wt. parts) | | | | | | | | | | | |
| hydrophobic silica | 1.2 | 1.2 | 1.2 | 1.2 | 1.2 | 1.2 | 1.0 | 1.2 | 1.2 | 1.2 | 1.2 |
| strontium titanate | 1.0 | 0.8 | 0.8 | 2.0 | 0.4 | 2.4 | 2.4 | 0.8 | 2.0 | 1.0 | 1.0 |
| 5.3 × X | 36.0 | 36.6 | 29.2 | 35.0 | 59.4 | 45.1 | 54.1 | 36.6 | 37.6 | 37.1 | 45.1 |
| Cut percentage Z (%) | 12.1 | 14.0 | 11.7 | 39.5 | 30.6 | 47.2 | 60.1 | 12.8 | 45.4 | 10.7 | 19.6 |
| Ci ≧ 0.900 (% N) | 95.8 | 95.3 | 92.5 | 96.6 | 91.2 | 95.9 | 93.8 | 97.8 | 92.3 | 89.7 | 93.4 |
| Ci ≧ 0.950 (% N) | 78.4 | 75.6 | 85.3 | 80.3 | 55.2 | 70.3 | 62.5 | 68.9 | 72.1 | 67.3 | 65.2 |
| exp 5.51 × $X^{0.645}$ | 71.8 | 71.1 | 82.3 | — | 52.0 | — | — | 71.1 | — | 70.4 | 62.2 |
| exp 5.37 × $X^{0.545}$ | — | — | — | 76.8 | — | 66.9 | 60.6 | — | 73.8 | — | — |
| Isolated iron particles (per 10000 toner particles) | 110 | 145 | 245 | 130 | 220 | 175 | 280 | 65 | 365 | 420 | 87 |

TABLE 13

Toner properties

| Example | 21 | 22 | 23 | 24 | 25 | 26 | 27 | Comp. Ex. 5 | Comp. Ex. 6 | Comp. Ex. 7 | Comp. Ex. 8 |
|---|---|---|---|---|---|---|---|---|---|---|---|
| Toner No. | 16 | 17 | 18 | 19 | 20 | 21 | 22 | (v) | (vi) | (vii) | (viii) |
| Mp ($\times 10^4$) | 1.42 | 1.58 | 1.0 | 1.61 | 0.79 | 1.39 | 1.12 | 0.78 | 1.09 | 1.60 | 1.60 |
| $W_{H½}$=y | 6.0 | 5.8 | 3.1 | 5.3 | 14.9 | 9.3 | 13.0 | 6.6 | 6.8 | 5.9 | 10.3 |
| $T_{abs\text{-}max}$ (° C.) | 77 | 104 | 105 | 126 | 141 | 129 | 103 | 102 | 138 | 126 | 125 |
| Carr's index (flood) | 83 | 85 | 82 | 84.5 | 87.0 | 85.0 | 82.5 | 87.0 | 75 | 79 | 81 |
| Carr's index (flow) | 63.5 | 75.5 | 63.0 | 63.5 | 73.0 | 68.0 | 67.5 | 61.0 | 58 | 60 | 59 |
| Qd(μC/g) | −33.1 | −29.6 | −31.9 | −32.5 | −28.5 | −26.8 | −40.1 | −35.2 | −29.6 | −31.8 | −42.5 |

TABLE 14

Image forming performances in NT/NH (23° C./65% RH)

| | Initial | | After 15000 sheets | | After standing for 1 day | |
|---|---|---|---|---|---|---|
| Example | I.D. | Fog | I.D. | Fog | I.D. | Fog |
| 21 | 1.45 | 1.0 | 1.43 | 1.1 | 1.41 | 0.9 |
| 22 | 1.48 | 0.8 | 1.46 | 1.0 | 1.45 | 1.0 |
| 23 | 1.45 | 0.8 | 1.42 | 1.1 | 1.42 | 1.0 |
| 24 | 1.47 | 1.1 | 1.45 | 1.2 | 1.45 | 1.0 |
| 25 | 1.44 | 0.7 | 1.41 | 0.9 | 1.40 | 0.9 |
| 26 | 1.47 | 1.2 | 1.45 | 1.3 | 1.43 | 1.2 |
| 27 | 1.41 | 0.8 | 1.40 | 0.8 | 1.40 | 0.7 |
| Comp. Ex. 5 | 1.40 | 1.2 | 1.38 | 1.3 | 1.34 | 1.2 |
| Comp. Ex. 6 | 1.39 | 1.6 | 1.37 | 1.7 | 1.36 | 1.8 |

TABLE 14-continued

| Image forming performances in NT/NH (23° C./65% RH) | | | | | | |
|---|---|---|---|---|---|---|
| | Initial | | After 15000 sheets | | After standing for 1 day | |
| Example | I.D. | Fog | I.D. | Fog | I.D. | Fog |
| Comp. Ex. 7 | 1.40 | 0.8 | 1.37 | 1.2 | 1.33 | 1.0 |
| Comp. Ex. 8 | 1.41 | 0.7 | 1.35 | 1.1 | 1.31 | 1.0 |

TABLE 15

| Image forming performances in HT/HH (30° C./80% RH) | | | | | | |
|---|---|---|---|---|---|---|
| | Initial | | After 15000 sheets | | After standing for 1 day | |
| Example | I.D. | Fog | I.D. | Fog | I.D. | Fog |
| 21 | 1.46 | 0.8 | 1.41 | 0.9 | 1.39 | 0.9 |
| 22 | 1.49 | 0.5 | 1.48 | 0.6 | 1.48 | 0.6 |
| 23 | 1.45 | 0.7 | 1.40 | 0.9 | 1.39 | 0.9 |
| 24 | 1.48 | 1.1 | 1.46 | 1.1 | 1.45 | 1.0 |
| 25 | 1.45 | 0.6 | 1.44 | 0.9 | 1.42 | 0.8 |
| 26 | 1.48 | 1.2 | 1.46 | 1.4 | 1.45 | 1.4 |
| 27 | 1.42 | 0.5 | 1.40 | 0.8 | 1.38 | 0.7 |
| Comp. Ex. 5 | 1.41 | 0.6 | 1.37 | 0.9 | 1.32 | 0.8 |
| Comp. Ex. 6 | 1.41 | 1.5 | 1.33 | 1.8 | 1.28 | 1.8 |
| Comp. Ex. 7 | 1.40 | 0.9 | 1.35 | 1.2 | 1.26 | 1.1 |
| Comp. Ex. 8 | 1.42 | 0.8 | 1.32 | 1.1 | 1.29 | 1.0 |

TABLE 16

| Image forming performances in LT/LH (15° C./10% RH) | | | | | | |
|---|---|---|---|---|---|---|
| | Initial | | After 15000 sheets | | After standing for 1 day | |
| Example | I.D. | Fog | I.D. | Fog | I.D. | Fog |
| 21 | 1.45 | 1.2 | 1.38 | 1.5 | 1.38 | 1.5 |
| 22 | 1.47 | 0.9 | 1.47 | 1.1 | 1.47 | 1.0 |
| 23 | 1.44 | 1.3 | 1.39 | 1.6 | 1.39 | 1.6 |
| 24 | 1.46 | 2.2 | 1.45 | 2.5 | 1.45 | 2.5 |
| 25 | 1.44 | 1.1 | 1.40 | 1.4 | 1.40 | 1.4 |
| 26 | 1.45 | 2.4 | 1.45 | 2.5 | 1.44 | 2.5 |
| 27 | 1.40 | 1.5 | 1.39 | 1.6 | 1.39 | 1.6 |
| Comp. Ex. 5 | 1.41 | 3.2 | 1.28 | 4.0 | 1.28 | 3.9 |
| Comp. Ex. 6 | 1.38 | 3.5 | 1.36 | 4.2 | 1.35 | 4.1 |
| Comp. Ex. 7 | 1.37 | 2.0 | 1.33 | 3.1 | 1.32 | 3.0 |
| Comp. Ex. 8 | 1.35 | 2.8 | 1.30 | 3.5 | 1.29 | 3.4 |

TABLE 17

| Transfer efficiency | | | |
|---|---|---|---|
| Example | Initial Ti (%) | After 10000 sheets Tf (%) | Change Ti − Tf (%) |
| 21 | 91.2 | 89.8 | 1.4 |
| 22 | 92.1 | 91.3 | 0.8 |
| 23 | 90.8 | 89.2 | 1.6 |
| 24 | 92.4 | 91.8 | 0.6 |
| 25 | 90.5 | 88.2 | 2.3 |
| 26 | 91.8 | 91.1 | 0.7 |
| 27 | 92.3 | 91.5 | 0.8 |
| Comp. Ex. 5 | 92.3 | 90.7 | 1.6 |
| Comp. Ex. 6 | 87.5 | 80.8 | 6.7 |
| Comp. Ex. 7 | 88.2 | 80.3 | 7.9 |
| Comp. Ex. 8 | 90.8 | 85.1 | 2.2 |

What is claimed is:

1. A dry magnetic toner, comprising; magnetic toner particles each comprising at least a binder resin and magnetic iron oxide particles; wherein 100–350 iron-containing isolated particles are present per 10,000 toner particles;

the toner has a weight-average particle size X in a range of 5–12 $\mu$m; and contain at least 90% by number of particles satisfying a circularity Ci according to formula (1) of at least 0.900 with respect to particles of 3 $\mu$m or larger therein, $$Ci=L_0/L \quad (1),$$

wherein L denotes a peripheral length of a projection image of an individual particle, and $L_0$ denotes a peripheral length of a circle giving an identical area as the projection image; and the toner satisfies either (a) (i) a cut percentage Z determined by formula (3) shown below satisfies formula (2) below with respect to the weight-average particle size X:

$$Z \leqq 5.3 \times X \quad (2),$$

$$Z = (1 - B/A) \times 100 \quad (3),$$

wherein A denotes the number of total particles and B denotes the number of particles of 3 μm or larger, and (ii) the toner contains a number-basis percentage Y (%) of particles having Ci≧0.950 within particles of 3 μm or larger satisfying:

$$Y \geqq X^{-0.645} \times \exp 5.51 \quad (4), \text{ or}$$

(b) (iii) a cut percentage Z determined by the formula (3) above satisfies formula (5) below with respect to the weight-average particle size X:

$$Z > 5.3 \times X \quad (5), \text{ and}$$

percentage Y (%) of particles having Ci≧0.950 within particles of 3 μm or larger satisfying:

$$Y \geqq X^{-0.545} \times \exp 5.37 \quad (6).$$

2. The toner according to claim 1, wherein the magnetic iron oxide particles have a surface formed of an oxide or/and a hydroxide.

3. The toner according to claim 1, wherein the magnetic iron oxide particles have a hydrophobicity of at most 20%.

4. The toner according to claim 1, wherein the magnetic iron oxide particles are contained in 20–200 wt. parts per 100 wt. parts of the binder resin.

5. The toner according to claim 1, wherein the magnetic iron oxide particles contains a non-iron element in 0.05–10 wt. % based on the iron.

6. The toner according to claim 5, wherein the magnetic iron oxide particles contain 0.4–2.0 wt. % of Si based on the iron, and have an Fe/Si ratio of 1.2–7.0 at their utmost surface.

7. The toner according to claim 6, wherein the magnetic iron oxide particles have an Fe/Si ratio of 1.2–4.0.

8. The toner according to claim 1, wherein the magnetic iron oxide particles have a smoothness of 0.3–0.8.

9. The toner according to claim 1, wherein the magnetic iron oxide particles have a BET specific surface area of at most 15.0 $m^2/g$.

10. The toner according to claim 5, wherein the magnetic iron oxide particles contain 0.01–2.0 wt. % of Al based on the iron.

11. The toner according to claim 10, wherein the magnetic iron oxide particles have an Fe/Al ratio of 0.3–10.0 at their utmost surface.

12. The toner according to claim 1, wherein the binder resin has a carboxyl or carboxylic anhydride group, and has an acid value of 1–100 mgKOH/g.

13. The toner according to claim 12, wherein the carboxyl or carboxylic anhydride group of the binder resin is originated from at least one acid monomer selected from the group consisting of maleic acid, maleic acid half esters and maleic anhydride.

14. The toner according to claim 12, wherein the binder resin comprises a styrene copolymer.

15. The toner according to claim 1, wherein the toner particles further contain a charge control agent.

16. The toner according to claim 15, wherein the charge control agent is an azo metal complex represented by formula (I) below:

(I)

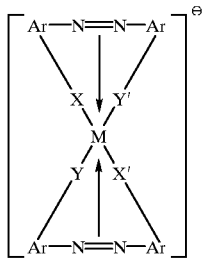

$A^{\oplus}$, wherein M denotes a coordination center metal selected from the group consisting of Cr, Co, Ni, Mn, Fe, Ti and Al; Ar denotes an aryl group capable of having a substituent, selected from include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^{\oplus}$ denotes a hydrogen, sodium, potassium, ammonium or aliphatic ammonium ion or a mixture of such ions.

17. The toner according to claim 15, wherein the charge control agent is a basic organometallic compound represented by formula (II) below:

(II)

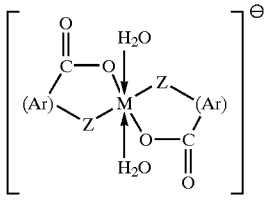

$A^{\oplus}$, wherein M denotes a coordination center metal selected from the group consisting of Cr, Co, Ni, Mn, Fe, Ti, Zr, Zn, Si, B and Al; Ar denotes an aryl group capable of having a substituted selected from nitro, halogen, carboxyl, anilide and alkyls and alkoxyles having 1–18 carbon atoms; Z denotes —O— or —CO—O—; and $A^{\oplus}$ denotes a hydrogen, sodium potassium, ammonium or aliphatic ammonium ion, or a mixture of such ions.

18. The toner according to claim 15, wherein the charge control agent is an azo iron complex represented by formula (III) belows: Formula (III):

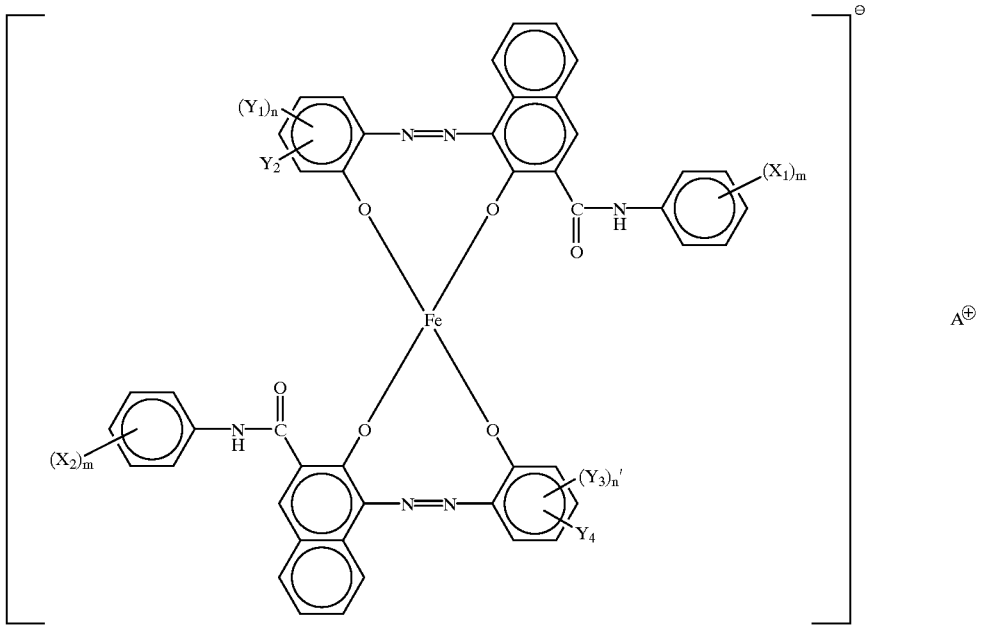

wherein $X_1$ and $X_2$ independently denote hydrogen, alkyl having 1–18 carbon atoms, alkoxy having 1–18 carbon atoms, nitro or halogen; m and m' denote an integer of 1–3; $Y_1$ and $Y_3$ independently denote hydrogen, alkyl having 1–18 carbon atoms, alkenyl having 2–18 carbon atoms, sulfonamide, mesyl, sulfonic acid, carboxy ester, hydroxy, alkoxy having 1–18 carbon atoms, acetylamino, benzoylamino or halogen; n and n' denote an integer of 1–3; $Y_2$ and $Y_4$ independently denote hydrogen or nitro; and $A^{\oplus}$ denotes an ammonium, hydrogen, sodium or potassium ion, or a mixture such ions.

19. The toner according to claim 15, wherein the charge control agent is an azo iron metal complex represented by formula (IV) shown below: Formula (IV):

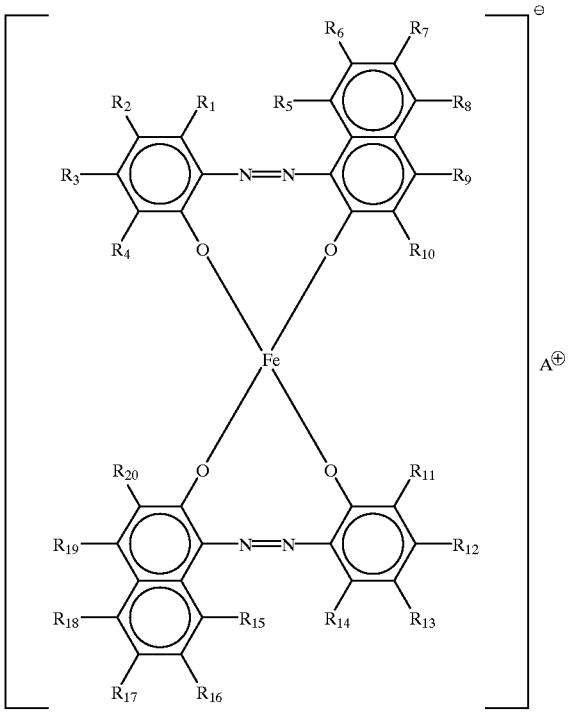

wherein $R_1$–$R_{20}$ independently denote hydrogen, halogen or alkyl; and $A^{\oplus}$ denotes an ammonium, hydrogen, sodium, or potassium ion, or a mixture of such ions.

20. The toner according to claim 1, wherein the toner particles further contain 0.2–20 wt. parts of a release agent per 100 wt. parts of the binder resin.

21. The toner according to claim 1, wherein the release agent has a melting point of 65–160° C.

22. The toner according to claim 1, wherein 100–300 iron-containing isolated particles are present per 10,000 toner particles, and the magnetic iron oxide particles have a surface found of an oxide or/and a hydroxide.

23. The toner according to claim 1, wherein the toner contains a tetrahydrofuran (THF)-soluble content showing a molecular-distribution according to gel-permeation chromatography (GPC) providing a main peak in a molecular weight region of 2,000–25,000.

24. The toner according to claim 22, wherein the toner contains a tetrahydrofuran (THF)-soluble content showing a molecular-distribution according to gel-permeation chromatography (GPC) providing a main peak in a molecular weight region of 2,000–25,000.

25. The toner according to claim 1, wherein the toner has a Carr's floodability index exceeding 80.

26. The toner according to claim 1, wherein the toner has a Carr's flowability index exceeding 60.

27. The toner according to claim 25, wherein the toner has a Carr's floodability index of 81–89.

28. The toner according to claim 26, wherein the toner has a Carr's flowability index of 61–79.

29. The toner according to claim 1, wherein the toner has a Carr's floodability index exceeding 80, and a Carr's flowability index exceeding 60.

30. The toner according to claim 22, wherein the toner has a Carr's floodability index of 81–89, and a Carr's flowability index of 61–79.

31. The toner according to claim 22, wherein the toner has a Carr's floodability index exceeding 80.

32. The toner according to claim 22, wherein the toner has a Carr's flowability index exceeding 60.

33. The toner according to claim 31, wherein the toner has a Carr's floodability index of 81–89.

34. The toner according to claim 32, wherein the toner has a Carr's flowability index of 61–79.

35. The toner according to claim 22, wherein the toner has a Carr's floodability index exceeding 80, and a Carr's flowability index exceeding 60.

36. The toner according to claim 22, wherein the toner has a Carr's floodability index of 81–89, and a Carr's flowability index of 61–79.

37. The toner according to claim 1, wherein the toner shows a number-basis particle size distribution taken over 256 channel according to the Coulter counter method providing a peak particle size x and a half-value width y of the peak satisfying a following formula:

$$2.06x-9.113 \leqq y \leqq 2.06x-7.341.$$

38. The toner according to claim 1, wherein the toner exhibits an absolute value of triboelectric chargeability |Qd| ($\mu$C/g) relative to iron powder carrier satisfying: $70 \leqq |Qd| \geqq 20$.

39. The toner according to claim 1, wherein the toner shows a thermal behaving giving a heat-absorption curve according to DSC showing a maximum heat-absorption peak temperature Tmax in a range of 60–120° C.

40. The toner according to claim 39, wherein the heat-absorption curve also shows a sub heat-absorption peak temperature Tsub in a range of 60–160° C. satisfying:

$$|Tmax-Tsub| \geqq 20°\ C.$$

41. The toner according to claim 1, wherein the toner has a weight-average particle size of 5–10 $\mu$m.

42. The toner according to claim 1, wherein the iron-containing isolated particles comprise magnetic iron oxide particles having an average particle size of 0.1–0.4 $\mu$m.

43. The toner according to claim 1, wherein the magnetic toner particles have been obtained by melt-kneading toner ingredients including at least the binder resin, the magnetic iron oxide particles and a wax to form a melt-kneaded product, cooling the melt-kneaded product, coarsely crushing the cooled kneaded product to provide a crushed product, and pulverizing the crushed product by a mechanical pulverizer.

44. An image forming method, comprising the steps of:

developing an electrostatic image formed on an image-bearing member with a dry magnetic toner to form a toner image thereon, transferring the toner image onto a transfer material via or without via an intermediate transfer member, and fixing the toner image onto the transfer material under application of heat and pressure, wherein the dry magnetic toner comprises: magnetic toner particles each comprising at least a binder resin and magnetic iron oxide particles; wherein 100–350 iron-containing isolated particles are present per 10,000 toner particles;

the toner has a weight-average particle size X in a range of 5–12 $\mu$m; and contain at least 90% by number of particles satisfying a circularity Ci according to formula (1) of at least 0.900 with respect to particles of 3 $\mu$m or larger therein, $$Ci=L_0/L \quad (1),$$

wherein L denotes a peripheral length of a projection image of an individual particle, and L0 denotes a peripheral length of a circle giving an identical area as the projection image; and the toner satisfies either (a) (i) a cut percentage Z determined by formula (3) shown below satisfies formula (2) below with respect to the weight-average particle size X:

$$Z \leqq 5.3 \times X \quad (2),$$

$$Z=(1-B/A)\times 100 \quad (3),$$

wherein A denotes the number of total particles and B denotes the number of particles of 3 $\mu$m or larger, and (ii) the toner contains a number-basis percentage Y (%) of particles having $Ci \geqq 0.950$ within particles of 3 $\mu$m or larger satisfying:

$$Y \geqq X^{-0.645} \times \exp 5.51 \quad (4), \text{ or}$$

(b) (iii) a cut percentage Z determined by the formula (3) above satisfies formula (5) below with respect to the weight-average size X:

$$Z > 5.3 \times X \quad (5), \text{ and}$$

percentage Y (%) of particles having $Ci \geqq 0.950$ within particles of 3 $\mu$m or larger satisfying:

$$Y \geqq X^{-0.545} \times \exp 5.37 \quad (6).$$

45. The method according to claim 44, wherein the image-bearing member is charged by a contact charging means and then exposed to light to form the electrostatic image in the form of a digital latent image; the digital latent image is developed with the dry magnetic toner retained in a developing means to form the toner image on the image-bearing member; and the toner image on the image-bearing member is transferred onto the transfer material by a contact transfer means supplied with a transfer bias voltage and pressed against the transfer material.

46. The method according to claim 45, wherein the developing means comprises a developing sleeve enclosing a magnetic field generating means therein, and an elastic blade disposed for forming a magnetic toner layer on the developing sleeve.

47. The method according to claim 44, wherein the image-bearing member is charged by the contact charging means according to an injection changing mode, and the developing means contains electro-conductive fine powder externally blended with the toner particles.

48. An image forming method, comprising the steps of:

developing an electrostatic image formed on an image-bearing member with a dry magnetic toner to form a toner image thereon, transferring the toner image onto a transfer material via or without via an intermediate transfer member, and fixing the toner image onto the transfer material under application of heat and pressure, wherein the dry magnetic toner comprises: magnetic toner particles each comprising at least a binder resin and magnetic iron oxide particles; wherein 100–350 iron-containing isolated particles are present per 10,000 toner particles;

the toner has a weight-average particle size X in a range of 5–12 μm; and contain at least 90% by number of particles satisfying a circularity Ci according to formula (1) below of 0.900 with respect to particles of 3 μm or larger therein, $$Ci=L_0/L \quad (1),$$

wherein L denotes a peripheral length of a projection image of an individual particle, and $L_0$ denotes a peripheral length of a circle giving an identical area as the projection image; and the toner satisfies either (a) (i) a cut percentage Z determined by formula (3) shown below satisfies formula (2) below with respect to the weight-average particle size X:

$$Z \leqq 5.3 \times X \quad (2),$$

$$Z=(1-B/A)\times 100 \quad (3),$$

wherein A denotes the number of total particles and B denotes the number of particles of 3 μm or larger, and (ii) the toner contains a number-basis percentage Y (%) of particles having Ci≧0.950 within particles of 3 μm or larger satisfying:

$$Y \geqq X^{-0.645} \times \exp 5.51 \quad (4), \text{ or}$$

(b) (iii) a cut percentage Z determined by the formula (3) above satisfies formula (5) below with respect to the weight-average particle size X:

$$Z > 5.3 \times X \quad (5), \text{ and}$$

percentage Y (%) of particles having Ci≧0.950 within particles of 3 μm or larger satisfying:

$$Y \geqq X^{-0.545} \times \exp 5.37 \quad (6),$$

wherein the dry magnetic toner is the dry magnetic toner according to any one of claims 2–43.

49. A process-cartridge comprising: an image-bearing member, and a developing means containing a dry magnetic toner for developing an electrostatic image formed on the image-bearing member, said image-bearing member and the developing means being integrally supported to form a cartridge which is detachably mountable to a main assembly of image forming apparatus, wherein the dry magnetic toner comprises: magnetic toner particles each comprising at least a binder resin and magnetic iron oxide particles; wherein 100–350 iron-containing isolated particles are present per 10,000 toner particles;

the toner has a weight-average particle size X in a range of 5–12 μm; and contain at least 90% by number of particles satisfying a circularity Ci according to formula (1) of at least 0.900 with respect to particles of 3 μm or larger therein, $$Ci=L0/L \quad (1),$$

wherein L denotes a peripheral length of a projection image of an individual particle, and L0 denotes a peripheral length of a circle giving an identical area as the projection image; and the toner satisfies either (a) (i) a cut percentage Z determined by formula (3) shown below satisfies formula (2) below with respect to the weight-average particle size X:

$$Z \leqq 5.3 \times X \quad (2),$$

$$Z=(1-B/A)\times 100 \quad (3),$$

wherein A denotes the number of total particles and B denotes the number of particles of 3 μm or larger, and (ii) the toner contains a number-basis percentage Y (%) of particles having Ci≧0.950 within particles of 3 μm or larger satisfying:

$$Y \geqq X^{-0.645} \times \exp 5.51 \quad (4), \text{ or}$$

(b) (iii) a cut percentage Z determined by the formula (3) above satisfies formula (5) below with respect to the weight-average particle size X:

$$Z > 5.3 \times X \quad (5), \text{ and}$$

percentage Y (%) of particles having Ci≧0.950 within particles of 3 μm or larger satisfying:

$$Y \geqq X^{-0.545} \times \exp 5.37 \quad (6).$$

50. The process-cartridge according to claim 49, wherein the image-bearing member comprises a photosensitive drum.

51. The process-cartridge according to claim 49, further comprising a contact charging means.

52. A process-cartridge comprising: an image-bearing member, and a developing means containing a dry magnetic toner for developing an electrostatic image formed on the image-bearing member, said image-bearing member and the developing means being integrally supported to form a cartridge which is detachably mountable to a main assembly of image forming apparatus, wherein the dry magnetic toner comprises: magnetic toner particles each comprising at least a binder resin and magnetic iron oxide particles; wherein 100–350 iron-containing isolated particles are present per 10,000 toner particles;

the toner has a weight-average particle size X in a range of 5–12 μm; and contain at least 90% by number of particles satisfying a circularity Ci according to formula (1) below of 0.900 with respect to particles of 3 μm or larger therein, $$Ci=L_0/L \quad (1),$$

wherein L denotes a peripheral length of a projection image of an individual particle, and $L_0$ denotes a peripheral length of a circle giving an identical area as the projection image; and the toner satisfies either (a) (i) a cut percentage Z determined by formula (3) shown below satisfies formula (2) below with respect to the weight-average particle size X:

$$Z \leqq 5.3 \text{ x} X \quad (2),$$

$$Z=(1-B/A)\times 100 \quad (3),$$

wherein A denotes the number of total particles and B denotes the number of particles of 3 μm or larger, and (ii) the toner contains a number-basis percentage Y (%) of particles having Ci≦0.950 within particles of 3 μm or larger satisfying:

$$Y \geqq X^{-0.645} \times \exp 5.51 \quad (4), \text{ or}$$

(b) (iii) a cut percentage Z determined by the formula (3) above satifies formula (5) below with respect to the weight-average particle size X:

$$Z > 5.3 \times X \quad (5), \text{ and}$$

percentage Y (%) of particles having Ci≧0.950 within particles of 3 μm or larger satisfying:

$$Y \geqq X^{-0.545} \times \exp 5.37 \quad (6),$$

wherein the dry magnetic toner is the dry magnetic toner according to any one of claims 2 to 43.

* * * * *

UNITED STATES PATENT AND TRADEMARK OFFICE

CERTIFICATE OF CORRECTION

PATENT NO. : 6,589,701 B2
DATED : July 8, 2003
INVENTOR(S) : Katsuhisa Yamazaki et al.

It is certified that error appears in the above-identified patent and that said Letters Patent is hereby corrected as shown below:

Column 5,
Line 27, "contain" should read -- contains --.

Column 6,
Line 62, "sowing" should read -- showing --.

Column 8,
Line 62, "Cav." should read -- Cav --.

Column 11,
Line 20, "ai" should read -- a --; and
Line 54, "$Y \geqq \exp 5.37 x X^{-0.545}$)," should read -- $Y \geqq \exp 5.37 x X^{-0.545}$, --.

Column 12,
Line 15, "having" should be deleted; and
Line 40, "is" should read -- are --.

Column 15,
Line 5, "may" should read -- may be --; and
Line 7, "merization" should read -- merization, or --.

Column 16,
Line 42, "luthenium" should read -- ruthenium --; and
Line 49, "retarded" should read -- regarded --.

Column 19,
Line 14, "of" should be deleted.

Column 21,
Line 11, "Rohdamine" should read -- Rhodamine --;
Line 38, "eicosy" should read -- eicosyl --; and
Line 53, "calcium stearate," (second ocurrence) should be deleted.

Column 23,
Line 17, "include;" should be deleted.

Column 24,
Line 15, "substituted" should read -- substituent --;
Line 16, "alkoxyles" should read -- alkoxyls --;
Line 18, "sodium" should read -- sodium, --; and
Line 63, "such" should read -- of such --.

UNITED STATES PATENT AND TRADEMARK OFFICE

CERTIFICATE OF CORRECTION

PATENT NO. : 6,589,701 B2
DATED : July 8, 2003
INVENTOR(S) : Katsuhisa Yamazaki et al.

It is certified that error appears in the above-identified patent and that said Letters Patent is hereby corrected as shown below:

Column 41,
Line 4, “classified,” should read -- classifier, --.

Column 42,
Line 47, "provide" should read -- provided --.

Column 43,
Line 3, "ca" should read -- can --; and
Line 36, "flow" should read -- flows --.

Column 45,
Line 10, "point-arrange" should read -- point-average --.

Column 46,
Line 48, "e" should read -- be --.

Column 47,
Line 5, "discharge" should read -- discharged --;
Line 24, Close up right margin;
Line 25, Close up left margin; and
Line 45, "Micron Separator and Turboplex (ATP);" should be deleted.

Column 48,
Line 16, "tone" should read -- toner --; and
Line 58, "f" should be deleted.

Column 49,
Line 20, "at" should read -- a --.

Column 50,
Line 33, "substantials" should read --substantially--; and
Line 54, "804 a" should read -- 804a --.

Column 51,
Line 8, "fie" should read -- fine --.

UNITED STATES PATENT AND TRADEMARK OFFICE

CERTIFICATE OF CORRECTION

PATENT NO. : 6,589,701 B2
DATED : July 8, 2003
INVENTOR(S) : Katsuhisa Yamazaki et al.

It is certified that error appears in the above-identified patent and that said Letters Patent is hereby corrected as shown below:

Column 52,
Line 27, "jected" should read -- jected to--; and "MIX-MALLER' should read -- MIX-MULLER --; and
Line 6, "and the sodium silicate" should read -- and the sodium hydioxide) --.

Column 55,
TABLE 1, "dodecenylsuccinicc" should read -- dodecenylsuccinic--; and
TABLE 2, "Fischer-Tropschc" should read -- Fischer-Tropsche --.

Column 56,
Line 4, "were" should read -- was --; and
Line 22, "hydrohobization" should read -- hydrophobization --.

Column 57,
Line 16, "are" should read -- and --.

Column 67,
Line 33, "hydrohobization" should read -- hydrophobization --.

Column 74,
Line 31, "include:" should read -- the group consisting of --;
Line 58, "substituted" should read -- substituent --;
Line 59, "alkoxyles" should read -- alkoxyls --;
Line 61, "sodium" should read -- sodium, --; and
Line 67, "belows:" should read -- below --; and "Formula (III)" should read -- ¶ Formula (III): --.

Column 75,
Line 3, "such" should read -- of such --; and
Line 36, "Formula (IV):" should read -- ¶ Formula (IV): --.

Column 76,
Line 42, "found" should read -- formed --.

Column 77,
Line 23, "channel" should read -- channels --; and
Line 33, "behaving" should read -- behavior --.

UNITED STATES PATENT AND TRADEMARK OFFICE

CERTIFICATE OF CORRECTION

PATENT NO. : 6,589,701 B2
DATED : July 8, 2003
INVENTOR(S) : Katsuhisa Yamazaki et al.

It is certified that error appears in the above-identified patent and that said Letters Patent is hereby corrected as shown below:

Column 78,
Line 2, "contain" should read -- contains --; and
Line 10, "L0" should read -- $L_0$ --.

Column 79,
Line 64, "*Ci=L0/L*" should read -- $Ci=L_0/L$ --; and
Line 66, "L0" should read -- $L_0$ --.

Column 81,
Line 2, "Ci≦0.950" should read -- Ci≧0.950 --.

Signed and Sealed this

Fourteenth Day of September, 2004

JON W. DUDAS
*Director of the United States Patent and Trademark Office*